US010469961B2

(12) United States Patent
Chen et al.

(10) Patent No.: US 10,469,961 B2
(45) Date of Patent: *Nov. 5, 2019

(54) BINAURAL HEARING SYSTEMS AND METHODS FOR PRESERVING AN INTERAURAL LEVEL DIFFERENCE BETWEEN SIGNALS GENERATED FOR EACH EAR OF A USER

(71) Applicant: Advanced Bionics AG, Staefa (CH)

(72) Inventors: Chen Chen, Valencia, CA (US); Dean Swan, Stevenson Ranch, CA (US); Leonid M. Litvak, Los Angeles, CA (US)

(73) Assignee: Advanced Bionics AG, Staefa (CH)

( * ) Notice: Subject to any disclaimer, the term of this patent is extended or adjusted under 35 U.S.C. 154(b) by 0 days.

This patent is subject to a terminal disclaimer.

(21) Appl. No.: 16/120,203

(22) Filed: Aug. 31, 2018

(65) Prior Publication Data

US 2019/0045308 A1 Feb. 7, 2019

Related U.S. Application Data

(63) Continuation of application No. 15/908,776, filed on Feb. 28, 2018, now Pat. No. 10,091,592, which is a (Continued)

(51) Int. Cl.
*H04R 25/00* (2006.01)

(52) U.S. Cl.
CPC ..... *H04R 25/552* (2013.01); *H04R 25/453* (2013.01); *H04R 25/505* (2013.01); *H04R 2225/67* (2013.01)

(58) Field of Classification Search
CPC ... H04R 25/453; H04R 25/552; H04R 25/505
See application file for complete search history.

(56) References Cited

U.S. PATENT DOCUMENTS 8,971,557 B2 3/2015 Xia et al.
9,199,079 B2 12/2015 Saoji
(Continued)

FOREIGN PATENT DOCUMENTS

DE 19704119 10/1998
WO WO-2011/006496 1/2011
WO WO-2011/101045 8/2011

OTHER PUBLICATIONS

Merks, et al., "Designs of a Broadside Array for Binaural Hearing Aid", Applications of Signal Processing to Audio and Acoustics, 1997. 1997 I EEE ASSP Workshop on New Paltz, NY, USA Oct. 19-22, 1997, p. 4pp, XP010248190, ISBN: 978-0-7803-3908-8.
(Continued)

*Primary Examiner* — Simon King
(74) *Attorney, Agent, or Firm* — ALG Intellectual Property, LLC

(57) ABSTRACT

A binaural hearing system includes a binaural pair of microphones that are configured to be located, respectively, at a first ear and a second ear of a user. The system further includes an interconnected binaural pair of sound processors that are associated with the binaural pair of microphones. The sound processors are configured to preserve an interaural level difference ("ILD") between a first signal generated by the first microphone and a second signal generated by the second microphone. The sound processors do this by performing a contralateral gain synchronization operation to a first degree with respect to the first and second signals at the first sound processor, and to a second degree with respect to the first and second signals at the second sound processor, where the first degree is distinct from the second degree or at least one of the first and second degrees is a partial degree.

25 Claims, 27 Drawing Sheets

Related U.S. Application Data continuation-in-part of application No. PCT/US2017/042274, filed on Jul. 14, 2017.

(60) Provisional application No. 62/379,223, filed on Aug. 24, 2016.

(56) References Cited

U.S. PATENT DOCUMENTS

| | | | | |
|---|---|---|---|---|
| 9,338,563 | B2 | 5/2016 | Xia et al. | |
| 2002/0041695 | A1 | 4/2002 | Luo | |
| 2004/0190734 | A1 | 9/2004 | Kates | |
| 2013/0158629 | A1* | 6/2013 | Schleich | A61N 1/36036 607/57 |
| 2014/0219486 | A1* | 8/2014 | Brown | H04R 25/43 381/320 |
| 2017/0043162 | A1* | 2/2017 | Lopez-Poveda | A61N 1/36032 |
| 2017/0094440 | A1* | 3/2017 | Brown | H04S 7/30 |
| 2017/0272882 | A1* | 9/2017 | Oh | H04S 1/00 |
| 2018/0091907 | A1 | 3/2018 | Long et al. | |

OTHER PUBLICATIONS

International Search Report and Written Opinion received in International Application No. PCT/US17/042273, dated Oct. 19, 2017.
International Search Report and Written Opinion received in International Application No. PCT/US17/042274, dated Oct. 19, 2017.

* cited by examiner

1600

1700

2202

Hearing Profile for User 1

2204

Hearing Ideology/Demographic Information

- Prelingual or postlingual deaf
- Age when hearing loss occurred
- Age when first hearing device used
- Age when first device implanted
- Age when second device implanted
- Etc.

2206

Hearing Profile Test Results

- Aided hearing thresholds
- Speech scores for first ear alone
- Speech score for second ear alone
- Speech score of both ears together
- Localization ability
- Psychoacoustic tests for binaural cues (ITD/ILD sensitivity on electrode pairs)
- Etc.

2208

Hearing Profile Objective Measurements

- Psychoacoustic tests for binaural cues (ITD/ILD sensitivity on electrode pairs)
- Physiological measurements (peripheral signals (EABR), central potential, ECoG potentials for residual hearing, etc.)
- Imaging of electrode placement
- Etc.

Fig. 22

BINAURAL HEARING SYSTEMS AND METHODS FOR PRESERVING AN INTERAURAL LEVEL DIFFERENCE BETWEEN SIGNALS GENERATED FOR EACH EAR OF A USER

RELATED APPLICATIONS

The present application is a continuation of U.S. patent application Ser. No. 15/908,776, filed Feb. 28, 2018, which application is a continuation-in-part application of PCT International Application No. PCT/US17/42274, filed Jul. 14, 2017, which application claims priority to U.S. Provisional Patent Application No. 62/379,223, filed Aug. 24, 2016. Each of these applications are incorporated herein by reference in their respective entireties.

BACKGROUND INFORMATION

One way that spatial locations of sound sources may be resolved is by a listener perceiving an interaural level difference ("ILD") of a sound at each of the two ears of the listener. For example, if the listener perceives that a sound has a relatively high level (i.e., is relatively loud) at his or her left ear as compared to having a relatively low level (i.e., being relatively quiet) at his or her right ear, the listener may determine, based on the ILD between the sound at each ear, that the spatial location of the sound source is to the left of the listener. The relative magnitude of the ILD may further indicate to the listener whether the sound source is located slightly to the left of center (in the case of a relatively small ILD) or further to the left (in the case of a larger ILD). In this way, listeners may use ILD cues along with other types of spatial cues (e.g., interaural time difference ("ITD") cues, etc.) to localize various sound sources in the world around them, as well as to segregate and/or distinguish the sound sources from noise and/or from other sound sources.

Unfortunately, many binaural hearing systems (e.g., cochlear implant systems, hearing aid systems, earphone systems, mixed hearing systems, etc.) are not configured to preserve ILD cues in representations of sound provided to users relying on the binaural hearing systems. As a result, it may be difficult for the users to localize sound sources around themselves or to segregate and/or distinguish particular sound sources from other sound sources or from noise in the environment surrounding the users. Even binaural hearing systems that attempt to encode ILD cues into representations of sound provided to users have been of limited use in enabling the users to successfully and easily localize the sound sources around them. For example, some binaural hearing systems have attempted to detect, estimate, and/or compute ILD and/or ITD spatial cues, and then to convert and/or reproduce the spatial cues to present them as ILD cues to the user. Unfortunately, the detection, estimation, conversion, and reproduction of ILD and/or ITD spatial cues tend to be difficult, processing-intensive, and error-prone. For example, noise, distortion, signal processing errors and artifacts, etc., all may be difficult to control and account for in techniques for detecting, estimating, converting, and/or reproducing these spatial cues. As a result, when imperfect spatial cues are presented to users of binaural hearing systems due to these difficulties, the users may inaccurately localize sound sources or be disoriented, confused, and/or misled by conflicting or erroneous spatial cues. For example, a user may perceive that a sound source is moving around when the sound source is actually stationary.

Moreover, independent signal processing at each ear (e.g., various types of gain processing such as automatic gain control, noise cancellation, wind cancellation, reverberation cancellation, impulse cancellation, and the like, performed by respective sound processors at each ear) may deteriorate spatial cues even if the spatial cues are detected, estimated, converted, and/or reproduced without errors or artifacts. For example, a sound coming from the left of the user may be detected to have a relatively high level at the left ear and a relatively low level at the right ear, but that level difference may deteriorate as various stages of gain processing at each ear independently process the signal (e.g., including by adjusting the signal level) prior to presenting a representation of the sound to the user at each ear.

BRIEF DESCRIPTION OF THE DRAWINGS

The accompanying drawings illustrate various embodiments and are a part of the specification. The illustrated embodiments are merely examples and do not limit the scope of the disclosure. Throughout the drawings, identical or similar reference numbers designate identical or similar elements.

FIG. 22 illustrates an exemplary hearing profile for an exemplary user according to principles described herein.

DETAILED DESCRIPTION

Figure 1:
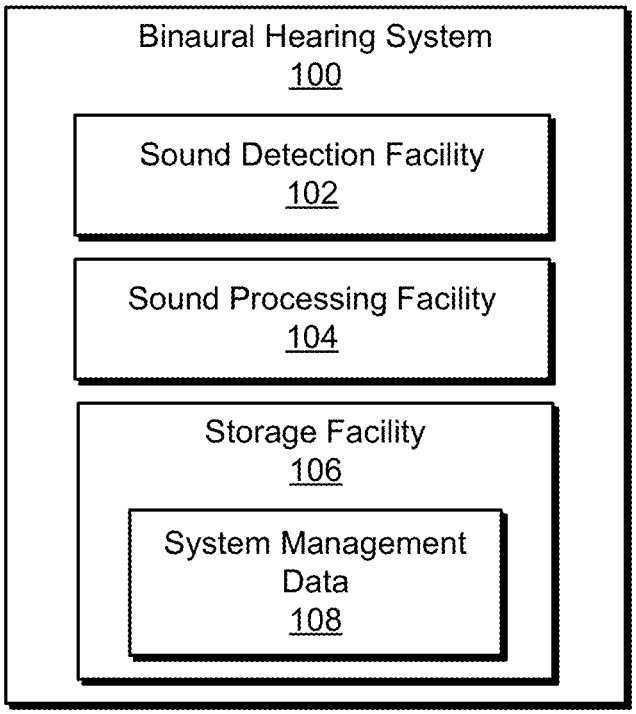
FIG. 1 illustrates exemplary components of an exemplary binaural hearing system for facilitating interaural level difference ("ILD") perception by a user of the binaural hearing system according to principles described herein.

Systems and methods for facilitating interaural level difference ("ILD") perception by users of binaural hearing systems (e.g., by enhancing and/or preserving the ILD) are described herein. Moreover, in certain examples disclosed herein, binaural systems and methods may preserve and/or enhance an ILD to a distinct degree for each ear of a user (e.g., preserving and/or enhancing the ILD to a first degree for one ear of the user and preserving and/or enhancing the ILD to a second, different degree for the other ear of the user).

As will be illustrated and described in more detail below, a binaural hearing system (e.g., a cochlear implant system, a hearing aid system, an earphone system, a mixed hearing system including a combination of these, etc.) used by a user (e.g., a cochlear implant or hearing aid patient, an earphone user, etc.) may include a binaural pair of audio detectors, a binaural pair of sound processors associated with the binaural pair of audio detectors, and a communication link interconnecting the binaural pair of sound processors.

The binaural pair of audio detectors may include a first audio detector (e.g., a microphone) that generates (e.g., in accordance with a first polar pattern such as a polar pattern that mimics a natural polar pattern of the ear, a directional polar pattern, etc.) a first signal representative of an audio signal (e.g., a sound or combination of sounds from one or more sound sources within hearing distance of the user) presented to the user as the audio signal is detected by the first audio detector at a first ear of the user. Additionally, the binaural pair of audio detectors may further include a second audio detector that generates (e.g., in accordance with a second polar pattern such as a polar pattern that forms a mirror-image equivalent of the first polar pattern) a second signal representative of the audio signal as detected by the second audio detector at a second ear of the user.

The binaural pair of sound processors may include a first sound processor associated with the first ear and coupled directly to the first audio detector and a second sound processor associated with the second ear and coupled directly to the second audio detector. The first sound processor and the second sound processor may also be communicatively coupled with one another by way of the communication link (e.g., a wireless audio transmission link) so as to enable transmission of the first and second signals between the first and second sound processors. For example, the first signal representative of the audio signal as detected by the first audio detector at the first ear and the second signal representative of the audio signal as detected by the second audio detector at the second ear may be exchanged between the sound processors by way of the communication link. By each processing both the first signal and the second signal, the sound processors may present representations of the audio signal to the user in a way that preserves and/or enhances ILD cues (e.g., to a distinct degree for each ear of the user in certain examples) to facilitate ILD perception by the user.

For example, the first sound processor may enhance the ILD between the first and second signals by: receiving the first signal directly from the first audio detector; receiving the second signal from the second sound processor via the communication link interconnecting the first and second sound processors; generating, based on a first beamforming operation using the first and second signals, a first directional signal representative of a spatial filtering of the audio signal detected at the first ear according to an end-fire directional polar pattern different from the first and second polar patterns; and presenting an output signal representative of the first directional signal to the user at the first ear of the user.

Similarly, in some examples, the second sound processor may further enhance the ILD between the first and second signals in parallel with the first sound processor by: receiving the second signal directly from the second audio detector; receiving the first signal from the first sound processor via the communication link interconnecting the first and second sound processors; generating, based on a second beamforming operation using the first and second signals, a second directional signal representative of a spatial filtering of the audio signal detected at the second ear according to the end-fire directional polar pattern; and presenting an output signal representative of the second directional signal to the user at the second ear of the user. In other examples, the second sound processor may process sound asymmetrically from the first sound processor (e.g., not further enhancing the ILD). For example, the second sound processor may present an output signal representative of the second signal only, a non-directional combination of the first and second signals, a directional signal asymmetric with the first directional signal, and/or any other output signal as may serve a particular implementation.

In the same or other examples, the first sound processor may preserve the ILD between the first and second signals as the first sound processor performs a gain processing operation (e.g., an automatic gain control operation, a noise cancellation operation, a wind cancellation operation, a reverberation cancellation operation, an impulse cancellation operation, etc.) on a signal representative of at least one of the first and second signals prior to presenting a gain-processed output signal representative of the first signal to the user at the first ear. For example, the first sound processor may preserve the ILD by: receiving the first signal directly from the first audio detector; receiving the second signal from the second sound processor via the communication link interconnecting the first and second sound processors; comparing the first and second signals; generating a gain processing parameter based on the comparison of the first and second signals; and performing, based on the gain processing parameter, the gain processing operation on the signal prior to presenting the gain-processed output signal representative of the first signal to the user (e.g., at the first ear of the user).

Similarly, and in parallel with the first sound processor, the second sound processor may preserve the ILD between the first and second signals as the second sound processor performs another gain processing operation on another signal representative of at least one of the first and second signals prior to presenting another gain-processed output signal representative of the second signal to the user at the second ear. For example, the second sound processor may similarly preserve the ILD by: receiving the second signal directly from the second audio detector; receiving the first signal from the first sound processor via the communication link interconnecting the first and second sound processors; comparing (e.g., independently from the comparison of the first and second signals by the first sound processor) the first and second signals; generating (e.g., independently from the generating performed by the first sound processor) a gain processing parameter (e.g., the same gain processing parameter independently generated by the first sound processor) based on the comparison of the first and second signals; and performing, based on the gain processing parameter, the other gain processing operation on the other signal prior to presenting the other gain-processed output signal to the user (e.g., at the second ear of the user).

Whether enhancing, preserving, or otherwise bolstering or optimizing the ILD, the sound processors included within the binaural pair of sound processors in exemplary binaural hearing systems described herein may be configured to process the ILD in a similar way at each ear (e.g., by performing identical or parallel operations at each sound processor) or to process the ILD in a distinct manner at each ear. In particular, as will be described in more detail below, binaural hearing systems described herein may, in certain examples, preserve the ILD to a distinct degree (e.g., a null degree, a partial degree, a full degree, etc.) for each ear of a user by preserving the ILD to a lesser degree for one ear and to a greater degree for the other ear. Examples of beamforming operations, gain processing operations, and various other aspects of enhancing and preserving ILD cues to facilitate ILD perception by users of binaural hearing systems will be provided below.

By performing operations described herein, binaural hearing systems may enhance and/or preserve ILD spatial cues and thereby provide users various benefits allowing the users to more easily, accurately, and/or successfully localize sound sources (i.e., spatially locate the sound sources), separate sounds, segregate sounds, and/or perceive sounds, especially when the sounds are generated by multiple sound sources (e.g., in an environment with lots of background noise, in a situation where multiple people are speaking at once, etc.). Moreover, the binaural hearing systems may provide these benefits even while avoiding the problems described above with respect to previous attempts to encode ILD spatial cues by binaural hearing systems.

As one example of a benefit of the binaural hearing systems described herein, a binaural hearing system may enhance an ILD between sounds detected at each ear (e.g., even when the sounds have a low frequency) by using beamforming operations to generate an end-fire directional polar pattern that includes statically-opposing, side-facing lobes at each ear (i.e., first and second lobes of the end-fire directional polar pattern that are each directed radially outward from the respective ears of the users, as will be described and illustrated below). Because the end-fire directional polar pattern may remain statically side-facing (e.g., rather than attempting to localize and/or otherwise analyze a sound source to attempt to aim the directional polar pattern at the sound source), processing resources may be minimized while cue estimation errors and undesirable noise and artifacts may be eliminated so that the user will not face disorienting and misleading scenarios such as those described above.

As another exemplary benefit, a binaural hearing system may synchronize gain processing between sound processors associated with each ear by comparing signals detected at both ears to independently generate the same gain processing parameters by which to perform gain processing operations at each ear. By synchronizing the gain processing in this way, ILD cues may be preserved (i.e., may not be prone to the deterioration described above) because signals may be processed in identical ways (i.e., according to identical gain processing parameters) prior to being presented to the user. In other words, by synchronizing the gain processing between the sound processors, signal levels may be amplified and/or attenuated together so that the difference between the signal levels remains constant (i.e., is preserved) even as various types of gain processing are performed on the signals.

Additionally, in some examples, users may enjoy certain incidental benefits from methods and systems described herein that may facilitate hearing in various ways other than the targeted improvements associated with ILD cues described above. For example, as a result of the beamforming described herein, certain noise may be reduced at each ear to create an effect analogous to an enhanced head shadow benefit for focusing on sound coming from the source and tuning out other sound in the area. Such noise reduction may increase a signal-to-noise ratio of sound heard or experienced by the user and may thereby increase the user's ability to perceive, understand, and/or enjoy the sound.

Various embodiments will now be described in more detail with reference to the figures. The disclosed methods and systems may provide one or more of the benefits mentioned above and/or various additional and/or alternative benefits that will be made apparent herein. For example, particular benefits may arise from binaural hearing systems for preserving and/or enhancing an ILD to a distinct degree for each ear of a user that will be described below in connection with a detailed description of such systems and methods.

FIG. 1 illustrates exemplary components of an exemplary binaural hearing system 100 ("system 100") for facilitating ILD perception (e.g., perception of ILD cues within audio signals) by a user of system 100. In various implementations, system 100 may include or be implemented by one or more different types of hearing systems. For example, as will be described in more detail below, system 100 may include or be implemented by a cochlear implant system, a hearing aid system, an earphone system (e.g., for hearing protection in military, industrial, music concert, and/or other situations involving loud sounds), a mixed system including at least two of these types of hearing systems (e.g., a cochlear implant system used for one ear with a hearing aid system used for the other ear, etc.), and/or any other type of hearing system that may serve a particular embodiment. System 100 may be configured to operate binaurally at each ear of a user. As such, in certain examples, system 100 may perform operations to facilitate ILD perception in a similar or identical way at each of the ears. Conversely, in other examples (e.g., for users who exhibit asymmetric hearing patterns, in particular hearing scenarios described herein, etc.), system 100 may perform operations to facilitate ILD perception in distinct ways at each of the ears. For instance, as will be described in more detail below, system 100 may perform certain operations (e.g., a contralateral gain synchronization operation) at one ear and not the other ear, to a first degree at one ear and to a second degree (e.g., a degree distinct from the first degree) at the other ear, or the like.

As shown, system 100 may include, without limitation, a sound detection facility 102, a sound processing facility 104, and a storage facility 106 selectively and communicatively coupled to one another. It will be recognized that although facilities 102 through 106 are shown to be separate facilities in FIG. 1, facilities 102 through 106 may be combined into fewer facilities, such as into a single facility, or divided into more facilities as may serve a particular implementation. Each of facilities 102 through 106 will now be described in more detail.

Sound detection facility 102 may include any hardware and/or software used for capturing audio signals presented to a user associated with system 100 (e.g., using system 100). For example, sound detection facility 102 may include one or more audio detectors such as microphones (e.g., omnidirectional microphones, T-MIC™ microphones from Advanced Bionics, etc.) and hardware equipment and/or software associated with the microphones (e.g., hardware and/or software configured to filter, beamform, or otherwise pre-process raw audio data detected by the microphones). In connection with these audio detectors, one or more microphones may be associated with each of the ears of the user such as by being positioned in a vicinity of the ear of the user as described above. Sound detection facility 102 may detect an audio signal presented to the user (e.g., a signal including sounds from the world around the user) at both ears of the user, and may provide two separate signals (i.e., separate signals representative of the audio signal as detected at each of the ears) to sound processing facility 104. Examples of audio detectors used to implement sound detection facility 102 will be described in more detail below.

Sound processing facility 104 may include any hardware and/or software used for receiving the signals generated and provided by sound detection facility 102 (i.e., the signals representative of the audio signal presented to the user as detected at both ears of the user), enhancing the ILD between the signals by generating respective side-facing directional signals for each ear using beamforming operations as described herein, and/or preserving the ILD between the signals by synchronizing gain processing parameters used to perform gain processing operations that would otherwise deteriorate the ILD as described herein.

Sound processing facility 104 may be implemented in any way as may serve a particular implementation. For instance, sound processing facility 104 may include or be implemented by two sound processors, each sound processor associated with one ear of the user and communicatively coupled to one another via a communication link. In some examples, these sound processors may perform operations to enhance and/or preserve the ILD between the signals in similar, parallel ways at each sound processor. In other examples, however, it may be desirable to perform certain operations to a first degree (i.e., to a first extent) at one sound processor while performing the operations to a second degree (e.g., to a second extent different from the first extent) at the other sound processor. For instance, in certain situations, it may be desirable for such operations (e.g., contralateral gain synchronization operations) to be performed to a full degree (i.e., to a full extent) at one sound processor while being performed to a null degree (i.e., performed to an insignificant extent or not performed at all) at the other sound processor.

In one exemplary hearing system, each sound processor may be included within a binaural cochlear implant system and may be communicatively coupled with a cochlear implant within the user. An exemplary cochlear implant system will be described and illustrated below with respect to FIG. 2. In implementations involving a sound processor included within a cochlear implant system, the sound processor may present an output signal (e.g., a gain-processed output signal that has undergone one or more stages of synchronized gain processing within the sound processor) to the user at the ear of the user by directing the cochlear implant to provide electrical stimulation, based on the output signal, to one or more locations within a cochlea of the user. For example, the output signal may be representative of the signal provided by sound detection facility 102 and, in certain implementations, may be a directional signal (e.g., a side-facing directional signal) generated by sound processing facility 104 based on a beamforming operation.

As another example, each sound processor may be included within a binaural hearing aid system and may be communicatively coupled with an electroacoustic transducer configured to reproduce sound representative of auditory stimuli within an environment occupied by the user (e.g., the audio signal presented to the user). In implementations involving a sound processor included within a hearing aid system, the sound processor may present an output signal (e.g., a gain-processed output signal that has undergone one or more stages of synchronized gain processing within the sound processor) to the user at the ear of the user by directing the electroacoustic transducer to reproduce, based on the output signal, sound representative of the auditory stimuli within the environment occupied by the user. For example, the output signal may be representative of the signal provided by sound detection facility 102 and, in certain implementations, may be a directional signal (e.g., a side-facing directional signal) generated by sound processing facility 104 based on a beamforming operation.

As yet another example, each sound processor may be included within a binaural earphone system and may be communicatively coupled with an electroacoustic transducer configured to generate sound to be heard by the user (e.g., the audio signal presented to the user, a simulated sound, a prerecorded sound, etc.). In implementations involving a sound processor included within an earphone system, the sound processor may present an output signal (e.g., a gain-processed output signal that has undergone one or more stages of synchronized gain processing within the sound processor) to the user at the ear of the user by directing the electroacoustic transducer to generate, based on the output signal, sound to be heard by the user. For example, the output signal may be representative of the signal provided by sound detection facility 102 and, in certain implementations, may be a directional signal (e.g., a side-facing directional signal) generated by sound processing facility 104 based on a beamforming operation.

Certain implementations of sound processing facility 104 may include both a first sound processor included within a first hearing system of a first type (e.g., a cochlear implant system, a hearing aid system, or an earphone system) and a second sound processor included within a second hearing system of a second type (e.g., a different type of hearing system from the first type). In these implementations, each sound processor may present respective output signals to the user at the respective ears of the user by the respective hearing systems used at each ear, as described above. For example, a first output signal may be presented by a first hearing system of a cochlear implant system type to a first ear of the user by directing the cochlear implant to provide electrical stimulation, based on the output signal, to one or more locations within a cochlea of the user. Concurrently, a second output signal may be presented by a second hearing system of a hearing aid system type to a second ear of the user by directing the electroacoustic transducer to reproduce, based on the output signal, sound representative of the auditory stimuli within the environment occupied by the user.

Regardless of what type (or types) of hearing system is (or are) used, the processing resources of sound processing facility 104 may be distributed in any way as may serve a particular implementation. For instance, while, in some examples, sound processing facility 104 may include sound processing resources at each ear of the user (e.g., using behind-the-ear sound processors at each ear), in other examples, sound processing facility 104 may be implemented by a single sound processing unit (e.g., a body worn unit) configured to process signals detected at microphones associated with each ear of the user or by another type of sound processor located elsewhere (e.g., within a headpiece, implanted within the user, etc.). Accordingly, as used herein, a sound processor, an audio detector (e.g., a microphone), or another component of a cochlear implant system described herein may be "associated with" an ear of a user if the component performs operations for a side of the user (e.g., a left side or a right side) at which the ear is located. For example, in some implementations, a sound processor may be associated with a particular ear by being a behind-the-ear sound processor worn behind the ear. In other examples, a sound processor may not be worn on the ear but may be implanted within the user, implemented partially or entirely in a headpiece worn on the head but not on or touching the ear, implemented in a body worn unit, or the like. In these examples too, the sound processor may be associated with the ear if the sound processor performs processing operations for signals used for or associated with the side of the user the ear is on, regardless of how or where if the sound processor is implemented.

Storage facility 106 may maintain system management data 108 and/or any other data received, generated, managed, maintained, used, and/or transmitted by facilities 102 or 104 in a particular implementation. System management data 108 may include audio signal data, beamforming data (e.g., beamforming parameters, coefficients, etc.), gain processing data (e.g., gain processing parameters, etc.) and so forth, as may be used by facilities 102 or 104 in a particular implementation.

Figure 2:
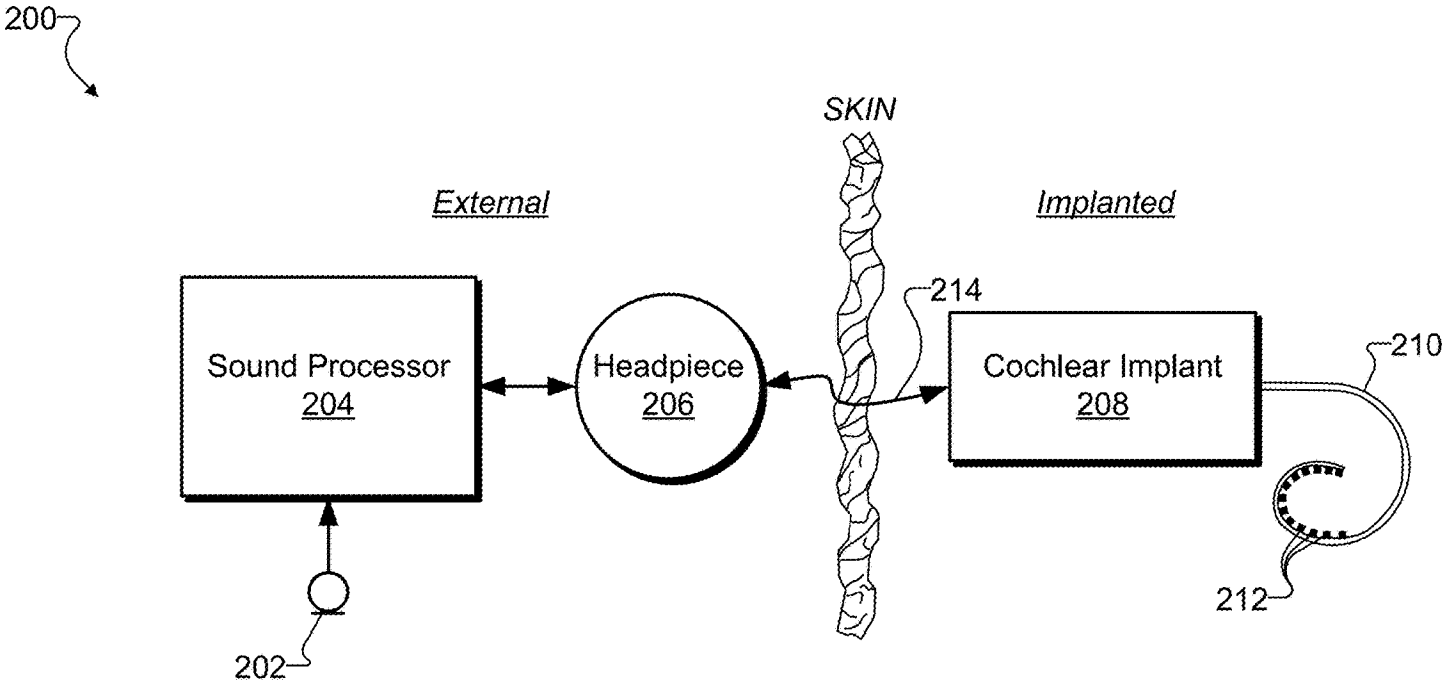
FIG. 2 illustrates an exemplary cochlear implant system according to principles described herein.

As described above, system 100 may include one or more cochlear implant systems (e.g., a binaural cochlear implant system, a mixed hearing system with a cochlear implant system used for one ear, etc.). To illustrate, FIG. 2 shows an exemplary cochlear implant system 200. As shown, cochlear implant system 200 may include various components configured to be located external to a cochlear implant patient (i.e., a user of the cochlear implant system) including, but not limited to, a microphone 202, a sound processor 204, and a headpiece 206. Cochlear implant system 200 may further include various components configured to be implanted within the patient including, but not limited to, a cochlear implant 208 (also referred to as an implantable cochlear stimulator) and a lead 210 (also referred to as an intracochlear electrode array) with a plurality of electrodes 212 disposed thereon. As will be described in more detail below, additional or alternative components may be included within cochlear implant system 200 as may serve a particular implementation. The components shown in FIG. 2 will now be described in more detail.

Microphone 202 may be configured to detect audio signals presented to the patient. Microphone 202 may be implemented in any suitable manner. For example, microphone 202 may include a microphone such as a T-MIC™ microphone from Advanced Bionics. Microphone 202 may be associated with a particular ear of the patient such as by being located in a vicinity of the particular ear (e.g., within the concha of the ear near the entrance to the ear canal). In some examples, microphone 202 may be held within the concha of the ear near the entrance of the ear canal by a boom or stalk that is attached to an ear hook configured to be selectively attached to sound processor 204. Additionally or alternatively, microphone 202 may be implemented by one or more microphones disposed within headpiece 206, one or more microphones disposed within sound processor 204, one or more omnidirectional microphones with substantially omnidirectional polar patterns, one or more beamforming microphones (e.g., omnidirectional microphones combined to generate a front-facing cardioid polar pattern), and/or any other suitable microphone or microphones as may serve a particular implementation.

Microphone 202 may implement or be included as a component within an audio detector used to generate a signal representative of the audio signal (i.e., the sound) presented to the user as the audio signal is detected by the audio detector. For example, if microphone 202 implements the audio detector, microphone 202 may generate the signal representative of the audio signal by converting acoustic energy in the audio signal to electrical energy in an electrical signal. In other examples where microphone 202 is included as a component within an audio detector along with other components (not explicitly shown in FIG. 2), a signal generated by microphone 202 (e.g., an electrical signal generated as described above) may further be filtered (e.g., to reduce noise, to emphasize or deemphasize certain frequencies in accordance with the hearing of a particular patient, etc.), beamformed (e.g., to "aim" a polar pattern of the microphone in a particular direction such as in front of the patient), gain adjusted (e.g., to amplify or attenuate the signal in preparation for processing by sound processor 204), and/or otherwise pre-processed by other components included within the audio detector as may serve a particular implementation. While microphone 202 and other microphones described herein may be illustrated and described as detecting audio signals and providing signals representative of the audio signals, it will be understood that any of the microphones described herein (e.g., including microphone 202) may represent or be associated with (e.g., implement or be included within) respective audio detectors that may perform any of these types of pre-processing, even if the audio detectors are not explicitly shown or described for the sake of clarity.

Sound processor 204 (i.e., one or more components included within sound processor 204) may be configured to direct cochlear implant 208 to generate and apply electrical stimulation (also referred to herein as "stimulation current") representative of one or more audio signals (e.g., one or more audio signals detected by microphone 202, input by way of an auxiliary audio input port, etc.) to one or more stimulation sites associated with an auditory pathway (e.g., the auditory nerve) of the patient. Exemplary stimulation sites include, but are not limited to, one or more locations within the cochlea, the cochlear nucleus, the inferior colliculus, and/or any other nuclei in the auditory pathway. While, for the sake of simplicity, electrical stimulation will be described herein as being applied to one or both of the cochleae of a patient, it will be understood that stimulation current may also be applied to other suitable nuclei in the auditory pathway. To this end, sound processor 204 may process the one or more audio signals in accordance with a selected sound processing strategy or program to generate appropriate stimulation parameters for controlling cochlear implant 208. Sound processor 204 may include or be implemented by a behind-the-ear ("BTE") unit, a body worn device, and/or any other sound processing unit as may serve a particular implementation. For example, sound processor 204 may be implemented by an electroacoustic stimulation ("EAS") sound processor included in an EAS system configured to provide electrical and acoustic stimulation to a patient.

In some examples, sound processor 204 may wirelessly transmit stimulation parameters (e.g., in the form of data words included in a forward telemetry sequence) and/or power signals to cochlear implant 208 by way of a wireless communication link 214 between headpiece 206 and cochlear implant 208. It will be understood that communication link 214 may include a bidirectional communication link and/or one or more dedicated unidirectional communication links. In the same or other examples, sound processor 204 may transmit (e.g., wirelessly transmit) information such as an audio signal detected by microphone 202 to another sound processor (e.g., a sound processor associated with another ear of the patient). For example, as will be described in more detail below, the information may be transmitted to the other sound processor by way of a wireless audio transmission link (not explicitly shown in FIG. 1).

Headpiece 206 may be communicatively coupled to sound processor 204 and may include an external antenna (e.g., a coil and/or one or more wireless communication components) configured to facilitate selective wireless coupling of sound processor 204 to cochlear implant 208. Headpiece 206 may additionally or alternatively be used to selectively and wirelessly couple any other external device to cochlear implant 208. To this end, headpiece 206 may be configured to be affixed to the patient's head and positioned such that the external antenna housed within headpiece 206 is communicatively coupled to a corresponding implantable antenna (which may also be implemented by a coil and/or one or more wireless communication components) included within or otherwise associated with cochlear implant 208. In this manner, stimulation parameters and/or power signals may be wirelessly transmitted between sound processor 204 and cochlear implant 208 via a communication link 214 (which may include a bidirectional communication link and/or one or more dedicated unidirectional communication links as may serve a particular implementation).

Cochlear implant 208 may include any type of implantable stimulator that may be used in association with the systems and methods described herein. For example, cochlear implant 208 may be implemented by an implantable cochlear stimulator. In some alternative implementations, cochlear implant 208 may include a brainstem implant and/or any other type of active implant or auditory prosthesis that may be implanted within a patient and configured to apply stimulation to one or more stimulation sites located along an auditory pathway of a patient.

In some examples, cochlear implant 208 may be configured to generate electrical stimulation representative of an audio signal processed by sound processor 204 (e.g., an audio signal detected by microphone 202) in accordance with one or more stimulation parameters transmitted thereto by sound processor 204. Cochlear implant 208 may be further configured to apply the electrical stimulation to one or more stimulation sites within the patient via one or more electrodes 212 disposed along lead 210 (e.g., by way of one or more stimulation channels formed by electrodes 212). In some examples, cochlear implant 208 may include a plurality of independent current sources each associated with a channel defined by one or more of electrodes 212. In this manner, different stimulation current levels may be applied to multiple stimulation sites simultaneously (also referred to as "concurrently") by way of multiple electrodes 212.

Figure 3:
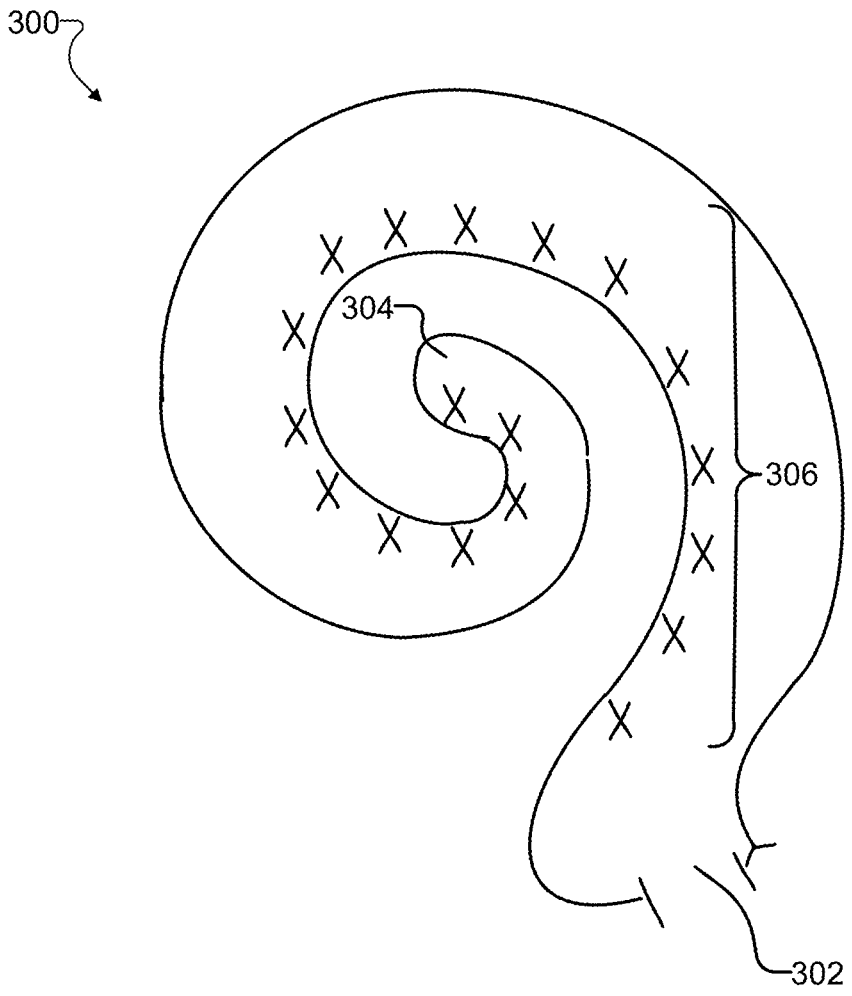
FIG. 3 illustrates a schematic structure of the human cochlea according to principles described herein.

FIG. 3 illustrates a schematic structure of a human cochlea 300 into which lead 210 may be inserted. As shown in FIG. 3, cochlea 300 is in the shape of a spiral beginning at a base 302 and ending at an apex 304. Within cochlea 300 resides auditory nerve tissue 306, which is denoted by Xs in FIG. 3. Auditory nerve tissue 306 is organized within cochlea 300 in a tonotopic manner. That is, relatively low frequencies are encoded at or near apex 304 of cochlea 300 (referred to as an "apical region") while relatively high frequencies are encoded at or near base 302 (referred to as a "basal region"). Hence, each location along the length of cochlea 300 corresponds to a different perceived frequency. Cochlear implant system 300 may therefore be configured to apply electrical stimulation to different locations within cochlea 300 (e.g., different locations along auditory nerve tissue 306) to provide a sensation of hearing to the patient. For example, when lead 210 is properly inserted into cochlea 300, each of electrodes 212 may be located at a different cochlear depth within cochlea 300 (e.g., at a different part of auditory nerve tissue 306) such that stimulation current applied to one electrode 212 may cause the patient to perceive a different frequency than the same stimulation current applied to a different electrode 212 (e.g., an electrode 212 located at a different part of auditory nerve tissue 306 within cochlea 300).

Figure 4:
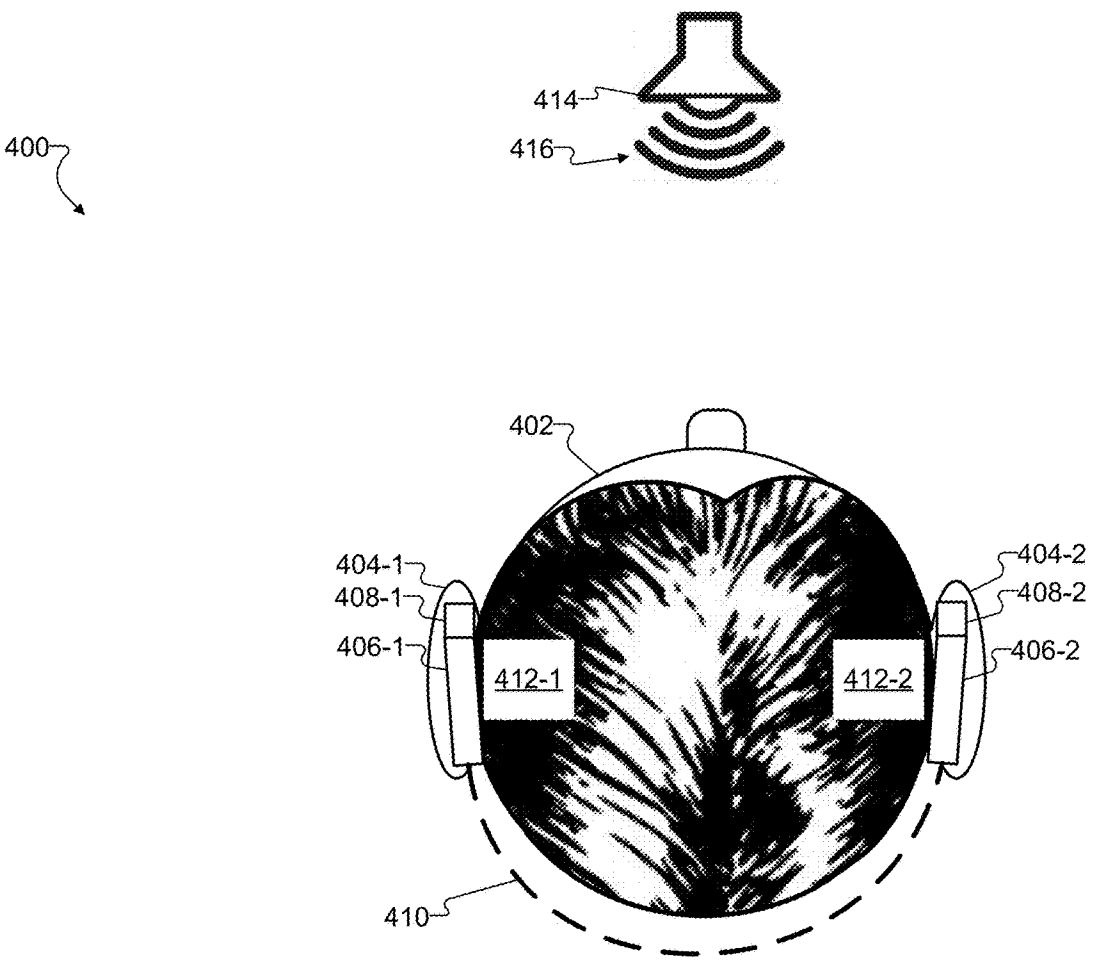
FIG. 4 illustrates an exemplary implementation of the binaural hearing system of FIG. 1 positioned in a particular orientation with respect to a spatial location of an exemplary sound source according to principles described herein.

To illustrate how system 100 (e.g., one or more components of system 100) may be used to facilitate ILD perception by a user of system 100, FIG. 4 illustrates an exemplary implementation 400 of system 100 positioned in a particular orientation with respect to a spatial location of an exemplary sound source. Specifically, as shown in FIG. 4, implementation 400 of system 100 may be associated with a user 402 having two ears 404 (i.e., a left ear 404-1 and a right ear 404-2). User 402 may be, for example, a cochlear implant patient, a hearing aid patient, an earphone user, or the like. In FIG. 4, user 402 is viewed from a perspective above user 402 (i.e., user 402 is facing the top of the page).

As shown, implementation 400 of system 100 may include two sound processors 406 (i.e., sound processor 406-1 associated with left ear 404-1 and sound processor 406-2 associated with right ear 404-2) each communicatively coupled directly with respective microphones 408 (i.e., microphone 408-1 associated with sound processor 406-1 and microphone 408-2 associated with sound processor 406-2). As shown, sound processors 406 may also be interconnected (e.g., communicatively coupled) to one another by way of a communication link 410. Implementation 400 also illustrates that sound processors 406 may each be associated with a respective cochlear implant 412 (i.e., cochlear implant 412-1 associated with sound processor 406-1 and cochlear implant 412-2 associated with sound processor 406-2) implanted within user 402. However, it will be understood that cochlear implants 412 may not be present for implementations of system 100 not involving cochlear implant systems (e.g., hearing aid systems, earphone systems, mixed systems without cochlear implant systems, etc.).

In certain examples, each of the elements of implementation 400 of system 100 may be similar to elements described above in relation to cochlear implant system 200. Specifically, sound processors 406 may each be similar to sound processor 204 of cochlear implant system 200, microphones 408 may each be similar to microphone 202 of cochlear implant system 200 (e.g., and, as such, may implement or be included within respective audio detectors that may perform additional pre-processing of audio signals as described above), and cochlear implants 412 may each be similar to cochlear implant 208 of cochlear implant system 200. Additionally, implementation 400 may include further elements not explicitly shown in FIG. 4 as may serve a particular implementation. For example, respective headpieces similar to headpieces 106 of cochlear implant system 200, respective wireless communication links similar to communication link 214, respective leads having one or more electrodes similar to lead 210 having one or more electrodes 212, and so forth, may be included within or associated with various other elements of implementation 400.

In other examples (e.g., examples where implementation 400 of system 100 does not include and/or is not implemented by any cochlear implant system), the elements of implementation 400 may perform similar functions as described above in relation to cochlear implant system 200, but in a context appropriate for the type or types of hearing systems that are included or do implement implementation 400. For example, if implementation 400 includes or is implemented by a binaural hearing aid system, sound processors 406 may each be configured to present output signals representative of auditory stimuli within an environment occupied by user 402 by directing an electroacoustic transducer to reproduce sounds representative of the auditory stimuli based on the output signal. Similarly, if implementation 400 includes or is implemented by a binaural earphone system, sound processors 406 may each be configured to present output signals representative of sound to be heard by user 402 by directing an electroacoustic transducer to generate the sound based on the output signal.

Moreover, regardless of what type (or types) of hearing system is (or are) used, microphones 408 may be implemented by a microphone such as a T-MIC™ microphone from Advanced Bionics, by one or more omnidirectional microphones with omnidirectional or substantially omnidirectional polar patterns, by one or more directional microphones (e.g., physical front-facing directional microphones, omnidirectional microphones processed to form a front-facing directional polar pattern, etc.), and/or by any other suitable microphone or microphones as may serve a particular implementation. As described above, microphones 408 may represent or be associated with (e.g., implementing or being included within) audio detectors that may perform pre-processing on the raw signals generated by microphones 408 prior to providing the signal representative of the audio signal. Additionally, in some examples, microphones 408 may be disposed, respectively, within each of sound processors 406. In other examples, each microphone 408 may be separate from and communicatively coupled with each respective sound processor 406.

As used herein, omnidirectional microphones refer to microphones configured, for all frequencies and/or particularly for low frequencies, to detect audio signals from all directions equally well. A perfectly omnidirectional microphone, therefore, would have an omnidirectional polar pattern (i.e., drawn as a perfectly circular polar pattern), indicating that sounds are detected equally well regardless of the angle that a sound source is located with respect to the omnidirectional microphone. A "substantially" omnidirectional polar pattern would also be circular, but may not be perfectly circular due to imperfections in manufacturing and/or due to sound interference in the vicinity of the microphone (e.g., sound interference from the head of user 402, referred to herein as a "head shadow" of user 402). Substantially omnidirectional polar patterns caused by head shadow interference of omnidirectional microphones will be described and illustrated in more detail below.

Also without regard for the type or types of hearing system used, implementation 400 may include communication link 410, which may represent a communication link interconnecting sound processor 406-1 and sound processor 406-2. For example, communication link 410 may include a wireless audio transmission link, a wired audio transmission link, or the like, configured to intercommunicate signals generated by microphones 408 between sound processors 406. Examples of uses of communication link 410 will be described in more detail below.

In operation, implementation 400 may facilitate ILD perception by user 402 by independently detecting, processing, and outputting an audio signal using elements on the left side of user 402 (i.e., elements of implementation 400 associated with left ear 404-1 and ending with "-1") and elements on the right side of user 402 (i.e., elements of implementation 400 associated with right ear 404-2 and ending with "-2"). Specifically, as will be described in more detail below, when implementation 400 is in operation, sound processor 406-1 may receive a first signal directly from microphone 408-1 (e.g., directly from an audio detector associated with microphone 408-1) and receive a second signal from sound processor 406-2 (i.e., that sound processor 406-2 receives directly from microphone 408-2) by way of communication link 410. Sound processor 406-1 may then enhance an ILD between the first signal and the second signal (e.g., particularly for low frequency components of the signals) and/or preserve the ILD between the first signal and the second signal as one or more gain processing operations are performed by sound processor 406-1 on at least one of the first signal and the second signal (e.g., including any signals derived therefrom) prior to presenting an output signal to user 402 at ear 404-1. General examples of preserving and enhancing the ILD between the first and the second signals (e.g., which may be applied to the same degree or to distinct degrees at the left side and the right side of the user) will now be described, while more specific examples of preserving the ILD to distinct degrees at each ear will be described in more detail below.

Sound processor 406-1 may preserve the ILD by comparing the first signal and the second signal, generating a gain processing parameter based on the comparison of the first signal and the second signal, and performing the one or more gain processing operations on the one or more signals based on the gain processing parameter and prior to presenting the gain-processed output signal representative of the first signal to user 402 at ear 404-1. In parallel with (e.g., independently from but concurrently with) the operations performed by sound processor 406-1, sound processor 406-2 may similarly receive the second signal directly from microphone 408-2 (e.g., directly from an audio detector associated with microphone 408-2) and receive the first signal from sound processor 406-1 by way of communication link 410. Sound processor 406-2 may then preserve the ILD by similarly comparing the first signal and the second signal, generating the gain processing parameter (i.e., the same gain processing parameter generated by sound processor 406-1) based on the comparison by sound processor 406-2, and performing one or more other gain processing operations (i.e., the same gain processing operations) on corresponding signals within sound processor 406-2 based on the gain processing parameter and prior to presenting another gain-processed output signal to user 402 at ear 404-2.

Sound processor 406-2 may perform parallel operations with sound processor 406-1, but may do so independently from sound processor 406-1 in the sense that no specific parameters or communication may be shared between sound processors 406 other than the first and second signals generated by microphones 408, which may be communicated over communication link 410. In other words, while both sound processors 406 may have access to both the first and the second signals from microphones 408, sound processor 406-2 may, for example, perform the comparison of the first signal and the second signal independently from the comparison of the first signal and the second signal performed by sound processor 406-1. Similarly, sound processor 406-2 may also generate the gain processing parameter independently from the generation of the gain processing parameter by sound processor 406-1, although it will be understood that since each gain processing parameter is based on a parallel comparison of the same first and second signals from microphones 408, the gain processing parameters independently generated by each sound processor 406 will be the same. Using the independently-generated gain processing parameter, sound processor 406-2 may also independently perform the gain processing operations on the signals within sound processor 406-2 that correspond to similar signals within sound processor 406-1. While the signals being processed in each sound processor 406 may be based on the same detected sound, the signals may not be identical because, for example, one may have a higher level than the other due to the ILD. Accordingly, the ILD may be preserved between the corresponding signals in each sound processor 406 by processing the signals in this way because any gain processing operations performed may be configured to use identical gain processing parameters to, for example, amplify and/or attenuate (e.g., compress) the signals by the same amount.

Figure 5:
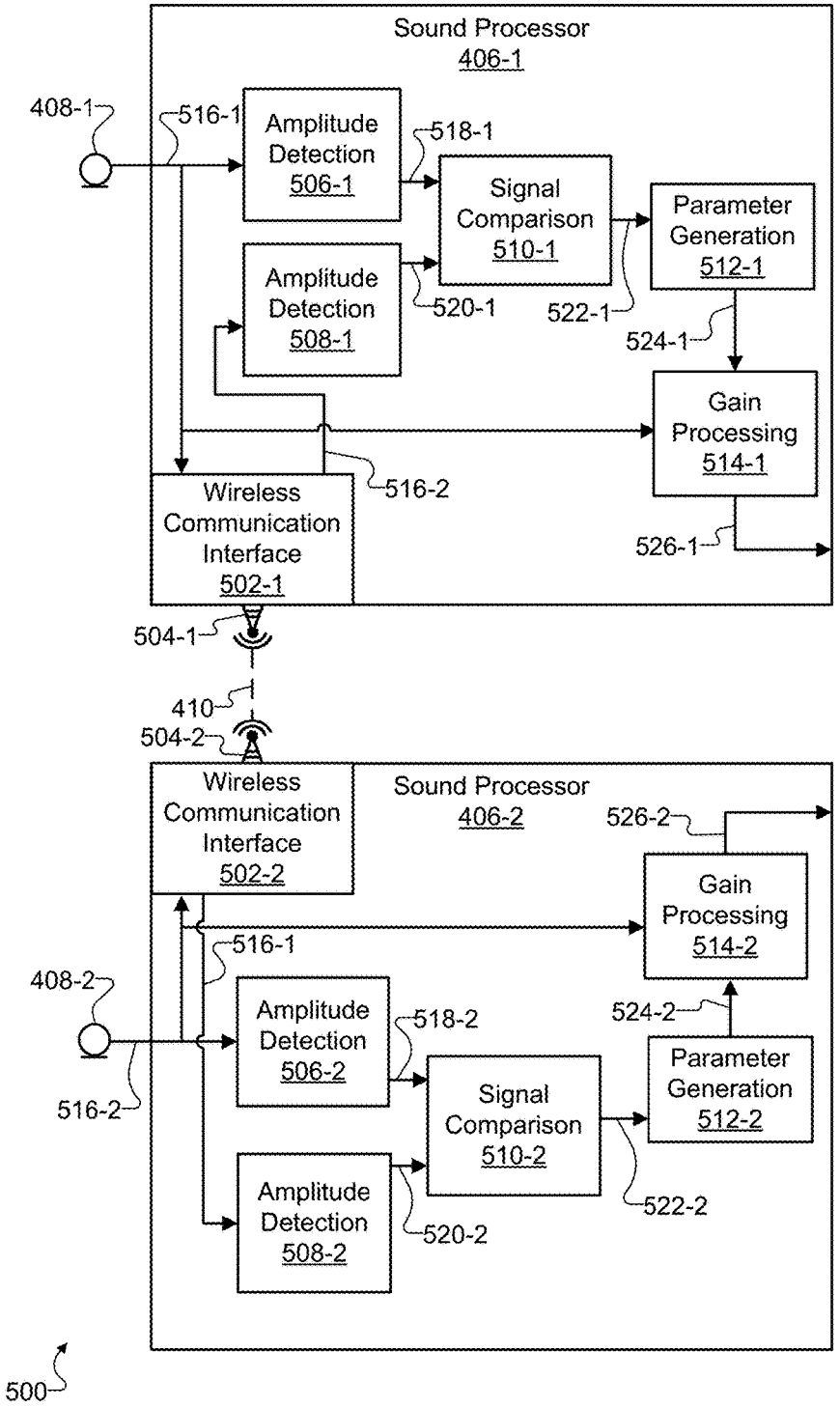
FIGS. 5-6 illustrate exemplary block diagrams of sound processors included within implementations of the binaural hearing system of FIG. 1 that perform synchronized gain processing to preserve ILD cues according to principles described herein.

To illustrate, FIG. 5 shows an exemplary block diagram of sound processors 406 included within an implementation 500 of system 100 that performs synchronized gain processing to preserve ILD cues as described above. Specifically, within implementation 500, sound processors 406 (i.e., sound processors 406-1 and 406-2) may receive input from respective microphones 408 (i.e., microphones 408-1 and 408-2) and may independently generate gain processing parameters used to perform gain processing operations on one or more signals prior to presenting gain-processed output signals to a user (e.g., user 402).

As shown, sound processors 406 may include respective wireless communication interfaces 502 (i.e., wireless communication interfaces 502-1 of sound processor 406-1 and wireless communication interface 502-2 of sound processor 406-2) each associated with respective antennas 504 (i.e., antenna 504-1 of wireless communication interface 502-1 and antenna 504-2 of wireless communication interface 502-2) to generate communication link 410, by which sound processors 406 are interconnected with one another as described above.

FIG. 5 also shows that sound processors 406 may each include respective amplitude detection modules 506 and 508 (i.e., amplitude detection modules 506-1 and 508-1 in sound processor 406-1 and amplitude detection modules 506-2 and 508-2 in sound processor 406-2), signal comparison module 510 (i.e., signal comparison module 510-1 in sound processor 406-1 and signal comparison module 510-2 in sound processor 406-2), parameter generation modules 512 (i.e., parameter generation module 512-1 in sound processor 406-1 and parameter generation module 512-2 in sound processor 406-2), and gain processing modules 514 (i.e., gain processing module 514-1 in sound processor 406-1 and gain processing module 514-2 in sound processor 406-2). While certain exemplary components are explicitly illustrated in sound processors 406 in FIG. 5 and in other sound processors described herein, it will be understood that certain other components not explicitly illustrated may also be included as may serve a particular implementation. For instance, in implementations in which sound processors 406 are included within a cochlear implant system such as cochlear implant system 200, sound processors 406 may each include respective high-pass filter circuitry (e.g. circuitry implementing a pre-emphasis filter) configured to filter signals respectively captured by microphones 408 prior to the signals being processed. Such filtering may be performed in cochlear implant systems, for example, to mimic natural filtering that would occur in the middle ear to sound heard by the user in an acoustic manner instead of by way of the electrical stimulation presented by the cochlear implant system. In this way, cochlear implant system sound processors may emphasize higher frequencies in a manner that mimics unassisted sound perception, facilitates speech recognition, and so forth.

Microphones 408 and communication link 410 are each described above. The other components illustrated in FIG. 5 (i.e., components 502 through 514) will now each be described in detail.

Wireless communication interfaces 502 may use antennas 504 to transmit wireless signals (e.g., audio signals) to other devices such as to other wireless communication interfaces 502 in other sound processors 406 and/or to receive wireless signals from other such devices, as shown in FIG. 5. In some examples, communication link 410 may represent signals traveling in both directions between two wireless communication interfaces 502 on both sound processors 406. While FIG. 5 illustrates wireless communication interfaces 502 transferring wireless signals using antennas 504, it will be understood that in certain examples, a wired communication interface without antennas 504 may be employed as may serve a particular implementation.

Wireless communication interfaces 502 may be especially adapted to wirelessly transmit audio signals (e.g., signals output by microphones 408 that are representative of audio signals detected by microphones 408). For example, as shown in FIG. 5, wireless communication interface 502-1 may be configured to transmit a signal 516-1 (e.g., a signal output by microphone 408-1 that is representative of an audio signal detected by microphone 408-1) with minimal latency such that signal 516-1 is received by wireless communication interface 502-2 at approximately the same time (e.g., within a few microseconds or tens of microseconds) as wireless communication interface 502-2 receives a signal 516-2 (e.g., a signal output by microphone 408-2 that is representative of an audio signal detected by microphone 408-2) from a local microphone (i.e., microphone 408-2). Similarly, wireless communication interface 502-2 may be configured to concurrently transmit signal 516-2 to wireless communication interface 502-1 (i.e., while simultaneously receiving signal 516-1 from wireless communication interface 502-1) with minimal latency. Wireless communications interfaces 502 may employ any communication procedures and/or protocols (e.g., wireless communication protocols) as may serve a particular implementation.

Amplitude detection modules 506 and 508 may be configured to detect or determine an amplitude or other characteristic (e.g., frequency, phase, etc.) of signals coming in from microphones 408. For example, each amplitude detection module 506 may detect an amplitude of a signal detected by an ipsilateral (i.e., local) microphone 408 (i.e., signal 516-1 for amplitude detection module 506-1 and signal 516-2 for amplitude detection module 506-2), while each amplitude detection module 508 may detect an amplitude of a signal detected by a contralateral (i.e., opposite) microphone 408 that is received via wireless communication interface 502 (i.e., signal 516-2 for amplitude detection module 508-1 and signal 516-1 for amplitude detection module 508-2). In some examples, amplitude detection modules 506 and 508 may output signals 518 and 520, respectively, which may be representative of a level (e.g., a loudness level, a noise level, etc.), an amplitude, and/or another such characteristic of signals 516-1 and 516-2. As shown, signals 518 may each represent the level, amplitude, and/or or other characteristic of the ipsilateral signal 516, while signals 520 may each represent the level, amplitude, and/or other characteristic of the contralateral signal 516. Amplitude detection modules 506 and 508 may read, analyze, and/or prepare signals 516 in any suitable way to facilitate the comparison of signals 516 with one another. In some examples, amplitude detection modules 506 and 508 may not be used and signals 516 may be compared with one another directly.

Signal comparison modules 510 may each be configured to compare signals 518 and 520 (i.e., signals 518-1 and 520-1 in the case of signal comparison module 510-1, and signals 518-2 and 520-2 in the case of signal comparison module 510-2), or, in certain examples, to compare signals 516-1 and 516-2 directly. Signal comparison modules 510 may perform any comparison as may serve a particular implementation. For example, signal comparison modules 510 may compare signals 518 and 520 to determine which signal has the greatest level or amplitude, the lowestlevel or amplitude, a level or amplitude nearest to a predetermined value, or the like. In these examples, signal comparison modules 510 may act as multiplexors to pass through a selected signal (e.g., whichever of signals 516 is determined to have the greater amplitude, the lesser amplitude, etc.). In other examples, signal comparison modules 510 may process and/or combine the incoming signals to output a signal that is different from signals 516, 518, and 520. For example, signal comparison modules 510 may output a signal that is an average of signals 516-1 and 516-2, an average of respective signals 518 and 520, and/or any other combination (e.g., an uneven combination) of any of these signals as may serve a particular implementation.

In any case, as described above, while signal comparison modules 510 may operate independently from one another in each respective sound processor 406, signal comparison modules 510 may each be configured to perform the same comparison and, thus, to independently generate identical signals 522 (i.e., signals 522-1 and 522-2). More specifically, because signals 518-1 and 520-2 are both representative of a level, amplitude, or other characteristic of signal 516-1, and because signals 518-2 and 520-1 are both representative of a level, amplitude, or other characteristic of signal 516-2, signal comparison modules 510 may each generate identical signals 522.

Accordingly, for example, if a sound originates or emanates from the left of the user, the amplitude of signal 516-1 may be greater than the amplitude of signal 516-2. As such, amplitude detection modules 506-1 and 508-2 will generate signals 518-1 and 520-2, respectively, that are indicative of a greater amplitude than signals 518-2 and 520-1 generated by amplitude detection modules 506-2 and 508-1, respectively. If signal comparison modules 510 are configured to determine a maximum amplitude, signal comparison module 510-1 may therefore output signal 522-1 to be representative of signal 516-1 and/or signal 518-1, while signal comparison module 510-2 may output signal 522-2 to be representative of signal 516-1 and/or signal 520-2. In other words, signal 522-2 may be identical to signal 522-1.

Parameter generation modules 512 (i.e., parameter generation modules 512-1 and 512-2) may each generate gain parameters based on respective signals 522 that are input to parameter generation modules 512. Because signals 522 may be identical for the reasons described above, parameter generation modules 512 may likewise generate identical gain parameters 524 (i.e., gain parameters 524-1 and 524-2). Gain parameters 524 may be any suitable parameters that may be used by gain processing modules 514 to analyze, determine, amplify, attenuate, or otherwise process any type of gain of respective signals 516. For example, if gain processing modules 514 are configured to apply an automatic gain control ("AGC") gain to respective signals 516 to amplify relatively quiet signals and/or attenuate relatively loud signals to fully utilize the full dynamic output range of the hearing system, gain parameters 524 may be representative of an AGC gain parameter by which the respective signals 516 are to be amplified or attenuated. If gain parameters 524 were not identical (e.g., in conventional examples where sound processors 406 operate independently), the gain of each signal 516 would be processed separately such that different, independently-generated gain would be applied at each sound processor 406. This may maximize the dynamic output range of the hearing system, but could result in a complete deterioration of the ILD between signals 516. However, by synchronizing gain parameters 524 to at least some degree (e.g., to a full degree in which the gain parameters are identical as described above, or to a lesser degree as will be described in more detail below), respective amounts of gain may be applied to each signal 516 that preserve the ILD between signals 516 to at least some degree (e.g., while also, for example, optimizing a balance between ILD preservation and dynamic output range maximization as may be appropriate for certain users and/or listening scenarios as will be described below).

Gain processing modules 514 (i.e., gain processing modules 514-1 and 514-2) may perform any type of gain processing or signal processing on respective signals 516 as may serve a particular implementation based on gain parameters 524. For example, as described above, gain parameters 524 may be AGC gain parameters and gain processing modules 514 may apply an AGC gain defined by the AGC gain parameter to one or more of signals 516 or other signals derived from signals 516. In another examples, gain parameters 524 may represent a noise cancellation gain parameter and gain processing modules 514 may apply a noise cancellation gain defined by the noise cancellation gain parameter to one or more of signals 516 or the other signals derived from signals 516. In yet another example, gain parameters 524 may represent a wind cancellation gain parameter and gain processing modules 514 may apply a wind cancellation gain defined by the wind cancellation gain parameter to one or more of signals 516 or the other signals derived from signals 516. In yet another example, gain parameters 524 may represent a reverberation cancellation gain parameter and gain processing modules 514 may apply a reverberation cancellation gain defined by the reverberation cancellation gain parameter to one or more of signals 516 or the other signals derived from signals 516. In yet another example, gain parameters 524 may represent an impulse cancellation gain parameter and gain processing modules 514 may apply an impulse cancellation gain defined by the impulse cancellation gain parameter to one or more of signals 516 or the other signals derived from signals 516.

It will be understood that, while only one stage of gain processing is explicitly shown in FIG. 5, two or more of the gain processing operations described above may be performed by two or more stages of gain processing each associated with one or more gain processing parameters (e.g. gain parameters 524 and/or additional gain processing parameters) synchronized between sound processors 406 as described above.

Based on the performance of the one or more stages of gain processing, gain processing modules 514 may generate output signals 526 (i.e., output signals 526-1 and 526-2). Output signals 526 may be used in any way that may serve a particular implementation (e.g., consistent with the type of hearing system that is implemented by sound processors 406). For example, output signals 526 may be used to direct an electroacoustic transducer to reproduce sound in hearing aid and/or or earphone type hearing systems, or may be used to direct a cochlear implant to apply electrical stimulation in cochlear implant type hearing systems, as described above.

In FIG. 5, sound processors 406 have been illustrated and described to compare signals 516 (e.g., or to compare signals 518 and 520, which may be derived from signals 516) and to generate gain parameters 524 while signals 516 are each in a time domain. In other words, signals 516 may be processed within sound processors 406 without regard to different frequency components included within the signals, such that each signal is treated as a whole and each frequency component is processed the same as every other frequency component. As such, each sound processor 406 (e.g., gain processing modules 514) may also perform gain processing operations in the time domain and using the gain processing parameter.

In other examples, however, sound processors 406 may convert signals 516 into a frequency domain by dividing each of signals 516 into a plurality of frequency domain signals each representative of a particular frequency band in a plurality of frequency bands associated with the respective signals 516. As such, the comparison of signals 516 (i.e., or signals 518 and 520) by signal comparison modules 510 may involve comparing, with each of the plurality of frequency domain signals into which each signal 516-1 is divided, a corresponding frequency domain signal from the plurality of frequency domain signals into which signal 516-2 is divided. Each frequency domain signal from the plurality of frequency domain signals into which signal 516-1 is divided may be representative of a same particular frequency band in the plurality of frequency bands as each corresponding frequency domain signal in the plurality of frequency domain signals into which signal 516-2 is divided. Accordingly, each sound processor 406 may generate individual gain processing parameters for each frequency band and may perform the one or more gain processing operations by performing individual gain processing operations for each frequency domain signal based on corresponding individual gain processing parameters for each frequency band.

Figure 6:
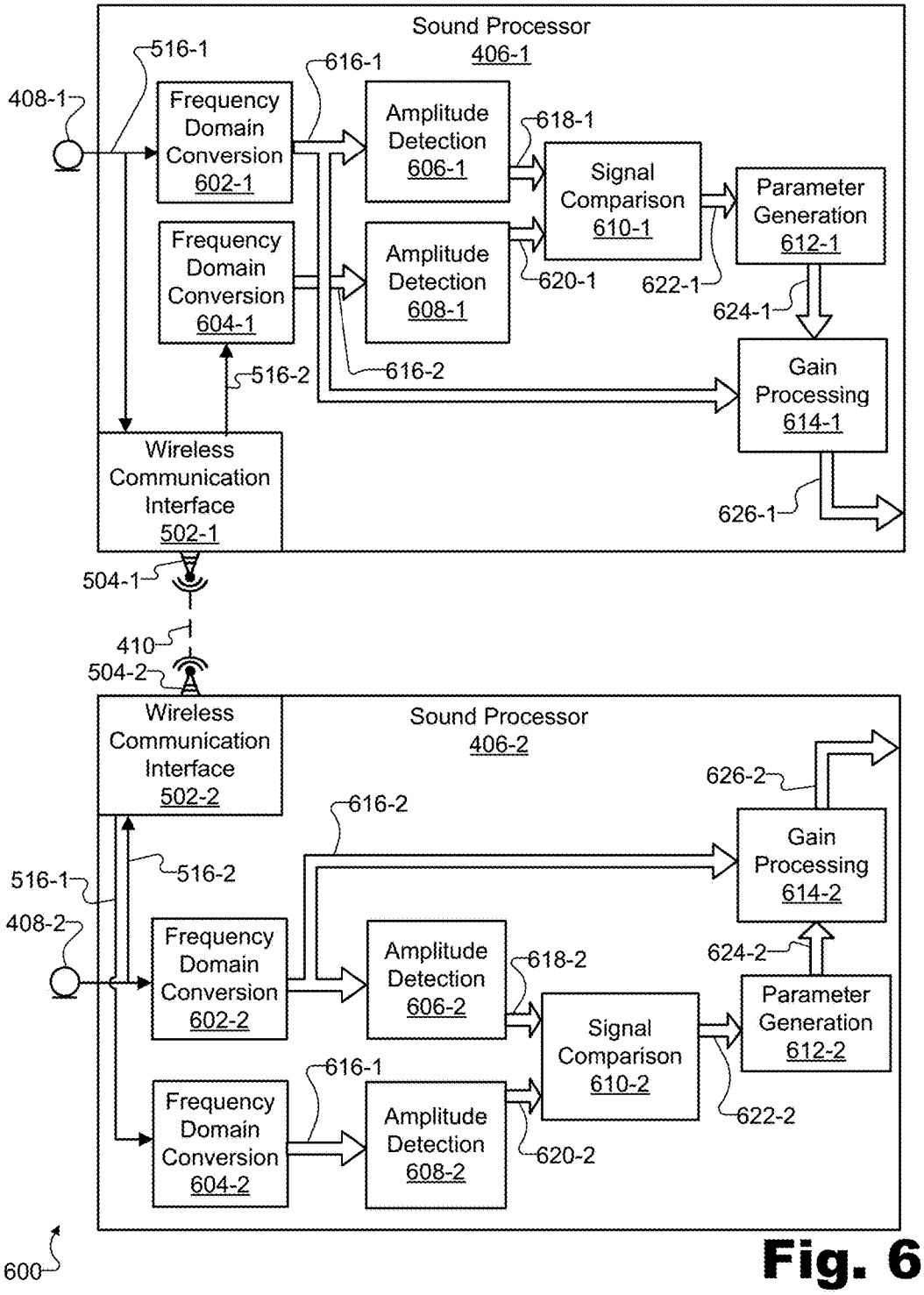

To illustrate, FIG. 6 shows another exemplary block diagram of sound processors 406 included within an implementation 600 of system 100 that performs synchronized gain processing to preserve ILD cues as described above. Implementation 600 includes similar components as described above with respect to implementation 500 in FIG. 5, such as wireless communication interfaces 502 and antennas 504, amplitude detection modules 606 and 608 (similar to amplitude detection modules 506 and 508, respectively), signal comparison modules 610 (similar to signal comparison modules 510), parameter generation modules 612 (similar to parameter generation module 512), and gain processing modules 614 (similar to gain processing modules 514).

However, implementation 600 also includes additional components not included in implementation 500. Frequency domain conversion modules 602 and 604 (i.e., frequency domain conversion modules 602-1 and 602-2 and frequency domain conversion modules 604-1 and 604-2) are included in-line between microphones 408 and amplitude detection modules 606 and 608. Frequency domain conversion modules 602 and 604 may be used to convert signals 516 into a frequency domain before signals 516 are processed according to operations described above. In other words, frequency domain conversion modules 602 and 604 may divide signals 516 into a plurality of frequency domain signals each representative of a particular frequency band in a plurality of frequency bands. For example, each signal 516 may be divided into 64 different frequency domain signals each representative of a different frequency component of the signal 516. In this example, each frequency component may correspond to one frequency band in a plurality of 64 frequency bands. In other examples, other suitable numbers of frequency bands may be used as may serve a particular implementation.

Frequency domain conversion modules 602 and 604 may convert signals 516 into the frequency domain (i.e., divide signals 516 into the plurality of frequency domain signals each representative of the particular frequency band in the plurality of frequency bands) in any way as may serve a particular implementation. For example, frequency domain conversion modules 602 and 604 may convert signals 516 into the frequency domain using a fast Fourier transform ("FFT"). FFTs may provide particular practical advantages for converting signals into the frequency domain because FFT hardware modules (e.g., dedicated FFT chips, microprocessors or other chips that include FFT modules, etc.) may be compact, commonly available, relatively inexpensive, and so forth. As another example, frequency domain conversion modules 602 and 604 may convert signals 516 into the frequency domain using a plurality of band-pass filters each associated with one particular frequency band within the plurality of frequency bands.

As shown in FIG. 6, implementation 600 may perform similar operations as described above with respect to implementation 500 and may have a similar data flow. In general, signals named starting with a '6' (i.e., signals "6xx") correspond to signals described above that start with a '5' (i.e., signals "5xx"). However, because signals 516-1 and 516-2 are converted into frequency domain signals 616-1 and 616-2, respectively, at the outset (e.g., by frequency domain conversion modules 602 and 604), various signals in implementation 600 (e.g., signals 616-1 and 616-2, signals 618-1 and 618-2, signals 620-1 and 620-2, signals 622-1 and 622-2, gain parameters 624-1 and 624-2, and output signals 626-1 and 626-2) are illustrated using hollow block arrows rather than linear arrows, indicating that these signals are in the frequency domain, rather than the time domain. As such, it will be understood that some or all of the processing described above with respect to configuration 500 may be performed for frequency domain signals for each frequency band within the plurality of frequency bands. In other words, for example, the arrows illustrating gain parameters 624 (i.e., gain parameters 624-1 and 624-2) may each represent a plurality (e.g., 64) of individual gain parameters, one for each frequency band. Likewise, gain processing modules 614 (i.e., gain processing modules 614-1 and 614-2) may each perform gain processing operations within the frequency domain to process each frequency band individually based on the individual gain parameters 624.

The description above of FIGS. 5 and 6 has described and given examples for how system 100 may preserve the ILD between the first signal and the second signal described above in relation to configuration 400 of FIG. 4. Additionally or alternatively, as mentioned above in relation to FIG. 4, the ILD between the first signal and the second signal may be enhanced, particularly for low frequency components of the signals. For example, returning to FIG. 4, sound processor 406-1 may enhance the ILD by generating a first directional signal representative of a spatial filtering of the audio signal detected at ear 404-1 according to an end-fire directional polar pattern, and by then presenting an output signal representative of the first directional signal to user 402 at ear 404-1.

As used herein, an "end-fire directional polar pattern" may refer to a polar pattern with twin, mirror-image, outward facing lobes. For example, as will be described and illustrated in more detail below (e.g., see FIG. 8), two microphones may be placed along an axis connecting the microphones (e.g., may be associated with mutually contralateral hearing instruments such as a cochlear implant and a hearing aid that are placed at each ear of a user along an axis passing from ear to ear through the head of the user). These microphones may form a directional signal according to an end-fire directional polar pattern by spatially filtering an audio signal detected at both microphones so as to have a first lobe statically directed radially outward from the first ear in a direction perpendicular to the first ear (i.e., pointing outward from the first ear along the axis), and to have a second lobe statically directed radially outward from the second ear in a direction perpendicular to the second ear (i.e., pointing outward from the second ear along the axis). Because the axis passes through both microphones (e.g., from ear to ear of the user), the direction perpendicular to the first ear of the user may be diametrically opposite to the direction perpendicular to the second ear of the user. In other words, the lobes of the end-fire directional polar pattern may point away from one another (e.g., as will be illustrated in FIG. 8).

As will be described and illustrated in more detail below, sound processor 406-1 may generate the first directional signal based on a first beamforming operation using the first and second signals. The end-fire directional polar pattern generated by sound processor 406-1 may be different from the first and second polar patterns (e.g., substantially omnidirectional polar patterns) in that the end-fire directional polar pattern may be directed radially outward (e.g., with twin side-facing cardioid polar patterns) from ears 404-1 and 404-2 along an axis passing through ears 404, as described above.

In parallel with (e.g., concurrently with, etc.) the operations performed by sound processor 406-1, sound processor 406-2 may similarly receive the second signal directly from microphone 408-2 and receive the first signal from sound processor 406-1 by way of communication link 410. Sound processor 406-2 may then enhance the ILD by generating a second directional signal representative of a spatial filtering of the audio signal detected at ear 404-2 according to the end-fire directional polar pattern, and presenting another output signal representative of the second directional signal to user 402 at ear 404-2. Similar to sound processor 406-1, sound processor 406-2 may generate the second directional signal based on a second beamforming operation using the first and second signals.

In other words, even though each of microphones 408 may be omnidirectional microphones with omnidirectional (or substantially omnidirectional) polar patterns, sound processors 406 may perform beamforming operations on the first and second signals generated by microphones 408 to generate an end-fire directional polar pattern with opposite (e.g., diametrically opposite) facing lobes (e.g., cardioid lobes). In some examples, the end-fire directional polar pattern may be static, such that the lobes of the end-fire directional polar pattern remains statically directed in the directions perpendicular to each respective ear 404 along the axis passing through ears 404 (i.e., passing through the microphones placed at each of ears 404). Accordingly, for example, a first lobe of the end-fire directional polar pattern may be a static cardioid polar pattern facing directly to the left of user 402, while the second lobe of the end-fire direction polar pattern may be a mirror image equivalent (e.g., an equivalent that is facing in a diametrically opposite direction) of the first lobe (i.e., a cardioid polar pattern facing directly to the right of user 402). As will now be described, the directionality of the end-fire directional polar pattern may enhance the ILD perceived by user 402, particularly at low frequencies (e.g., frequencies less than 1.0 kHz), where ILD effects from the head shadow of user 402 may otherwise be minimal.

To illustrate, FIG. 4 shows a sound source 414 emitting a sound 416 that may be included within or otherwise associated with an audio signal (e.g., an acoustic audio signal representing the sound in the air) received by implementation 400 of system 100 (e.g., by microphones 408). As shown in FIG. 4, user 402 may be oriented so as to be directly facing a spatial location of sound source 414. Accordingly, sound 416 may arrive at both ears 404 of user 402 having approximately the same level such that the ILD between sound 416 as detected by microphone 408-1 at ear 404-1 and as detected by microphone 408-2 at ear 404-2 may be very small or nonexistent and the first and second signals generated by microphones 408 may be approximately identical.

Figure 7:
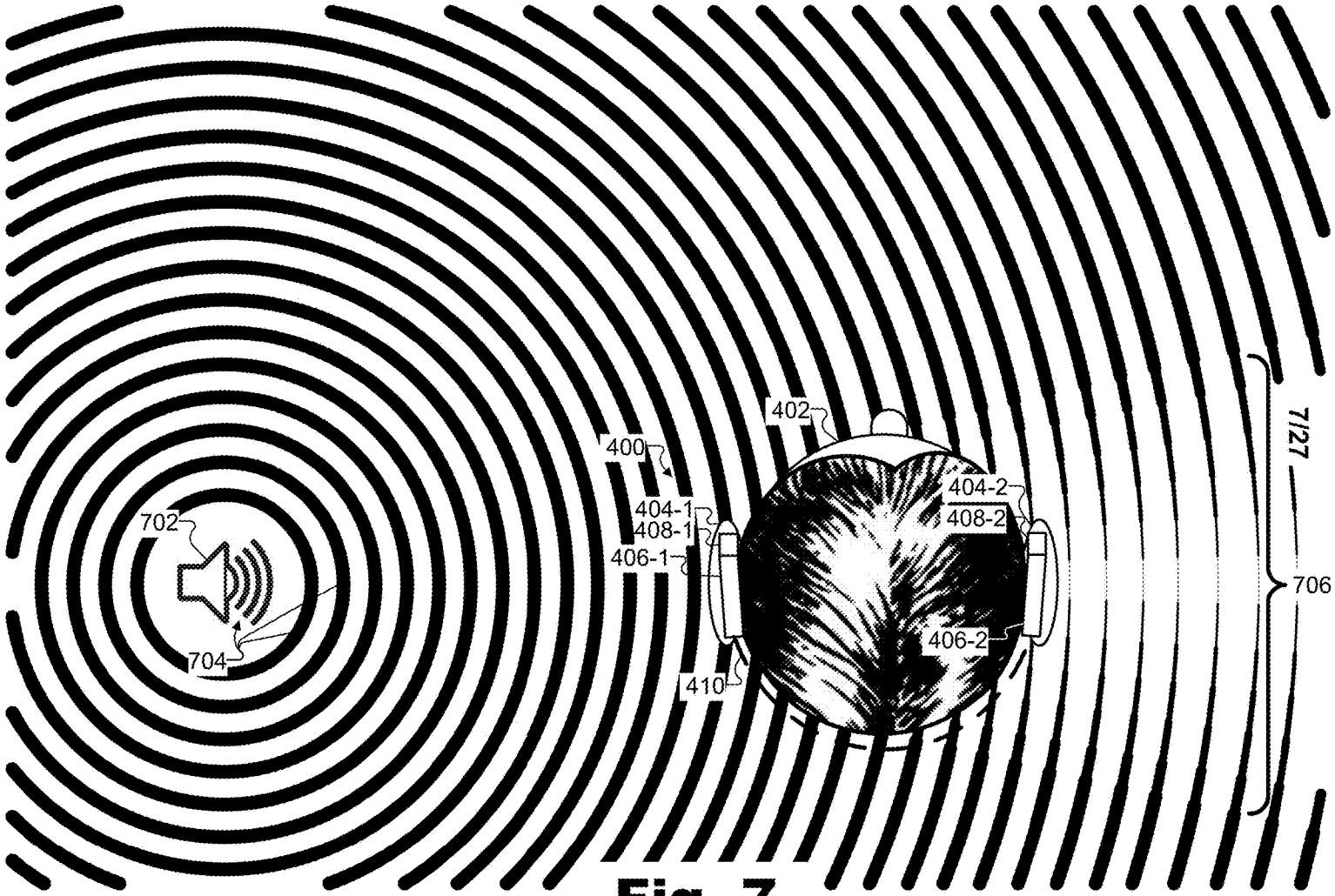
FIG. 7 illustrates an ILD of an exemplary high frequency sound presented to the user of the binaural hearing system of FIG. 1 according to principles described herein.

In contrast, FIG. 7 illustrates an ILD of an exemplary high frequency sound presented to user 402 from an angle (i.e., directly to the left of user 402) that may maximize the ILD. As shown, FIG. 7 shows a sound source 702 emitting a sound 704 that may be included within or otherwise associated with an audio signal received by system 100 (e.g., by microphones 408). FIG. 7 illustrates concentric circles around (e.g., emanating from) sound source 702, representing the propagation of sound 704 through the air toward user 402. (While size constraints of FIG. 7 do not allow entire circles to be drawn farther away from sound source 702, it will be understood that the curved lines farther away from sound source 702 that reach the boundaries of the page are also representative of concentric circles and will be referred to as such herein.) The circles associated with sound 704 are relatively close together to illustrate that sound 704 is a relatively high frequency sound (e.g., a sound greater than 1 kHz).

In FIG. 7, the thickness of the circles representative of sound 704 represents a level (e.g., an intensity level, a volume level, etc.) associated with sound 704 at various points in space. For example, relatively thick lines indicate that sound 704 has a relatively high level (e.g., loud volume) at that point in space while relatively thin lines indicate that sound 704 has a relatively low level (e.g., quiet volume) at that point in space.

As shown in FIG. 7, user 402 may be oriented to be facing perpendicularly to a spatial location of sound source 702. More specifically, sound source 702 is directly to the left of user 402. Accordingly, as shown, sound 704 (e.g., or a high frequency component of sound 704) may have a higher level (e.g., a louder volume, indicated by thicker lines) at left ear 404-1 and a lower level (e.g., a quieter volume, indicated by thinner lines) at right ear 404-2. This is due to interference by the head of user 402 with sound 704 within a head shadow 706, in which sound waves of sound 704 may be partially or fully blocked traversing through the air medium in which the sound waves are traveling.

This interference or blocking of the sound associated with head shadow 706 may give user 402 the ability to localize sounds based on ILD cues. Specifically, because sound 704 emanates from directly to the left of user 402, there is a very large difference (i.e., ILD) in the volume of sound 704 arriving at ear 404-1 and in the volume of sound 704 arriving at ear 404-2. This large ILD where ear 404-1 hears a significantly larger level than does ear 404-2 may be interpreted by user 402 to indicate that sound 704 emanates directly from his or her left, and, therefore, that sound source 702 is located to his or her left. In other examples where sound source 702 is located to the left but not directly to the left, ear 404-1 may still hear sound 704 at a higher level than ear 404-2, but the difference may not be as significant. For example, as shown, the circles representing sound 704 are thicker toward the edge of head shadow 706 and thinner closer to the middle. Accordingly, in this example, user 402 may localize sound source 702 to be somewhat to his or her left but not directly to the left due to the smaller magnitude of the ILD.

For people with unassisted hearing (i.e., people not using a hearing system), detecting ILD cues resulting from head shadow may be an effective strategy for localizing high frequency sounds because the head shadow effect (i.e., the ability of the head to block sound) is particularly pronounced for high frequency sounds and/or components of sound. (It will be noted, however, that other localization strategies such perceiving and interpreting interaural time difference ("ITD") cues may be more heavily relied on by people with unassisted hearing for localizing sound sources of low frequency sounds.)

Figure 8:
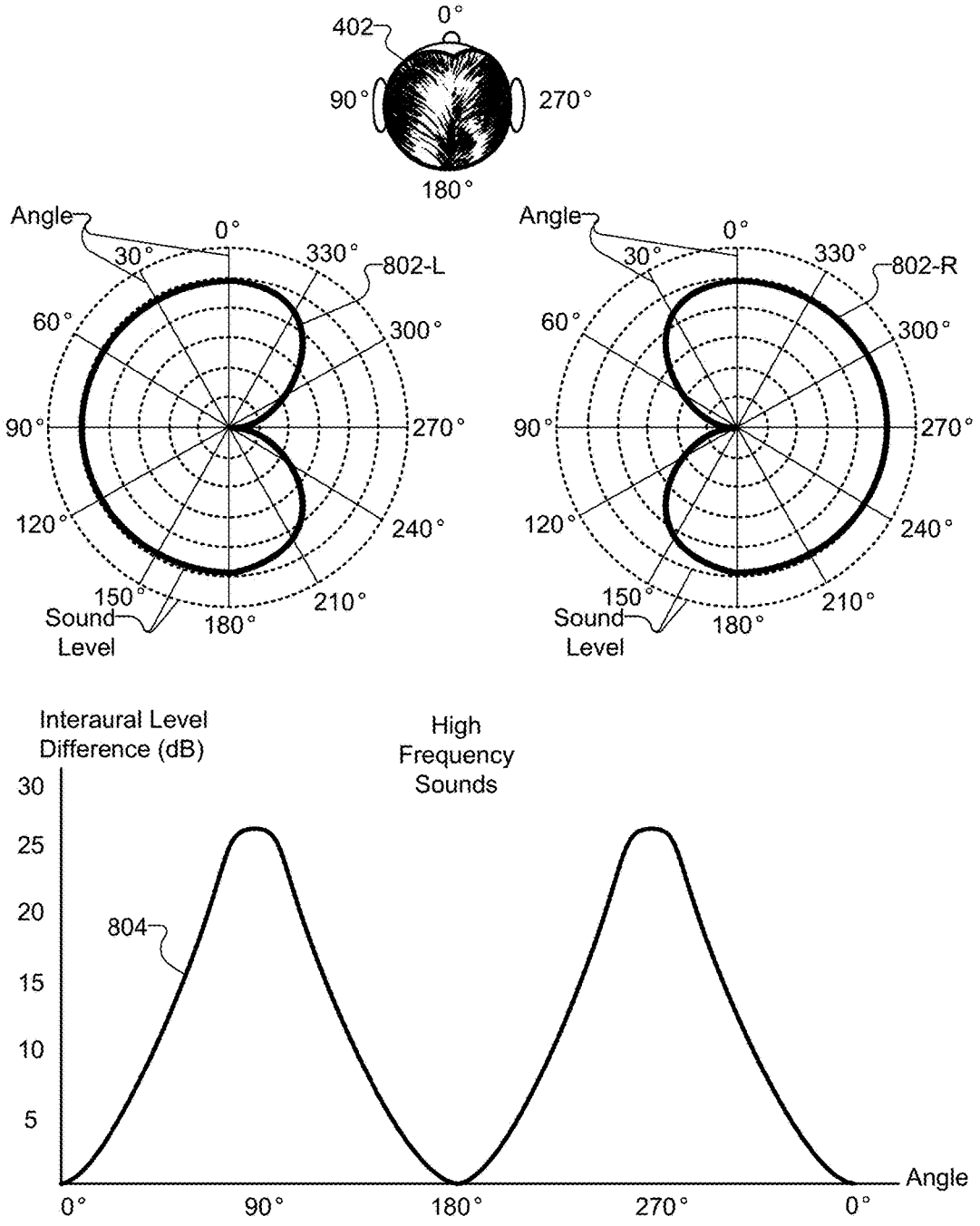
FIG. 8 illustrates an exemplary end-fire polar pattern and a corresponding ILD magnitude plot associated with high frequency sounds such as the high frequency sound illustrated in FIG. 7 according to principles described herein.

FIG. 8 illustrates an exemplary end-fire polar pattern 802 (e.g., the combination of a left-facing lobe 802-L and a right-facing lobe 802-R for the left and right ear of user 402, respectively) and a corresponding ILD magnitude plot 804 associated with high frequency sounds such as high frequency sound 704 illustrated in FIG. 7. In FIG. 8, an orientation key illustrating a small version of user 402 is included above end-fire polar pattern 802 to indicate orientation conventions used for end-fire polar pattern 802 (i.e., user 402 is facing 0°, the left of user 402 is at 90°, the right of user 402 is at 270°, etc.). Lobes 802-L and 802-R of polar pattern 802 each illustrate levels at which sounds are detected (e.g., by one of microphones 408) at a particular ear (e.g., one of ears 404 of user 402) with respect to the angle from which the sounds emanate. In FIG. 8, it is assumed that microphones 408 are omnidirectional microphones (i.e., have substantially omnidirectional polar patterns in free space). However, as shown, lobes 802-L and 802-R each show side-facing cardioid polar patterns directed radially outward from ears 404 in directions perpendicular to ears 404. This is because of the head shadow of the head of user 402 and the significant effect that the head shadow has for high frequency sounds (e.g., as illustrated by head shadow 706 in FIG. 7).

Thus, for example, left-facing lobe 802-L for left ear 404-1 indicates that sounds emanating directly from the left (i.e., 90°) may be detected without any attenuation, while sound emanating directly from the right (i.e., 270°) may be detected with extreme attenuation or may be blocked completely. Between 90° and 270°, other sounds are associated with varying attenuation levels. For example, there is very little attenuation for any sound emanating from directly in front of user 402 (0°), directly behind user 402 (180°), or any angle relatively to the left of user 402 (i.e., greater than 0° and less than 180°). However, for sounds emanating from an angle in which the head shadow of user 402 blocks the sounds (i.e. greater than 180° and less than 360°), the sound levels quickly drop off as the direct right of user 402 (270°) is approached, where the levels may be completely attenuated or blocked.

Right-facing lobe 802-R for right ear 404-2 forms a mirror image equivalent of left-facing lobe 802-L within end-fire directional polar pattern 802. In other words, right-facing lobe 802-R is exactly the opposite of left-facing lobe 802-L and symmetric with left-facing lobe 802-L over a plane bisecting the head between ears 404. Accordingly, as shown, sounds emanating directly from the right (i.e., 270°) may be detected without any attenuation, while sound emanating directly from the left (i.e., 90°) may be detected with extreme attenuation or may be blocked completely.

ILD magnitude plot 804 illustrates the magnitude (e.g., absolute value, root mean square ("RMS") value, short-term average, long-term average, etc.) of the difference between the level of sounds detected at the left ear and at the right ear with respect to the angle from which the sounds emanate. Accordingly, as shown, ILD magnitude plot 804 is very low (e.g., 0 dB) around 0°, 180°, and 360° (labeled as °0 again to indicate a return to the front of the head). This is because at 0° and 180° (i.e., directly in front of user 402 and directly behind user 402, respectively), there is little or no ILD and both ears detect sounds at identical levels. Conversely, ILD magnitude plot 804 is relatively high (e.g., greater than 25 dB) around 90° and 270°. This is because at 90° and 270° (i.e., directly to the left and directly to the right of user 402, respectively), there is a very large ILD and one ear detects sound at a much higher level than the other ear.

Figure 9:
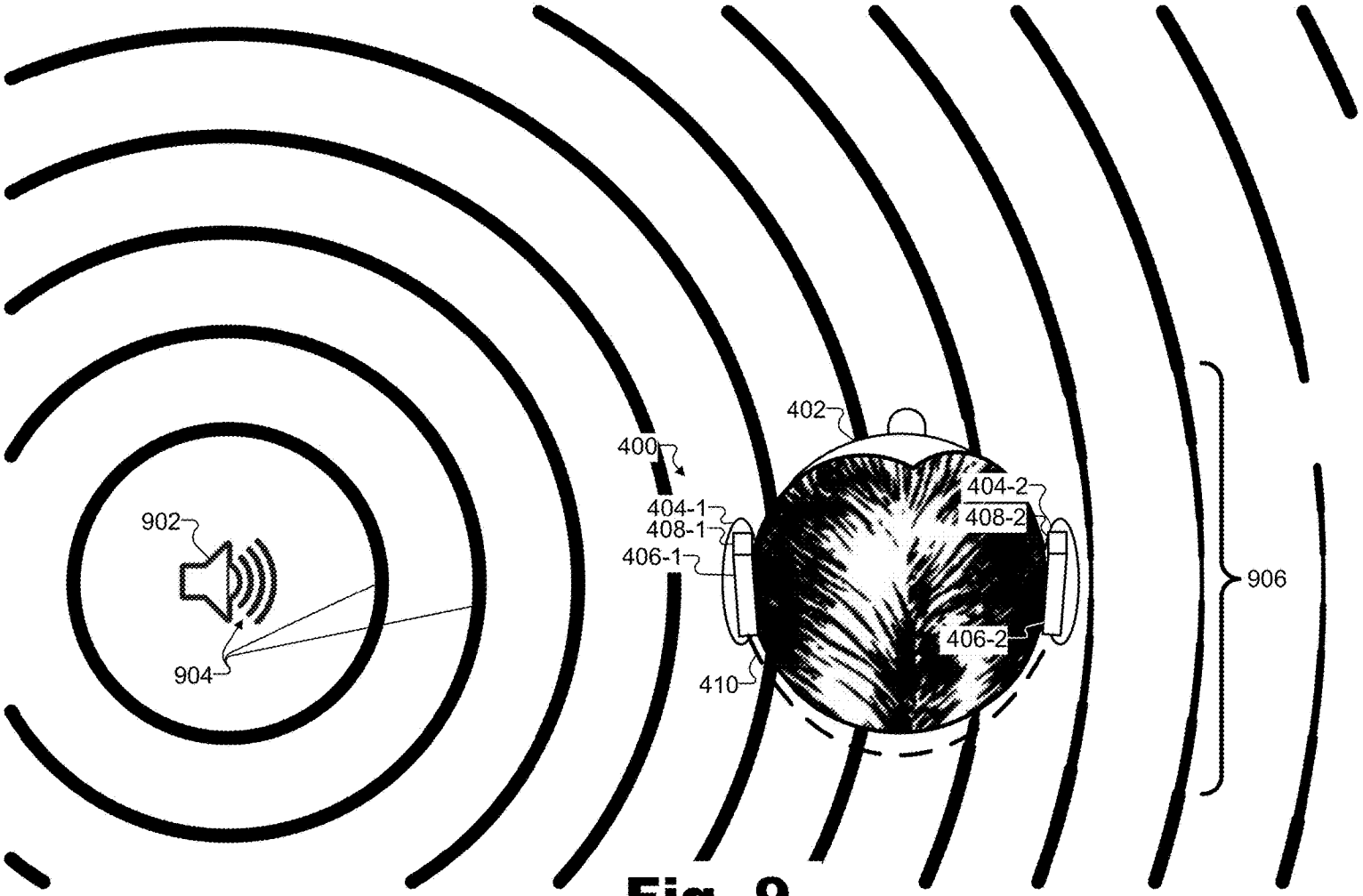
FIG. 9 illustrates an ILD of an exemplary low frequency sound presented to the user of the binaural hearing system of FIG. 1 according to principles described herein.

As mentioned above, ILD is typically not relied on by people with unassisted hearing for relatively low frequency sounds because the effects of the head are much less pronounced, making ILD more difficult to perceive (due to longer wavelengths of low frequency sound waves). To illustrate, FIG. 9 shows an ILD of an exemplary low frequency sound presented to user 402. As shown, FIG. 9 shows a sound source 902 emitting a sound 904 that likewise may be included within or otherwise associated with an audio signal received by implementation 400 of system 100 (e.g., by microphones 408). Like FIG. 7, FIG. 9 illustrates concentric circles around (e.g., emanating from) sound source 902, representing the propagation of sound 904 through the air toward user 402. In FIG. 9, however, the circles associated with sound 904 are spaced relatively far apart to illustrate that sound 904 is a relatively low frequency sound (e.g., a sound less than 1 kHz).

As with sound source 702 in FIG. 7, sound source 902 in FIG. 9 is located directly to the left of user 402 to illustrate a maximum ILD between ear 404-1, where sound 904 may be received at a maximum level without any interference, and ear 404-2, where the head shadow of the head of user 402 attenuates sound 904 to a minimum level. However, as illustrated in FIG. 9, a head shadow 906 caused by the head of user 402 is less pronounced for low frequency sound 904 than was head shadow 706 for high frequency sound 704. For example, as shown, the thickness of the circles associated with sound 904 do not get as thin or decrease as quickly within head shadow 906 as did the thickness of the circles associated with sound 704 within head shadow 706. As mentioned above, this is because the relatively long wave lengths of low frequency sound waves are more impervious to (i.e., not blocked as significantly by) objects of a size such as that of the head of user 402.

Figure 10:
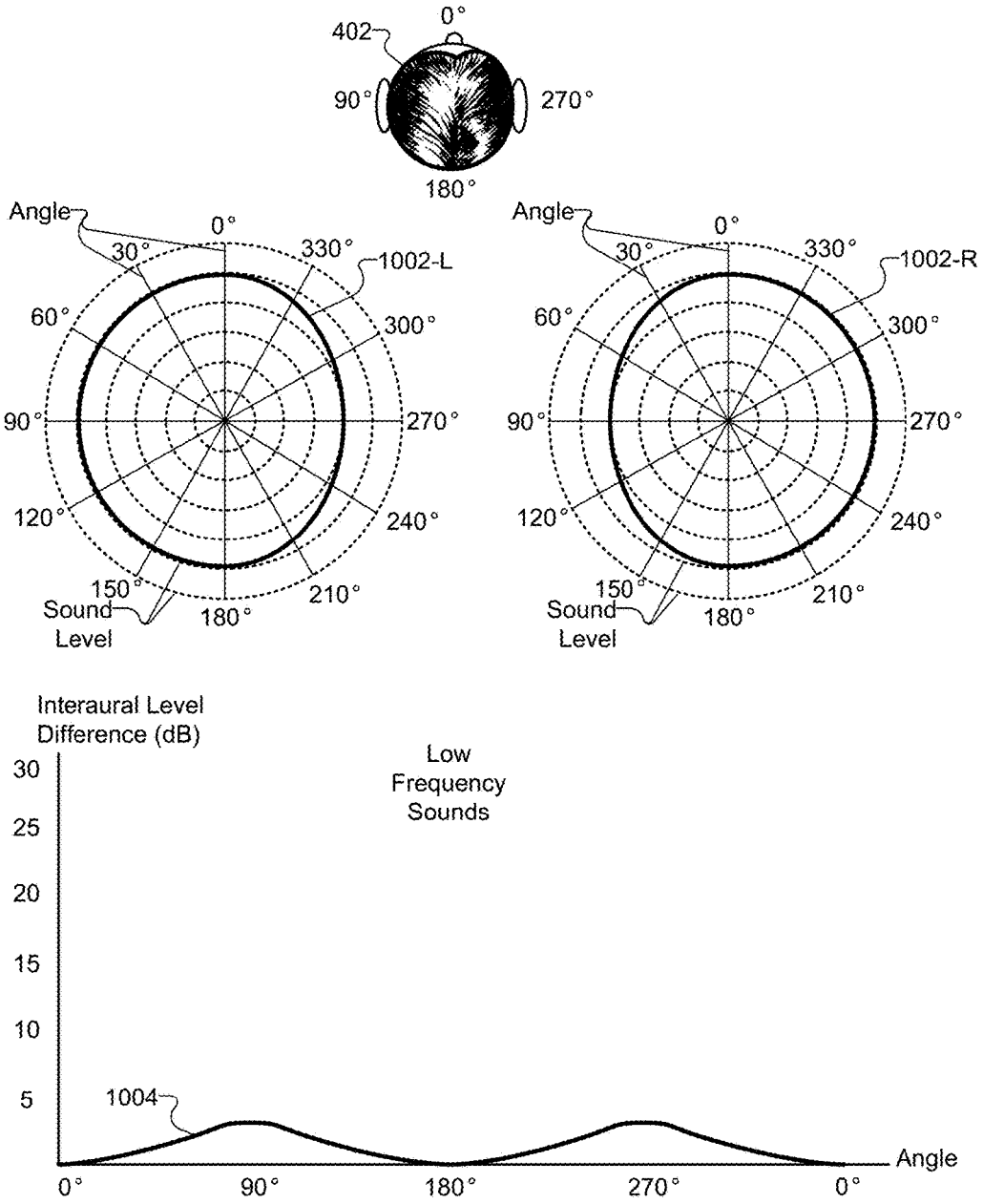
FIG. 10 illustrates exemplary polar patterns and a corresponding ILD magnitude plot associated with low frequency sounds such as the low frequency sound illustrated in FIG. 9 according to principles described herein.

Accordingly, the polar patterns associated with each ear 404 (e.g., with omnidirectional microphones 408 placed at each ear 404) show a much less significant ILD for low frequency sounds than for high frequency sounds. To illustrate, FIG. 10 shows exemplary polar patterns 1002 (i.e., polar patterns 1002-L and 1002-R for the left and right ear of user 402, respectively) and a corresponding ILD magnitude plot 1004 associated with low frequency sounds such as low frequency sound 904 illustrated in FIG. 9. Like lobes 802-L and 802-R of end-fire directional polar patterns 802 in FIG. 8, polar patterns 1002 form mirror-image equivalents of one another and indicate that sound may be attenuated at some angles more than others due to a head shadow of user 402. However, in contrast to end-fire polar pattern 802, polar patterns 1002 are still substantially omnidirectional (i.e., nearly circular except for slight distortions from head shadow 906) because head shadow 906 is much less significant for low frequency sound 904 than was head shadow 706 for high frequency sound 704.

ILD magnitude plot 1004 illustrates the magnitude of the difference between the level of sounds detected at the left ear and at the right ear with respect to the angle from which the sounds emanate. As shown, while ILD magnitude plot 1004 has a similar basic shape as ILD magnitude plot 804 (i.e., showing minimum ILD around 0° and 180° and showing maximum ILD around 90° and 270°), no ILD plotted in ILD magnitude plot 1004 rises above about 5 dB, in contrast to the nearly 30 dB illustrated in ILD magnitude plot 804. In other words, FIG. 10 illustrates that low frequency sounds do not typically generate ILD cues that are as easily perceivable and/or useful for localizing sound sources.

As described above, system 100 may be used to enhance ILD cues to facilitate ILD perception by users of binaural hearing systems, especially for relatively low frequency sounds such as sound 904 which may not be associated with a significant ILD under natural circumstances as shown in FIG. 10.

Figure 11:
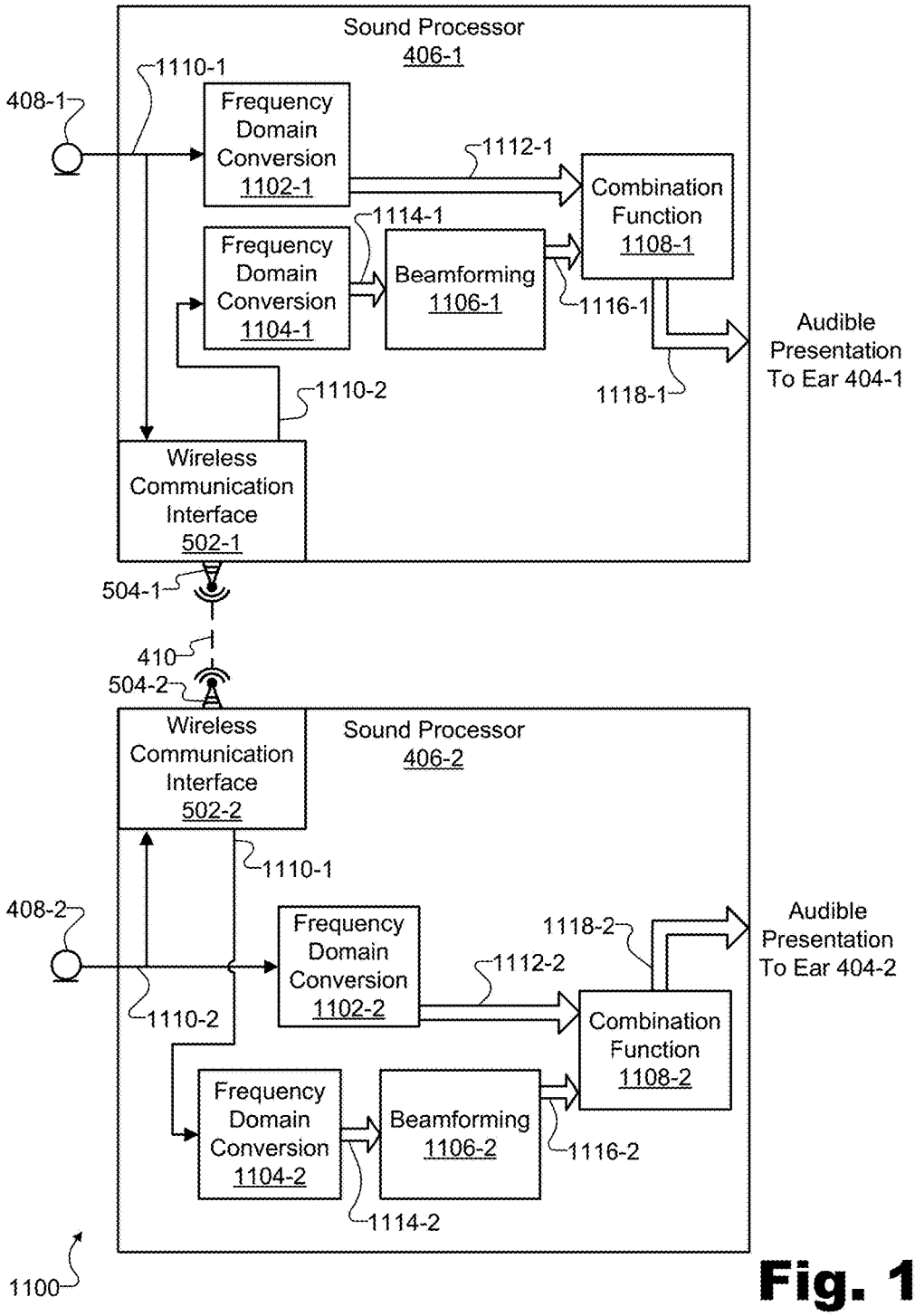
FIG. 11 illustrates an exemplary block diagram of sound processors included within an implementation of the binaural hearing system of FIG. 1 that is configured to perform beamforming operations to enhance ILD cues according to principles described herein.

To illustrate, FIG. 11 shows an exemplary block diagram of sound processors 406 included within an implementation 1100 of system 100 that performs beamforming operations to enhance ILD cues. Specifically, within implementation 1100, sound processors 406 may receive signals from respective microphones 408 and may perform beamforming operations using the signals from microphones 408 to generate directional signals representative of spatial filtering of the audio signal detected by microphones 408 according to an end-fire directional polar pattern different from the polar patterns (e.g., natural, substantially omnidirectional polar patterns) of microphones 408. As mentioned above, it will be understood that microphones 408 may represent or be associated with audio detectors that may perform other pre-processing not explicitly shown. For example, in implementations in which the ILD is enhanced particularly between low frequency components of signals, audio detectors represented by or associated with microphones 408 may perform low-pass filtering on signals generated by microphones 408 in order to eliminate spatial aliasing. In some examples, the filtered signals may then be combined with complementary high-pass filtered, non-beamformed input signals.

While microphones 408 may detect the audio signal (e.g., low frequency components of the audio signal) according to substantially omnidirectional polar patterns (e.g., as illustrated in FIG. 10), sound processors 406 may perform beamforming operations based on the signals associated with the substantially omnidirectional polar patterns to generate directional signals associated with directional (e.g., side-facing cardioid) polar patterns. In this way, system 100 may enhance the ILD between even a low frequency component of the signal detected by microphone 408-1 at ear 404-1 and the low frequency component of the signal detected by microphone 408-2 at ear 404-2. Essentially, by performing the beamforming operations to generate the directional signals and presenting the directional signals to user 402, system 100 may mathematically simulate a "larger" head for user 402, or, in other words, a head that casts a more pronounced head shadow with a more easily-perceivable and useful ILD even for low frequency sounds.

To this end, sound processors 406 may include wireless communication interfaces 502 each associated with respective antennas 504 to generate communication link 410, as described above. FIG. 11 also shows that sound processors 406 may each include respective frequency domain conversion modules 1102 and 1104 (i.e., frequency domain conversion modules 1102-1 and 1104-1 in sound processor 406-1 and frequency domain conversion modules 1102-2 and 1104-2 in sound processor 406-2), beamforming modules 1106 (i.e., beamforming module 1106-1 in sound processor 406-1 and beamforming module 1106-2 in sound processor 406-2), and combination functions 1108 (i.e., combination function 1108-1 in sound processor 406-1 and combination function 1108-2 in sound processor 406-2). Microphones 408, wireless communication interfaces 502 with antennas 504, and communication link 410 are each described above. The other components illustrated in FIG. 11 (i.e., components 1102 through 1108) will now each be described.

As with frequency domain conversion modules 602 and 604 described above in relation to FIG. 6, frequency domain conversion modules 1102 and 1104 are included in-line directly following microphones 408 to convert signals generated by microphones 408 into a frequency domain before the signals are processed according to operations that will be described below. In the example of FIG. 11, the signals generated by microphones 408 are signals 1110 (i.e., signals 1110-1 and 1110-2). Thus, frequency domain conversion modules 1102 and 1104 may divide each of signals 1110 into a plurality of frequency domain signals each representative of a particular frequency band in a plurality of frequency bands associated with signals 1110. For example, each signal 1110 may be divided into 64 different frequency domain signals each representative of a different frequency component of the signal 1110. In this example, each frequency component may correspond to one frequency band in a plurality of 64 frequency bands. In other examples, other suitable numbers of frequency bands may be used as may serve a particular implementation.

As with frequency domain conversion modules 602 and 604, frequency domain conversion modules 1102 and 1104 may convert signals 1110 into the frequency domain (i.e., divide signals 1110 into the plurality of frequency domain signals each representative of the particular frequency band in the plurality of frequency bands) in any way as may serve a particular implementation. For example, frequency domain conversion modules 1102 and 1104 may convert signals 1110 into the frequency domain using a fast Fourier transform ("FFT"), using a plurality of band-pass filters each associated with one particular frequency band within the plurality of frequency bands, or using any combination thereof or any other suitable technique. As in FIG. 6, signals in the frequency domain in FIG. 11 are illustrated using a block-style arrow rather than a linear arrow.

Accordingly, signals 1112 (i.e., signals 1112-1 and 1112-2) and signals 1114 (i.e., signals 1114-1 and 1114-2) include a plurality of frequency domain signals each representative of a particular frequency band associated with signal 1110-1 (in the case of signals 1112-1 and 1114-2) or signal 1110-2 (in the case of signals 1112-2 and 1114-1). Put another way, signals 1112 each represent frequency domain versions of the ipsilateral signal 1110 for each side, while signals 1114 represent frequency domain versions of the contralateral signal 1110 for each side. In both sound processors 406, signals 1114 (i.e., the frequency domain signals representative of the audio signal detected by the contralateral microphone 408) are used by beamforming modules 1106 to perform beamforming operations to generate signals 1116 (i.e., signals 1116-1 and 1116-2). Signals 1116 may be combined with respective signals 1112 (i.e., the frequency domain signals representative of the audio signal detected by the ipsilateral microphone 408) within combination functions 1108 to generate respective directional signals 1118 which may be presented as output signals to user 402 (e.g., in an earphone type hearing system, for example, or in other types of hearing systems as will be described in more detail below).

Beamforming modules 1106 may perform any beamforming operations as may serve a particular implementation to facilitate generation of the directional signals with the end-fire directional polar pattern directed radially outward from ears 404 in the directions perpendicular to ears 404. For example, beamforming modules 1106 may apply, to each of the plurality of frequency domain signals included within each of signals 1114, a phase adjustment and/or a magnitude adjustment associated with a plurality of beamforming coefficients implementing the end-fire directional polar pattern. In other words, beamforming modules 1106 may generate signals 1116 such that when signals 1116 are combined (e.g., added to, subtracted from, etc.) with corresponding signals 1112 in combination functions 1108, signals 1116 will constructively and/or destructively interfere with signals 1112 to amplify and/or attenuate components of signals 1112 to output directional signals 1118 that represent a spatial filtering of signals 1112 according to a preconfigured end-fire directional polar pattern (e.g., having side-facing cardioid lobes).

Additionally, along with implementing the end-fire directional polar pattern, the beamforming coefficients may further be configured to implement an inverse transfer function of a head of the user to reverse an effect of the head on the audio signal as detected at the respective ear (i.e., if the ear is in the head shadow). In other words, along with attenuating a level (e.g., a volume level) of audio signals that propagate past the head of user 402, the head may also affect sound waves in other ways (e.g., by distorting or modifying particular frequencies to alter the sound perceived by an ear within the head shadow). Accordingly, beamforming modules 1106 may be configured to correct the effects that the head produces on the sound by implementing the inverse transfer function of the head and thereby reversing the effects in directional signals 1118.

In FIG. 11, as well as in other figures that will be described below, beamforming modules (e.g., beamforming modules 1106 in FIG. 11, other beamforming modules that will be described below, etc.) are illustrated to perform beamforming operations only on contralateral signals (e.g., respective signals 1114 in FIG. 11). However, in certain implementations, the beamforming modules may additionally or alternatively perform beamforming operations on ipsilateral signals (e.g., respective signals 1112 in FIG. 11). As such, in certain implementations, the beamforming modules may be combined with respective combination functions (e.g., combination functions 1108 in FIG. 11), and may receive both ipsilateral signals (e.g., signals 1112) and contralateral signals (e.g., signals 1114) as inputs.

To illustrate, in FIG. 11, beamforming module 1106-1 may be functionally combined with combination function 1108-1 and may receive both signals 1112-1 and 1114-1 as inputs, while beamforming module 1106-2 may be functionally combined with combination function 1108-2 and may receive both signals 1112-2 and 1114-2 as inputs. This type of configuration may allow other types of implementations that the configurations explicitly illustrated in FIG. 11 and/or other figures herein may not support. For example, by performing beamforming operations on the ipsilateral signals, an implementation including directional signals having a broadside directional polar pattern (i.e., a directional polar pattern having inward-facing cardioid lobes) may be used to enhance ILD.

Combination functions 1108 may each combine respective frequency domain signals from the plurality of frequency domain signals within signals 1116 (i.e., the output signals from beamforming modules 1106 to which the phase adjustment and/or the magnitude adjustment associated with the plurality of beamforming coefficients has been applied) with corresponding frequency domain signals from the plurality of frequency domain signals within signals 1112. As described above, by combining signals 1112 and 1116 in this way, combination functions 1108 may constructively and destructively interfere with signals 1112 (e.g., using signals 1116) such that the signals output from combination functions 1108 are directional signals 1118 that conform with desired directional polar patterns and/or reverse some or all of the other effects of the head.

Figure 12:
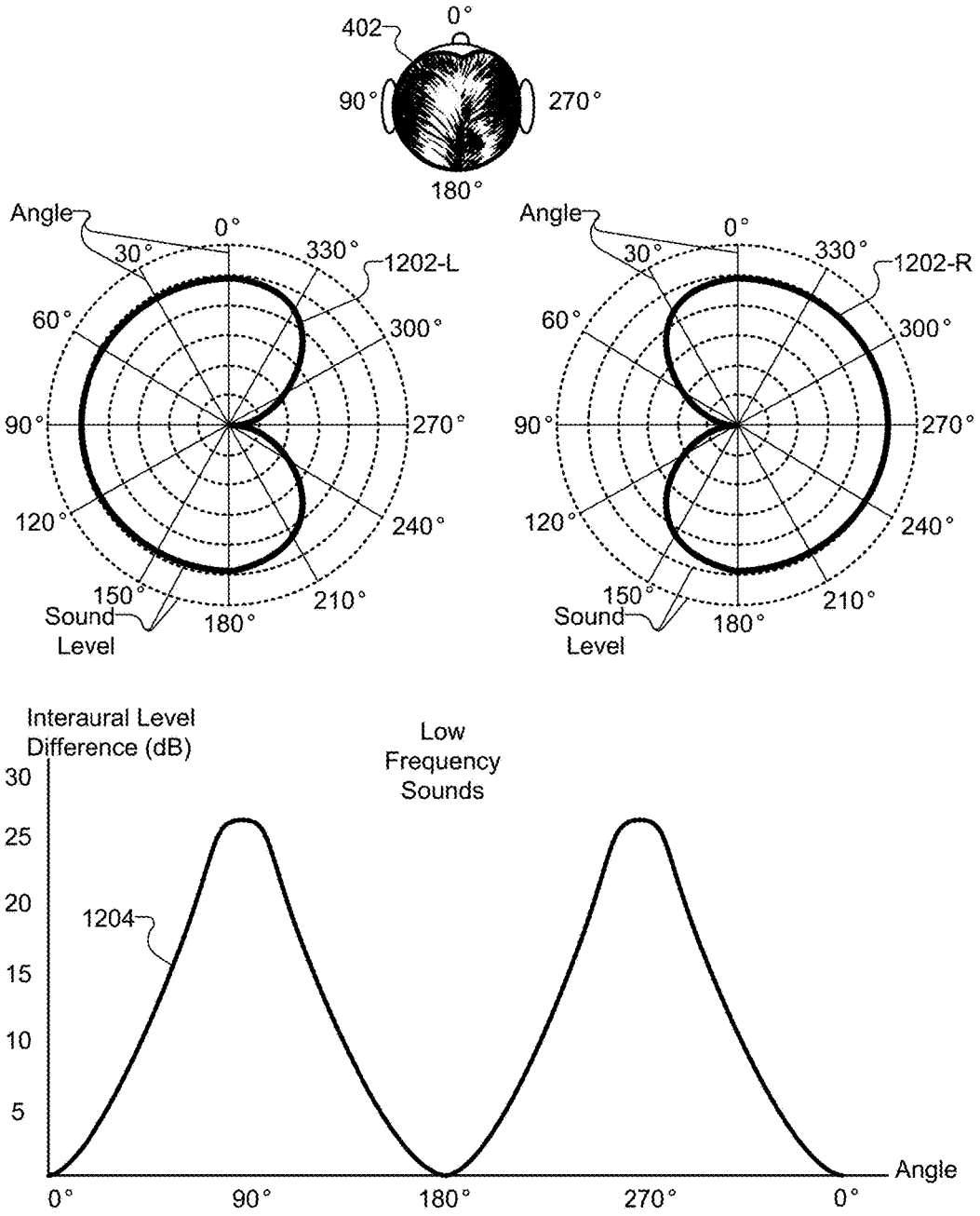
FIG. 12 illustrates an exemplary end-fire polar pattern and a corresponding ILD magnitude plot associated with low frequency sounds such as the low frequency sound illustrated in FIG. 9 when the ILD is enhanced by the implementation of the binaural hearing system illustrated in FIG. 11 according to principles described herein.

For example, directional signals 1118 may conform with an end-fire directional polar pattern shown in FIG. 12. Specifically, FIG. 12 illustrates an exemplary end-fire polar pattern 1202 (e.g., the combination of a left-facing lobe 1202-L and a right-facing lobe 1202-R) and a corresponding ILD magnitude plot 1204 associated with low frequency sounds (or low frequency components of sounds) when the ILD is enhanced by implementation 1100 of system 100.

By performing the beamforming operations described in relation to FIG. 11, sounds at all frequencies may be spatially filtered according to end-fire directional polar pattern 1202. For example, even low frequency sounds and/or low frequency components of sounds, which may normally be received according to substantially omnidirectional polar patterns as described above in relation to FIG. 10, may be presented to the user as if the sounds or components of the sounds were received according to end-fire directional polar pattern 1202 (i.e., similar to end-fire directional polar pattern 802 of high frequency sounds described in relation to FIG. 8).

Along with combining signals 1112 and 1116, circuitry or computing resources associated with combination functions 1108 may further perform other operations as may serve a particular implementation. For example, circuitry or computing resources associated with combination functions 1108 may explicitly calculate an ILD between the signals received by each sound processor 406, further process or enhance the calculated ILD (e.g., with respect to particular frequency ranges), and/or perform any other operations as may serve a particular implementation.

Additionally, while FIG. 11 illustrates that directional signal 1118 are each presented to respective ears 404 (i.e., "Audible Presentation To Ear 404-1" and "Audible Presentation To Ear 404-2"), it will be understood that additional post filtering may be performed in certain implementations prior to the audible presentation at ears 404. For example, directional signals 1118 may be processed in additional processing blocks not explicitly shown in FIG. 11 to further enhance the beamformer output as may serve a particular implementation prior to presentation of the signals at the respective ears. Additionally, in some examples, signals 1118-1 may be exchanged between sound processors 406 (e.g., by way of wireless communication interfaces 502) or may both be generated by both sound processors such that both directional signals 1118-1 and 1118-2 are available to each sound processor 406 for performing additional processing to combine directional signals 1118 and/or otherwise process and enhance signals that are ultimately to be presented at ears 404.

Even in examples where the microphones used to detect the sounds use non-omnidirectional polar patterns (e.g., such as microphones with front facing directional polar patterns), the beamforming operations described herein may help enhance the ILD. In either case, as described above, the ILD is enhanced to simulate an ILD that would result from a head that casts a significant head shadow even at low frequencies. Thus, while omnidirectional (or substantially omnidirectional) microphones may be used to generate perfect (or nearly perfect) side-facing cardioid polar patterns as shown in FIG. 12, non-omnidirectional microphones such as those with a front-facing directional polar pattern may be used to generate lopsided (e.g., "peanut-shaped") polar patterns that have a basic cardioid shape but with reduced lobes near 180° (behind the user) as compared to the lobes near 0° (in front of the user).

ILD magnitude plot 1204 illustrates the magnitude of the difference between the level of sounds detected at the left ear and at the right ear with respect to the angle from which the sounds emanate. As shown, ILD magnitude plot 1204 (for low frequency sounds) is similar or identical to ILD magnitude plot 804 described above due to the enhancement of the ILD performed by system 100. For example, ILD magnitude plot 1204 is very low (e.g., 0 dB) around 0°, 180°, and 360° while being relatively high (e.g., greater than 25 dB) around 90° and 270°.

Figure 13:
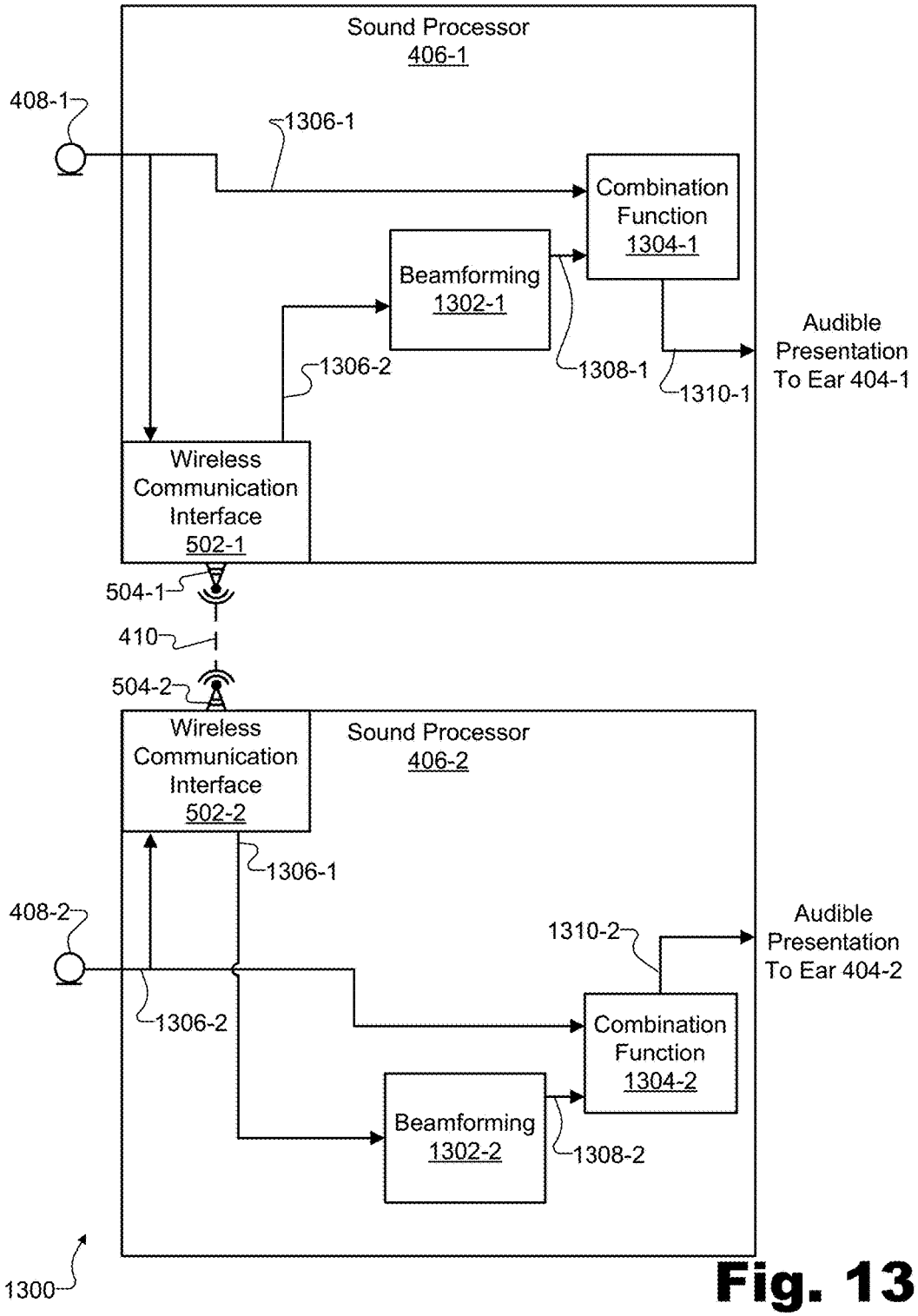
FIGS. 13-15 illustrate other exemplary block diagrams of sound processors included within implementations of the binaural hearing system of FIG. 1 that are configured to perform beamforming operations to enhance ILD cues according to principles described herein.
Figure 14:
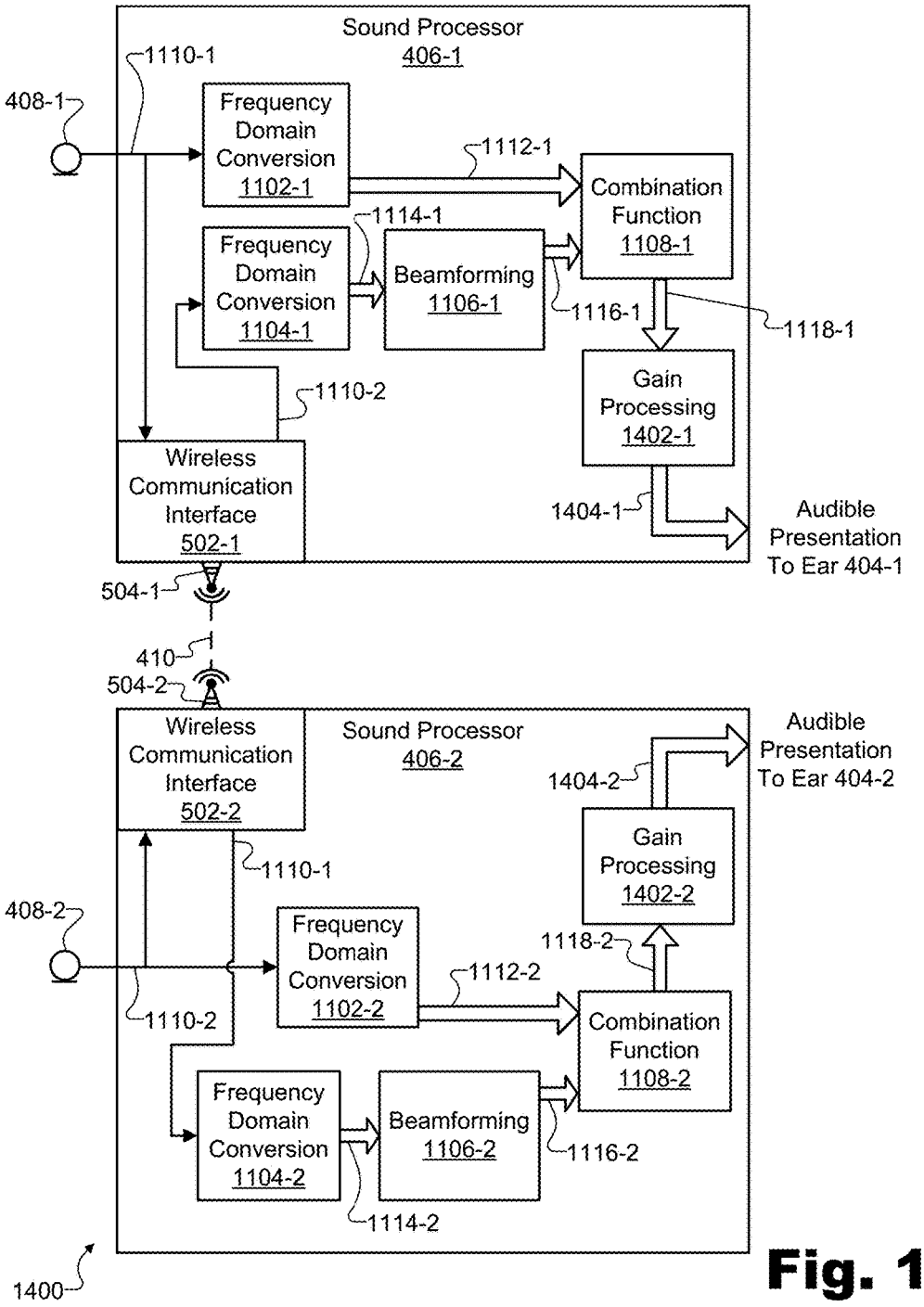
Figure 15:
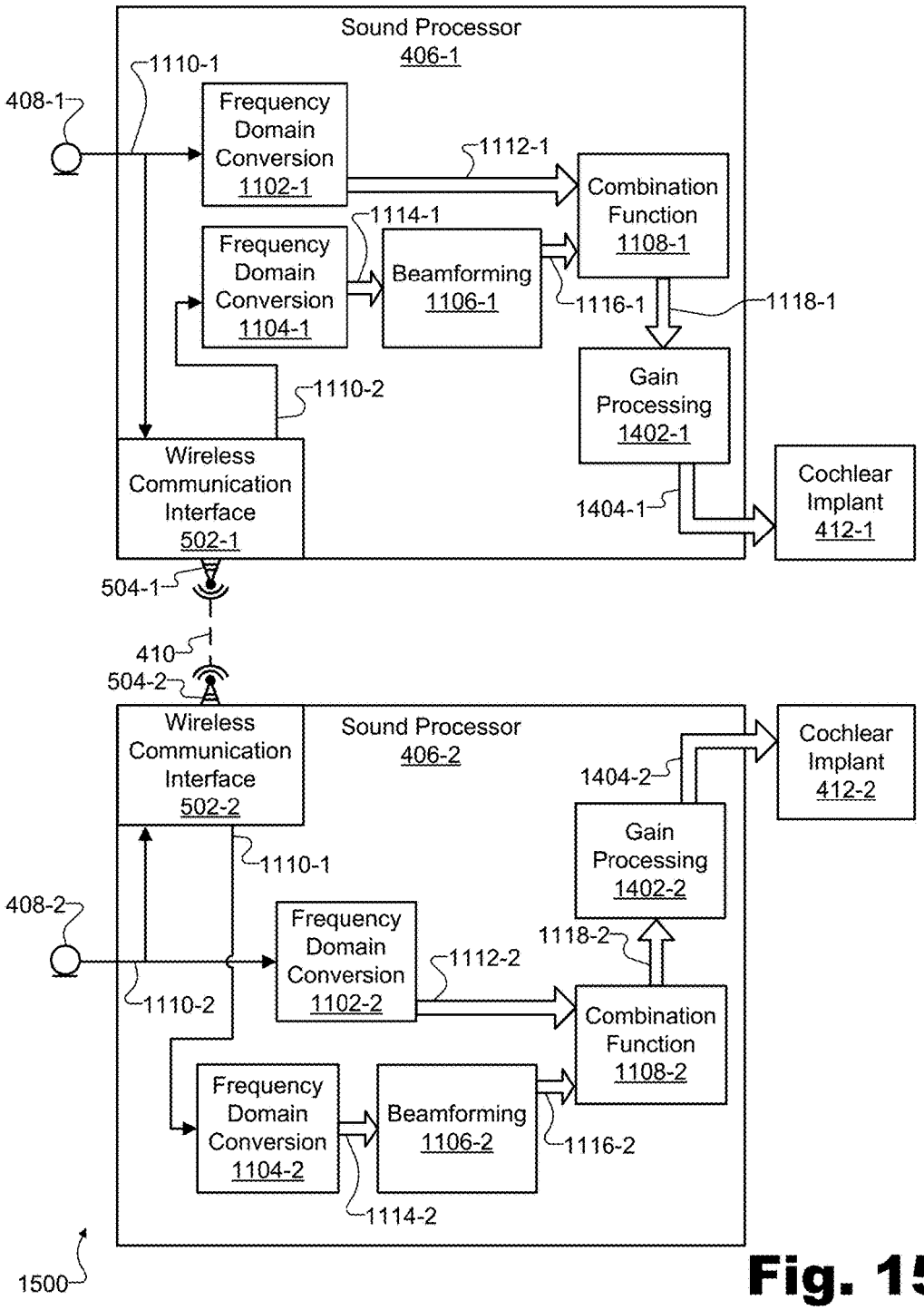

FIGS. 13-15 illustrate additional exemplary block diagrams of sound processors 406 included within alternative implementations of system 100 that are configured to perform beamforming operations to enhance ILD cues. FIGS. 13-15 are similar to FIG. 11 in many respects, but illustrate certain features and/or modifications that may be added or made to implementation 1100 within the spirit of the invention.

For example, FIG. 13 illustrates an implementation 1300 of system 100 in which the time domain, rather than the frequency domain, is used to perform the beamforming operations. Specifically, as illustrated, FIG. 13 includes various components similar to those described in relation to FIG. 11 such as beamforming modules 1302 (i.e., beamforming modules 1302-1 and 1302-2) and combination functions 1304 (i.e., combination functions 1304-1 and 1304-2), as well as other components previously described in relation to other implementations. As shown, each sound processor 406 may generate respective directional signals based on respective beamforming operations while signals generated by microphones 408-1 and 408-2 (i.e., signals 1306-1 and 1306-2, respectively) are in a time domain. In some examples, respective beamforming modules 1302 may generate signals 1308 (i.e., signals 1308-1 and 1308-2, respectively) that, when combined with ipsilateral signals within respective combination functions 1304 (i.e., combining signal 1306-1 with signal 1308-1 and signal 1306-2 with signal 1308-2), may generate respective directional signals 1310 (i.e., signals 1310-2 and 1310-2). As described in relation to FIG. 11 for the frequency domain, beamforming modules 1302 may also apply at least one of a time delay and a magnitude adjustment implementing an end-fire directional polar pattern to respective contralateral signals (i.e., signal 1306-2 for beamforming module 1302-1 and signal 1306-1 for beamforming module 1302-2), while combining functions 1304 may combine the contralateral signals to which the at least one of the time delay and the magnitude adjustment implementing the end-fire directional polar pattern has been applied with the ipsilateral signals to generate respective directional signals 1310. While not explicitly illustrated in FIG. 13, it will also be understood that, in certain implementations, signals may be processed using both the time domain and the frequency domain as may serve a particular implementation.

FIGS. 14 and 15 illustrate modifications to implementation 1100 that may be employed to configure implementation 1100 for other types of hearing systems. For example, while FIG. 11 illustrates directional signals 1118 as being presented to ears 404 (e.g., by directing an electroacoustic transducer) as may be done in certain types of hearing systems (e.g., earphone hearing systems, etc.), FIG. 14 illustrates an implementation 1400 in which additional gain processing modules 1402 (i.e., gain processing modules 1402-1 and 1402-2) may perform gain processing operations (e.g., AGC operations, noise cancellation operations, wind cancellation operations, reverberation cancellation operations, impulse cancellation operations, etc.) prior to outputting output signals 1404 (i.e., signals 1404-1 and 1404-2). For example, implementation 1400 may be used in a hearing aid type hearing system where output signals 1404 would then be used to direct an electroacoustic transducer to generate sound at respective ears 404 of user 402.

Similarly, FIG. 15 illustrates an implementation 1500 in which the additional gain processing modules 1402 may perform the gain processing operations before outputting output signals 1404 to respective cochlear implants 412 to direct cochlear implants 412 to provide electrical stimulation to one or more locations within respective cochleae of user 402 based on output signals 1404. Accordingly, implementation 1500 may be used in a cochlear implant type hearing system.

As described above, system 100 may be configured to enhance the ILD between signals detected by microphones at each ear of a user, including even for low frequency sounds relatively unaffected by a head shadow of the user, and/or to preserve the ILD while a gain processing operation is performed on the signals prior to presenting the signals to the user. Examples described above largely focus on the enhancing of the ILD and the preserving of the ILD separately. It will be understood, however, that certain implementations of system 100 may be configured to both preserve and enhance the ILD as described and illustrated above.

More specifically, in certain implementations, system 100 may include a first audio detector (e.g., microphone) associated with a first ear of a user and that detects an audio signal at the first ear according to a first polar pattern (e.g., a substantially omnidirectional polar pattern that mimics the natural polar pattern of the first ear) as the audio signal is presented to the user, and generates, as the audio signal is presented to the user, a first signal representative of the audio signal as detected by the first audio detector at the first ear. Similarly, system 100 may also include a second audio detector associated with a second ear of the user and that detects the audio signal at the second ear according to a second polar pattern (e.g., forming a mirror-image equivalent of the first polar pattern) as the audio signal is presented to the user, and generates, as the audio signal is presented to the user, a second signal representative of the audio signal as detected by the second audio detector at the second ear. System 100 may further include a first sound processor associated with the first ear of the user and that is communicatively coupled directly to the first audio detector, and a second sound processor associated with the second ear of the user and that is communicatively coupled directly to the second audio detector.

Within these implementations, the first sound processor may both preserve and enhance an ILD between the first signal and the second signal as a gain processing operation is performed by the first sound processor on a signal representative of at least one of the first and second signals prior to presenting a gain-processed output signal representative of a first directional signal.

For example, the first sound processor may preserve and enhance the ILD by receiving the first signal directly from the first audio detector; receiving the second signal from the second sound processor via a communication link interconnecting the first and second sound processors; detecting an amplitude of the first signal and an amplitude of the second signal (e.g., while the first signal and the second signal are in a time domain); comparing (e.g., while the first and second signals are in the time domain) the detected amplitude of the first signal and the detected amplitude of the second signal to determine a maximum amplitude between the amplitude of the first signal and the amplitude of the second signal; generating, based on the comparison of the first and second signals (e.g., and while the first and second signals are in the time domain), a gain processing parameter for whichever of the first and second signals that has the maximum amplitude according to the comparison; performing, based on the gain processing parameter, a gain processing operation on the signal representative of at least one of the first signal and the second signal; generating, based on a first beamforming operation using the first and second signals, the first directional signal to be representative of a spatial filtering of the audio signal detected at the first ear according to an end-fire directional polar pattern (e.g., different from the first and second polar patterns and having twin lobes directed radially outward from the ears of the user in a opposite directions along an axis passing through the ears); and presenting, based on the performance of the gain processing operation and on the generation of the first directional signal, the gain-processed output signal representative of the first directional signal to the user at the first ear of the user. System 100 may perform these operations in any way as may serve a particular implementation such as described and illustrated above.

Also within these implementations, the second sound processor may similarly preserve and enhance the ILD between the first and second signals as another gain processing operation is performed by the second sound processor on another signal representative of at least one of the first signal and the second signal prior to presenting another gain-processed output signal representative of a second directional signal.

For example, the second sound processor may preserve and enhance the ILD by receiving the second signal directly from the second audio detector; receiving the first signal from the first sound processor via a communication link interconnecting the first and second sound processors; detecting, independently from the detection by the first sound processor of the amplitude of the first signal and the amplitude of the second signal, the amplitude of the first signal and the amplitude of the second signal (e.g., while the first signal and the second signal are in the time domain); comparing, independently from the comparison of the first signal and the second signal by the first sound processor (e.g., and while the first and second signals are in the time domain), the detected amplitude of the first signal and the detected amplitude of the second signal to determine the maximum amplitude between the amplitude of the first signal and the amplitude of the second signal; generating, independently from the generation of the gain processing parameter by the first sound processor and based on the comparison by the second sound processor of the first signal and the second signal, the gain processing parameter for whichever of the first and second signals that has the maximum amplitude according to the comparison by the second sound processor; performing, based on the gain processing parameter, the other gain processing operation on the other signal representative of at least one of the first signal and the second signal; generating, based on a second beamforming operation using the first and second signals, the second directional signal to be representative of a spatial filtering of the audio signal detected at the second ear according to the end-fire directional polar pattern; and presenting, based on the performance of the other gain processing operation and on the generation of the second directional signal, the other gain-processed output signal representative of the second directional signal to the user at the second ear of the user. System 100 may perform these operations in any way as may serve a particular implementation such as described and illustrated above.

Figure 16:
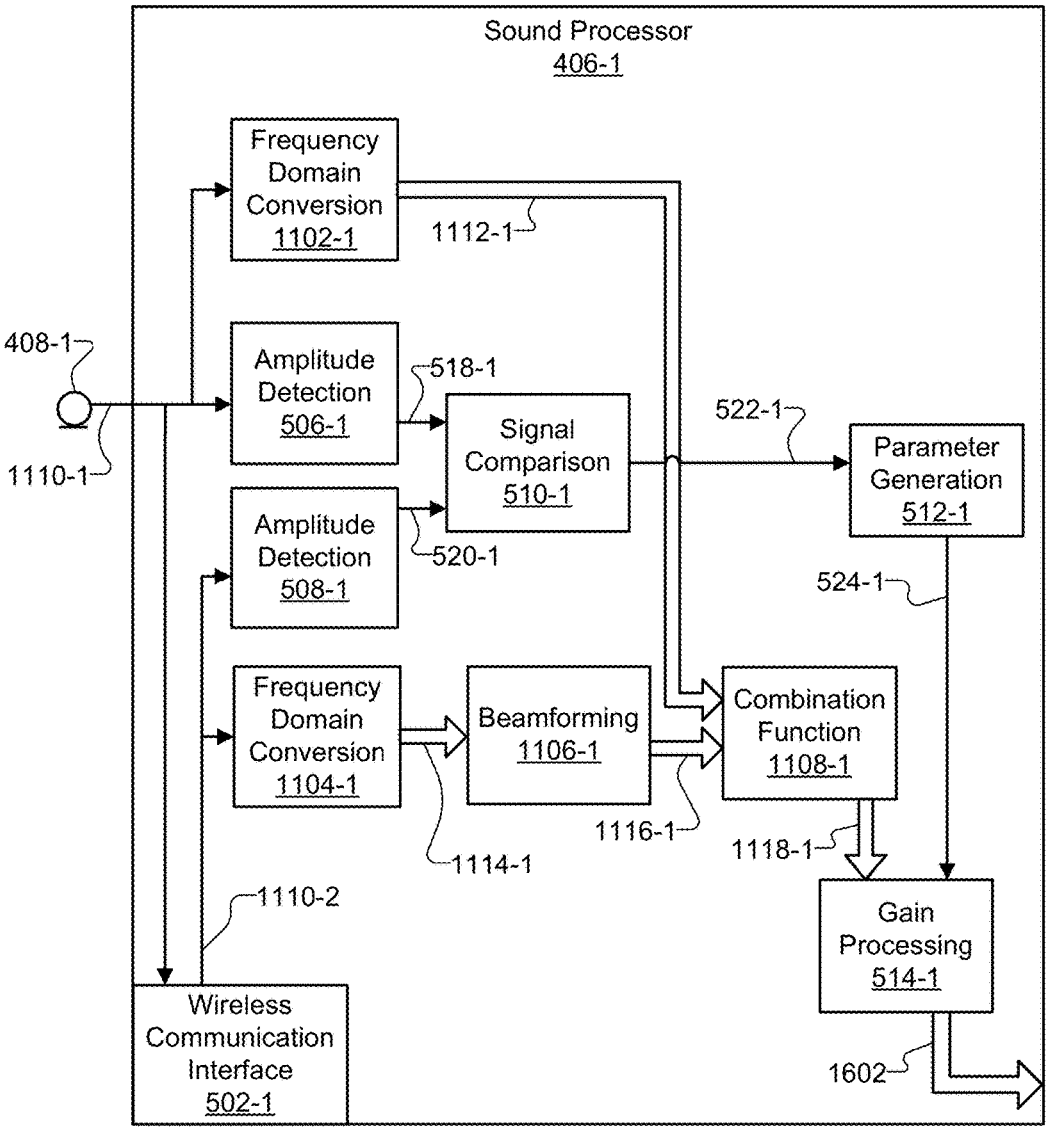
FIGS. 16-17 illustrate exemplary block diagrams of sound processors included within implementations of the binaural hearing system of FIG. 1 that are configured to perform synchronized gain processing to preserve ILD cues and to perform beamforming operations to enhance the ILD cues according to principles described herein.
Figure 17:
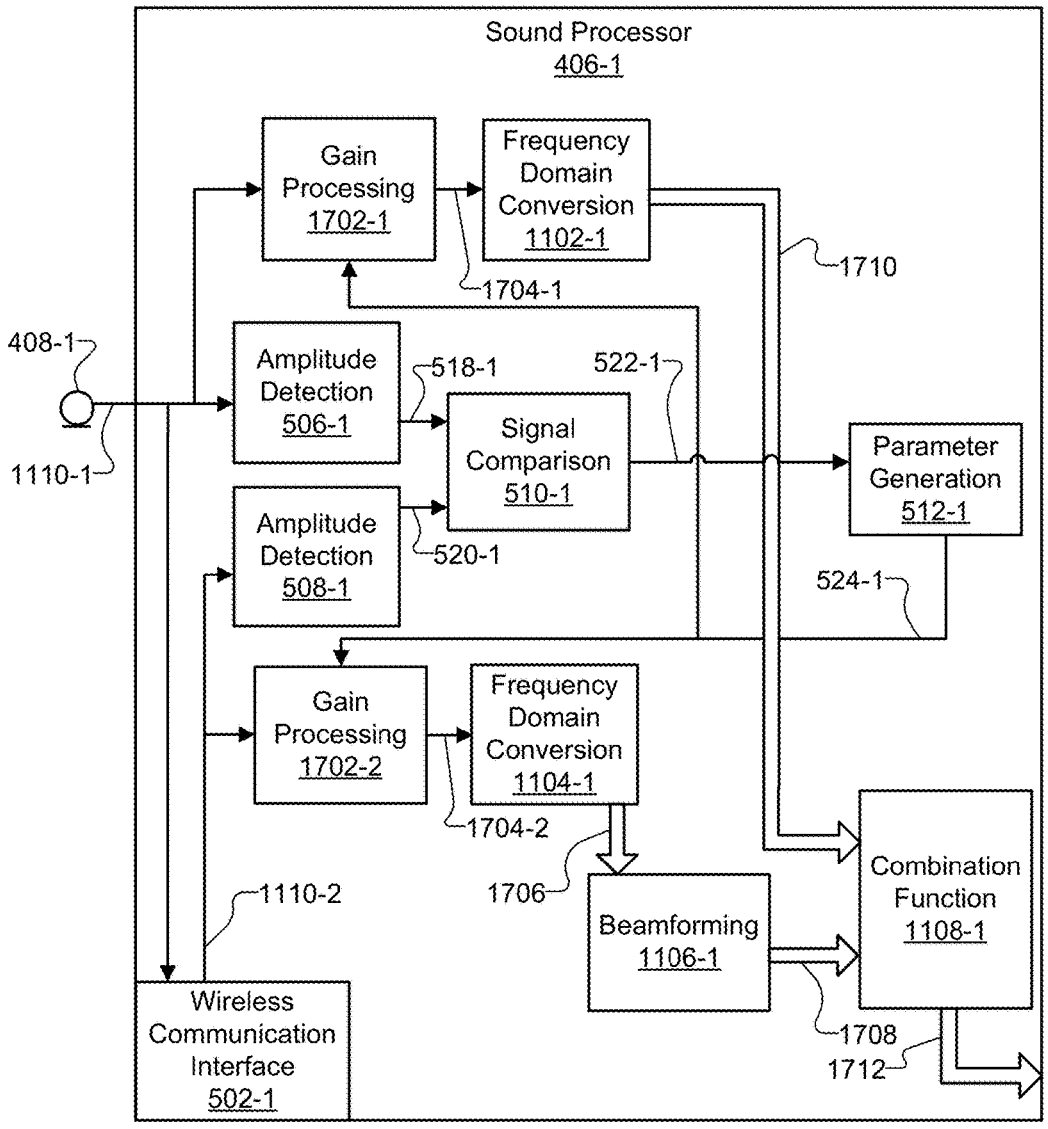

To illustrate, FIGS. 16-17 show exemplary block diagrams of sound processors 406 included within implementations of system 100 that are configured to perform synchronized gain processing to preserve ILD cues as well as to perform beamforming operations to enhance the ILD cues as described above. Due to space constraints and in the interest of simplicity and clarity of description, FIGS. 16-17 each illustrate only one sound processor (i.e., sound processor 406-1). It will be understood, however, that, as with other block diagrams described previously, sound processor 406-1 in FIGS. 16-17 may be complemented by a corresponding implementation of sound processor 406-2 communicatively coupled with sound processor 406-1 via wireless communication interfaces 502.

FIG. 16 illustrates an implementation 1600 in which sound processor 406-1 generates a gain-processed output signal 1602 that is representative of a directional signal using components and signals similar to those described above. In FIG. 16, signals 1110 are converted to the frequency domain (i.e., by frequency domain conversion modules 1102 and 1104) before undergoing beamforming operations (e.g., using beamforming module 1106-1 and combination function 1108-1) to generate directional signal 1118-1 in a similar manner as described above. As further described above, it will be understood that beam forming operations may be performed in the time domain rather than the frequency domain in certain implementations.

As shown, signals 1110 may also be concurrently compared and/or processed in the time domain (e.g., by amplitude detection modules 506-1 and 508-1, signal comparison module 510-1, and parameter generation 512-1) to generate at least one gain parameter 524-1 in a similar manner as described above. As further described above, it will be understood that parameter generation operations may be performed in the frequency domain rather than the time domain in certain implementations.

As shown, gain processing module 514-1 may then perform one or more gain processing operations on each of the plurality of frequency domain signals included within a plurality of frequency domain signals represented by directional signal 1118-1 using the same gain parameter 524-1 for each frequency domain signal to generate gain-processed output signal 1602, which may be presented to user 402 at ear 404-1.

Accordingly, as illustrated by FIG. 16, sound processor 406-1 may preserve the ILD between signal 1110 as the one or more gain processing operations are performed on signals 1110 by performing the gain processing operations on the first directional signal (e.g., directional signal 1118-1) subsequent to generating the first directional signal and prior to presenting the gain-processed output signal (e.g., gain-processed output signal 1602) representative of the first directional signal.

In contrast, however, sound processor 406-1 may, in other examples, preserve the ILD between signals 1110 as the one or more gain processing operations are performed on signals 1110 by performing the gain processing operations individually on each of signals 1110 prior to generating the first directional signal and presenting the gain-processed output signal representative of the first directional signal.

To illustrate, FIG. 17 shows an implementation 1700 in which sound processor 406-1 uses separate gain processing modules 1702 (i.e., gain processing modules 1702-1 and 1702-2) to process each signal 1110 in the time domain to generate signals 1704 (i.e., signals 1704-1 and 1704-2) which are converted to the frequency domain by frequency domain conversion modules 1102-1 and 1104-1 in a similar way as described above. Accordingly, a plurality of frequency domain signals 1706 is processed by beamforming module 1106-1 to generate frequency domain signals 1708 and combined with signal 1710 (i.e., within combination function 1108-1 in a similar way as described above) to generate a gain-processed output signal 1712 that, like gain-processed output signal 1602 described above, is representative of a directional signal.

As shown, signals 1110 may also be concurrently compared and/or processed (e.g., in the time domain) by the same components and in a similar way as described above with respect to FIG. 16 to generate gain parameter 524-1. Gain parameter 524-1 may be received by both gain processing modules 1702 such that the gain processing operations performed by gain processing modules 1702 may each be based on the same gain parameter 524-1.

The description above details how system 100 and various implementations thereof may facilitate ILD perception by users of binaural hearing systems by enhancing and/or preserving ILD in various ways as the binaural signals are processed by the system. More particularly, the description above discloses various aspects and operations that one or more sound processors within a binaural hearing system may perform to preserve and/or enhance the ILD to the full extent possible using the aspects and operations described. As used herein, such implementations may be said to enhance and/or preserve the ILD to a "full degree" or, in other words, to the fullest extent possible. However, as mentioned above, it may be desirable for certain users and/or in certain listening scenarios to balance other considerations with enhancing and/or preserving the ILD. For example, in certain instances, preserving the ILD to the full degree may come at the expense of using a full dynamic range of both sound processors, thereby artificially limiting the level of sound (e.g., the loudness level) at one ear of the user in a non-ideal way. While limiting the level in this way may generally be beneficial to the user for the reasons described above (e.g., for reasons related to ILD preservation and enhancement), it may not be beneficial in all situations and circumstances. For example, in certain circumstances, it may be desirable, at least with respect to one sound processor and one ear, to abstain from preserving and/or enhancing the ILD at all (referred to herein as preserving and/or enhancing the ILD to a "null degree"), or to only preserve and/or enhance the ILD to a limited extent (referred to herein as preserving and/or enhancing the ILD to a "partial degree").

As described above, system 100 may be configured to preserve and/or enhance the ILD to the full degree at both ears to provide a maximum ILD benefit to the user in certain examples. However, in other examples, other considerations may outweigh the benefits of such ILD preservation and/or enhancement. For instance, user-specific or hearing-scenario-specific considerations related to loudness, dynamic range, and so forth, may make it desirable for the system implement a greater degree of versatility with regard to how and to what extent the ILD is preserved and/or enhanced at each ear. For some users and/or in some scenarios, for example, it may be desirable to preserve and/or enhance the ILD at one or both ears only to a partial degree, or to a null degree (i.e., negligibly or not at all).

To this end, an exemplary implementation of system 100 for preserving an ILD to a distinct degree for each ear of a user may include a binaural pair of audio detectors, a binaural pair of sound processors associated with the binaural pair of audio detectors, and a communication link interconnecting the binaural pair of sound processors, similar to other implementations of system 100 described herein. Within this implementation of system 100, the binaural pair of audio detectors may include a first audio detector that generates a first signal representative of an audio signal presented to a user as the audio signal is detected by the first audio detector at a first ear of the user, as well as a second audio detector that generates a second signal representative of the audio signal as detected by the second audio detector at a second ear of the user. Also like other implementations of system 100 described herein, the communication link may be configured to enable transmission of the first and second signals between the binaural pair of sound processors.

The binaural pair of sound processors in this exemplary implementation of system 100 may include, similar to other implementations of system 100 described herein, a first sound processor associated with the first ear and coupled directly to the first audio detector, and a second sound processor associated with the second ear and coupled directly to the second audio detector. The binaural pair of sound processors may be configured to preserve, to a distinct degree for each of the first and second ears of the user, an ILD between the first and second signals. For example, the binaural pair of sound processors may preserve the ILD by performing a contralateral gain synchronization operation to a first degree with respect to the first and second signals at the first sound processor, and by performing the contralateral gain synchronization operation to a second degree with respect to the first and second signals at the second sound processor. In some examples, the second degree may be the same as the first degree while, in other examples, the second degree may be distinct from the first degree.

As used herein, a "contralateral gain synchronization operation" may refer to one or more of operations described herein for synchronizing, to some degree (e.g., a null degree, a partial degree, a full degree, etc.), a gain processing parameter determined by one sound processor with a gain processing parameter determined by the other, contralateral sound processor. For example, as described above, operations such as receiving or otherwise determining both the first and second signals at a particular sound processor, comparing the first and second signals (e.g., to determine which level or magnitude is greater, lesser, etc.), generating a gain processing parameter based on the comparison (e.g., based on whichever of the first and second signals was determined to be greater, lesser, etc.), and performing a gain processing operation based on the gain processing parameter determined in this way, all may be included among the operations performed as part of a contralateral gain synchronization operation. Different operations and/or additional operations may also be included among the operations performed as part of the contralateral gain synchronization operation, as will be described in more detail below.

Contralateral gain synchronization operations may be said to be performed to a "full degree" when gain processing parameters are determined by detecting, comparing, and fully taking into account not only the ipsilateral signal (i.e., the signal captured by the audio detector on the same side), but also the contralateral signal (i.e., the signal captured by the audio detector on the opposite side and transmitted by way of the communicative link). The contralateral signal may be considered to have been taken into account when the contralateral signal is received and compared, regardless of whether the contralateral signal ultimately ends up forming a basis for the determination of the gain processing parameter. For instance, the examples described above in which the ILD was preserved by fully synchronizing the gain processing parameter between sound processors may be said to involve contralateral gain synchronization operations performed to the full degree regardless of which signal ultimately formed the basis for the gain processing parameter in each example. In other words, regardless of which signal was changed to become synchronous with the other signal, both sound processors in each example may be considered to have performed the contralateral gain synchronization operation to the full degree.

Similarly, contralateral gain synchronization operations may be said to be performed to a "partial degree" when gain processing parameters are determined by detecting, comparing, and at least partially accounting for both ipsilateral and contralateral signals (e.g., by weighting the contralateral signal and the ipsilateral signal in any suitable way as will be described below). Contralateral gain synchronization operations may be said to be performed to a "null degree" when gain processing parameters are determined without reference to contralateral signals (e.g., without receiving and/or comparing both signals to account for the contralateral signal when appropriate) or when contralateral signals are substantially ignored and not taken into account as the gain processing parameter is determined.

Binaural systems and methods for preserving an ILD to a distinct degree for each ear of a user (e.g., by way of performing contralateral gain synchronization operations to different degrees at each ear) may provide additional benefits beyond those provided by system and methods described above for facilitating ILD perception by performing contralateral gain synchronization operations only to the full degree. For example, as will be described in more detail below, users having asymmetrical hearing may be facilitated in performing sound localization without compromising dynamic range, or may be better able to balance competing priorities of sound localization and dynamic range in a desirable way. Additionally, in certain scenarios, performing contralateral gain synchronization operations to the full degree may cause certain undesirable outcomes that will be described below in more detail. As such, binaural systems for preserving an ILD to a distinct degree for each ear of a user described herein may, at least temporarily, switch from performing the contralateral gain synchronization operations to the full degree to performing the contralateral gain synchronization operations to a partial degree or a null degree as the situation may call for. Consequently, binaural hearing systems for preserving an ILD to a distinct degree for each ear of a user may be more versatile and provide the same, as well as additional, benefits to users as provided by other binaural hearing systems for facilitating ILD perception described herein.

Conventional binaural hearing systems (e.g., binaural systems that, unlike system 100, do not utilize a communicative link to interchange signals detected at both ears but, rather, operate independently at both ears using only ipsilaterally detected signals) may naturally be configured to maximize a full dynamic range with respect to various types of gain (e.g., AGC gain, noise cancellation gain, wind cancellation gain, reverberation cancellation gain, impulse cancellation gain, etc.). As such, each sound processor in such binaural hearing systems may operate independently to determine gain processing parameters for gain processing operations based only on ipsilateral signals.

Figure 18:
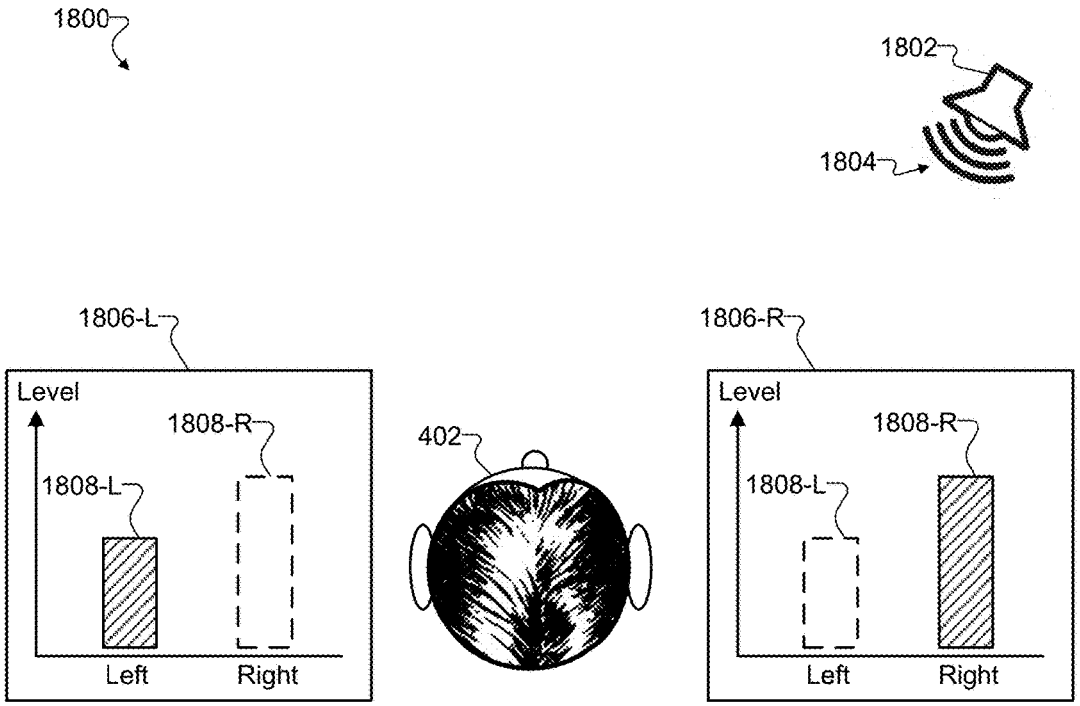
FIG. 18 illustrates exemplary bases for an independent generation of gain processing parameters at each ear of a user according to principles described herein.

To illustrate, FIG. 18 shows exemplary bases for an independent generation of gain processing parameters at each ear of a user that may be used by this type of conventional binaural hearing system. In an example 1800 illustrated in FIG. 18, an exemplary sound source 1802 generates an exemplary sound 1804 that is offset to the right side of user 402, as shown. Because of the right-side offset, an audio detector disposed at the right ear of user 402 may detect sound 1804 at a higher level than an audio detector disposed at the left ear of user 402 for the reasons described above (e.g., the head shadow of user 402, etc.). In FIG. 18, bases 1806 (e.g., a basis 1806-L on the left of user 402 and a basis 1806-R on the right of user 402) are depicted on either side of user 402 to illustrate which signal 1808 (e.g., a first signal 1808-L detected at the left ear or a second signal 1808-R detected at the right ear) forms the basis for determining a gain processing parameter at the sound processor on each side. Specifically, as shown by the shaded box within basis 1806-L, the sound processor on the left uses first signal 1808-L detected at the left ear as the sole basis for determining the gain processing parameter, while, as shown by the shaded box within basis 1806-R, the sound processor on the right uses second signal 1808-R detected at the right ear as the sole basis for determining the gain processing parameter. As a result of using different signals 1808 as the basis for generating the gain processing parameter, the sound processors of example 1800 may be expected to determine different gain processing parameters at each ear, thereby maximizing dynamic range but not preserving the ILD between signals 1808, as described above.

While both signals 1808 are illustrated within each basis 1806 for comparison purposes (i.e., to illustrate, by the heights of the signals that a level of signal 1808-R is greater than a level of signal 1808-L due to the ILD caused by the relative position of sound source 1802 with respect to user 402), the contralateral signals depicted on each side (i.e., signal 1808-R on the left side and signal 1808-L on the right side) are outlined by dashed lines. This notation is meant to indicate that these contralateral signals 1808 may not actually even be available to be taken into account by the conventional binaural hearing system due to the lack of a communicative link between the sound processors associated with each ear. Accordingly, in this conventional example, no contralateral gain synchronization operation may be performed, and the dynamic range of each sound processor may be optimized while no ILD may be preserved at all.

Figure 19:
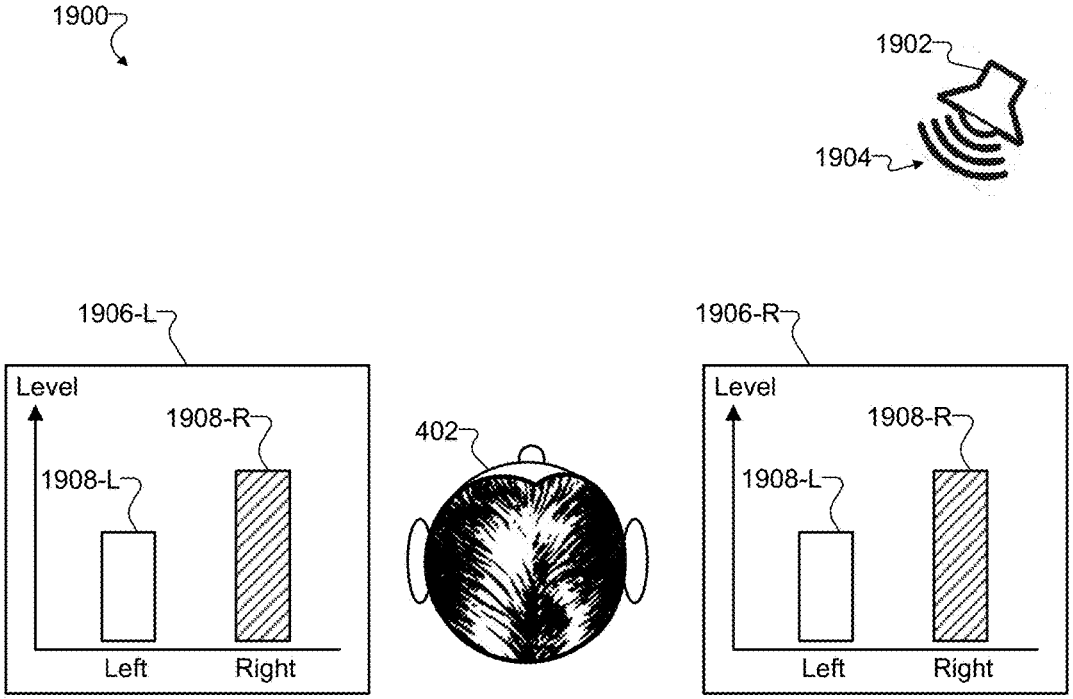
FIG. 19 illustrates exemplary bases for a contralaterally synchronized generation of gain processing parameters at each ear of a user according to principles described herein.

In contrast, FIG. 19 illustrates exemplary bases for a contralaterally synchronized generation of gain processing parameters at each ear of a user. Specifically, as with various implementations of system 100 described above, the binaural hearing system in an example 1900 of FIG. 19 may perform a contralateral gain synchronization operation to the full degree by fully synchronizing the gain processing parameter to be the same at both ears. Specifically, as shown, a sound source 1902 generates a sound 1904 that, like sound 1804 of example 1800, is offset to the right side of user 402. Accordingly, as shown in both bases 1906-L and 1906-R, the level of a second signal 1908-R is greater than the level of a first signal 1908-L. Unlike the binaural hearing system of example 1800, however, the binaural hearing system of example 1900 may include a communicative link whereby each sound processor may receive access to both signals 1908-L and 1908-R. Accordingly, both sound processors may take their respective ipsilateral and contralateral signals 1908 into account so as to base the determination of their respective gain processing parameters on the same signal 1908 (e.g., on signal 1908-R in this example, because the level of signal 1908-R is greater than the level of signal 1908-L).

Consequently, as shown by the shaded box in basis 1906-R, the sound processor associated with the right ear of user 402 may again, as in example 1800, use the ipsilateral signal (i.e., signal 1908-R) as the sole basis for generating the gain processing parameter. However, as shown by the shaded box in basis 1906-L, the sound processor associated with the left ear of user 402 may, in contrast to example 1800, use the contralateral signal (i.e., also signal 1908-R) as the sole basis for generating the gain processing parameter. Because the bases are the same, both sound processors may be expected to independently generate the same gain processing parameter and to thereby preserve and maintain the ILD between signals 1908-L and 1908-R when the gain processing parameters are each used to perform parallel gain processing operations as described above. Accordingly, in this example, full contralateral gain synchronization may be implemented, and the ILD between signals 1908 may be fully optimized while the dynamic range (e.g., of the sound processor on the left in this example in which sound source 1902 is located to the right of user 402) may be artificially limited to some extent.

As described above, system 100 may be implemented so as to be versatile in the sense that system 100 may be configured to prioritize or optimize different considerations (e.g., ILD preservation, dynamic range maximization, etc.) to different extents in different ears. More specifically, the binaural pair of sound processors included within an exemplary implementation of system 100 for preserving an ILD to a distinct degree for each ear of a user may be configured to perform a contralateral gain synchronization operation to a first degree at a first sound processor in the binaural pair and to perform the contralateral gain synchronization operation to a second degree (e.g., distinct from the first degree) at a second sound processor in the binaural pair.

The system may perform the contralateral gain synchronization operation to the first degree at the first sound processor by receiving the first signal (e.g., the ipsilateral signal for the first sound processor) directly from the first audio detector, receiving the second signal (e.g., the contralateral signal for the first sound processor) from the second sound processor by way of the communication link, determining a level (e.g., a loudness level) of the first signal, determining a level of the second signal, and determining the first degree to which the contralateral gain synchronization operation is to be performed. Based on the determined levels of the first and second signals, as well as on the first degree to which the contralateral gain synchronization operation is to be performed, the first sound processor may generate a first gain processing parameter based on: 1) exclusively the level of the first signal if the first degree is a null degree or if the level of the first signal is greater than the level of the second signal, 2) exclusively the level of the second signal if the level of the second signal is greater than the level of the first signal and the first degree is a full degree, and 3) both the levels of the first and second signals (e.g., weighted together in a particular way) if the level of the second signal is greater than the level of the first signal and the first degree is a partial degree. Also as part of the contralateral gain synchronization operation, the first sound processor may perform a first gain processing operation, based on the first gain processing parameter, on a first at least one of the first and second signals to thereby generate a first output signal.

Similarly, the system may perform the contralateral gain synchronization operation to the second degree at the second sound processor by receiving the second signal (e.g., the ipsilateral signal for the second sound processor) directly from the second audio detector, receiving the first signal (e.g., the contralateral signal for the second sound processor) from the first sound processor by way of the communication link, determining the level of the first signal, determining the level of the second signal, and determining the second degree to which the contralateral gain synchronization operation is to be performed at the second sound processor. Based on the determined levels of the first and second signals (i.e., the same levels determined by the first sound processor), as well as on the second degree to which the contralateral gain synchronization operation is to be performed, the second sound processor may generate a second gain processing parameter based on: 1) exclusively the level of the second signal if the second degree is a null degree or the level of the second signal is greater than the level of the first signal, 2) exclusively the level of the first signal if the level of the first signal is greater than the level of the second signal and the second degree is a full degree, and 3) both the levels of the first and second signals (e.g., weighted together in a particular way) if the level of the first signal is greater than the level of the second signal and the second degree is a partial degree. Also as part of the contralateral gain synchronization operation, the second sound processor may perform a second gain processing operation, based on the second gain processing parameter, on a second at least one of the first and second signals (e.g., the same or a different signal or signals upon which the first gain processing operation is performed) to thereby generate a second output signal.

Figure 20:
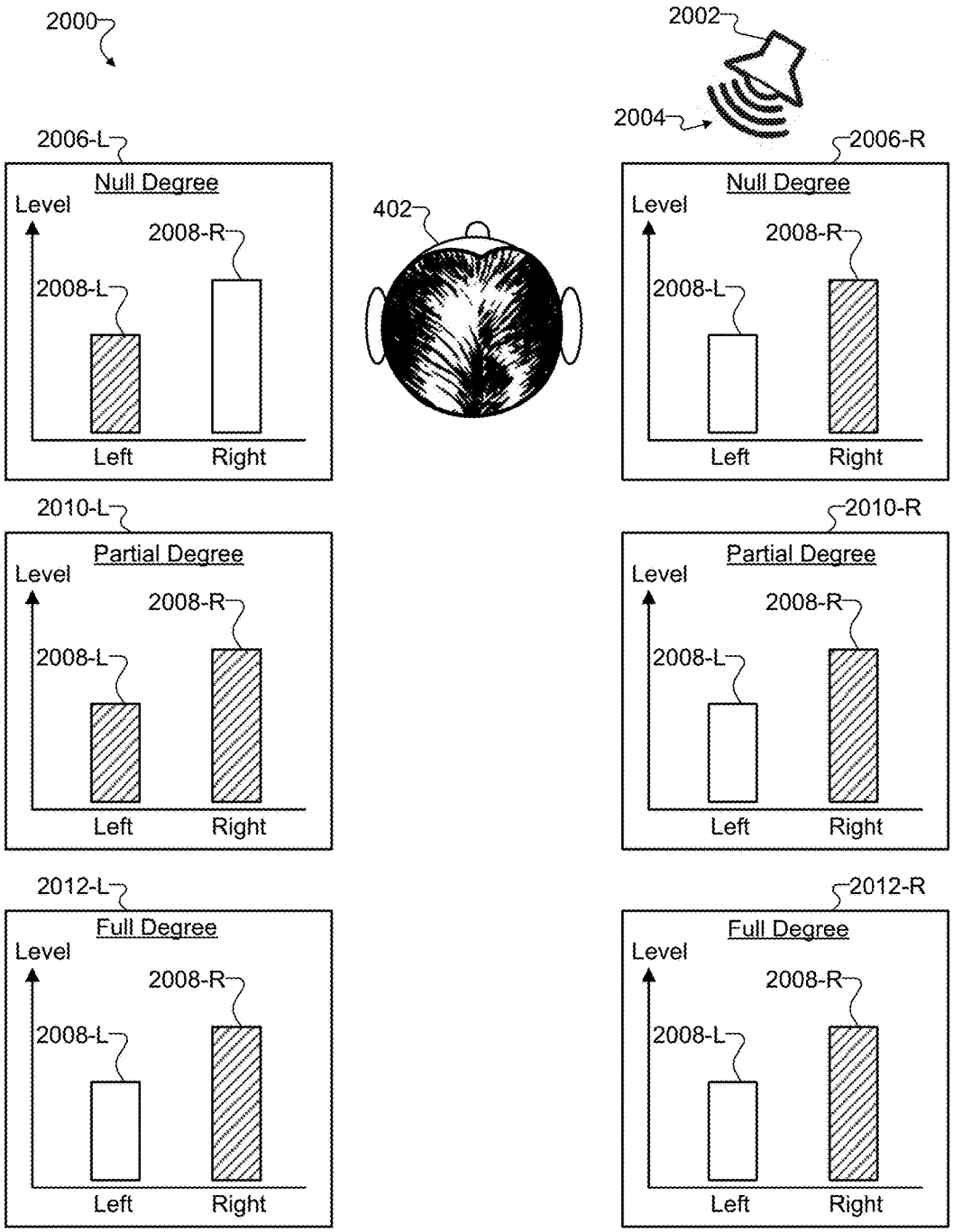
FIGS. 20-21 illustrate exemplary bases for various exemplary degrees of a contralaterally synchronized generation of gain processing parameters at each ear of a user according to principles described herein.
Figure 21:
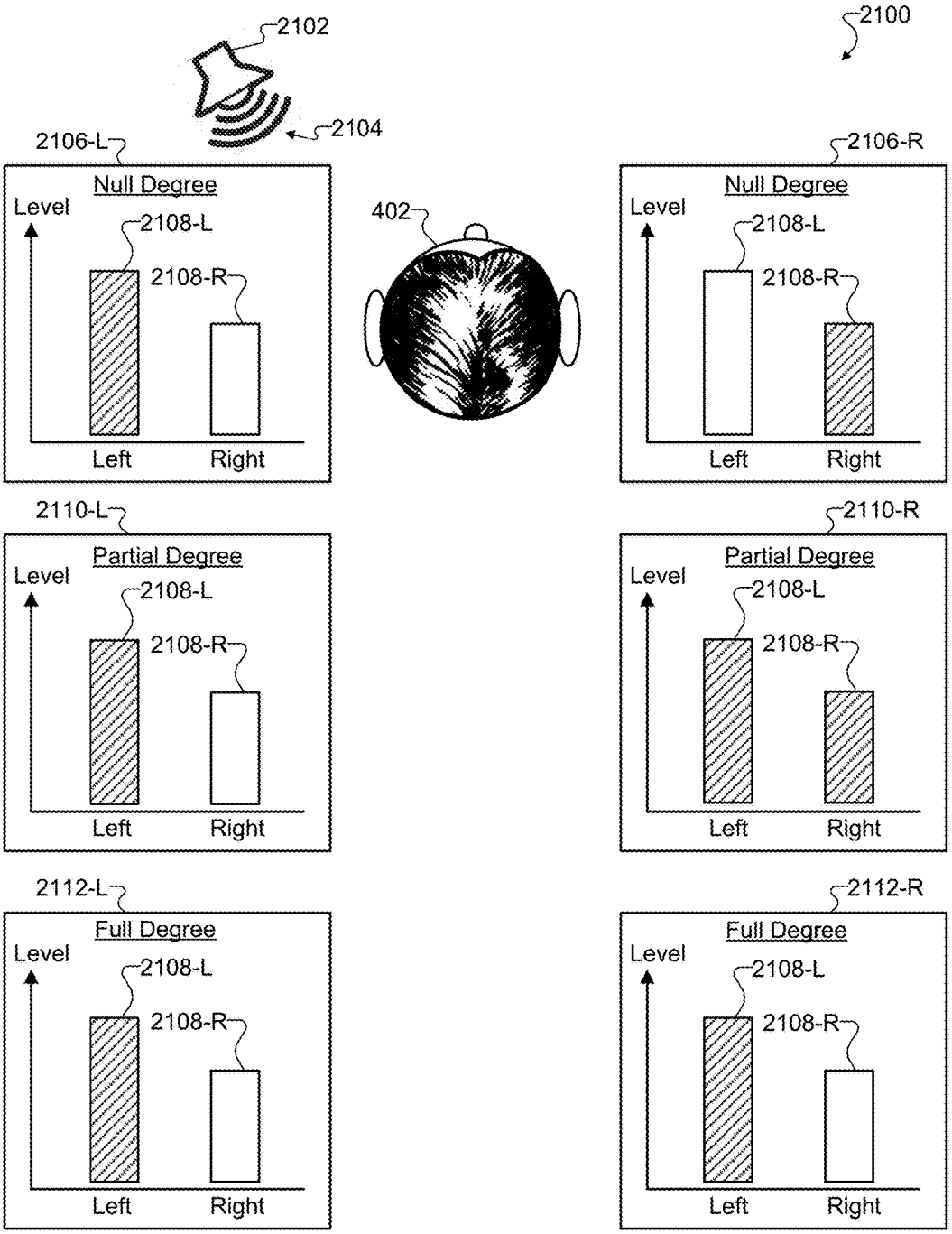

To illustrate certain potential differences between how the first sound processor may perform the contralateral gain synchronization operation and how the second sound processor may perform the contralateral gain synchronization operation, FIGS. 20-21 illustrate exemplary bases for various exemplary degrees of a contralaterally synchronized generation of gain processing parameters at each ear of a user. Specifically, FIG. 20 illustrates an example 2000, similar to examples 1800 and 1900, in which a sound source 2002 disposed at a location offset to the right of user 402 presents a sound 2004, while FIG. 21 illustrates an equivalent example 2100 in which a sound source 2102 is disposed at a location offset to the left of user 402 when presenting a sound 2104. In both examples 2000 and 2100, respective bases for determining a gain processing parameter at the sound processor associated with each of the left and right ears of user 402 are illustrated for three possible degrees of contralateral gain synchronization: a null degree, a partial degree, and a full degree.

Specifically, FIG. 20 depicts bases 2006 (e.g., basis 2006-L associated with the left ear of user 402 and basis 2006-R associated with the right ear of user 402) each including respective signals 2008 (e.g., signal 2008-L having a lesser level and signal 2008-R having a greater level) and associated with the null degree. As shown by the shaded box in basis 2006-L, if the sound processor on the left is to perform the contralateral gain synchronization operation to the null degree, the sound processor ignores contralateral signal 2008-R and uses ipsilateral signal 2008-L as a basis for determining the gain processing parameter. As shown by the shaded box in basis 2006-R, the sound processor on the right may similarly ignore contralateral signal 2008-L when performing the contralateral gain synchronization operation to the null degree (although, coincidentally, the contralateral signal 2008-L is lesser than ipsilateral signal 2008-R in this case anyway), and may use signal 2008-R as the sole basis for determining the gain processing parameter. It is noted that behavior is equivalent to the operation of the sound processors in example 1800 described above.

FIG. 20 further depicts bases 2010 (e.g., basis 2010-L associated with the left ear of user 402 and basis 2010-R associated with the right ear of user 402) each including respective signals 2008 and associated with the partial degree. As shown by the shaded boxes in basis 2010-L, if the sound processor on the left is to perform the contralateral gain synchronization operation to the partial degree, the sound processor does not use either signal 2008 as a sole basis for determining the gain processing parameter, but, rather, uses a particular combination of both signals 2008. For example, depending on the degree of partiality (e.g., between 0% and 100%) the sound processor may weight signals 2008-L and 2008-R to use a basis heavily weighting signal 2008-L (e.g., if the degree of partiality is near 0%), heavily weighting signal 2008-R (e.g., if the degree of partiality is near 100%), weighting both signals 2008 approximately equally (e.g., if the degree of partiality is near 50%), or the like. As shown by the shaded box in basis 2006-R, however, even though the sound processor on the right might be configured to also take contralateral signal 2008-L into account when performing the contralateral gain synchronization operation to the partial degree, because ipsilateral signal 2008-R is greater than contralateral signal 2008-L, this sound processor again uses signal 2008-R as the sole basis for determining the gain processing parameter.

FIG. 20 further depicts bases 2012 (e.g., basis 2012-L associated with the left ear of user 402 and basis 2012-R associated with the right ear of user 402) each including respective signals 2008 and associated with the full degree. As shown by the shaded box in both bases 2012, if the sound processor is to perform the contralateral gain synchronization operation to the full degree, the sound processor is configured to use, as a sole basis for determining the gain processing parameter, whichever of the ipsilateral and the contralateral signal has a greater level. Accordingly, both the left-side and right-side sound processors determine the gain processing parameter based solely on signal 2008-R. It is noted that this behavior is equivalent to the operation of the sound processors in example 1900 described above.

Switching the sound source to the left of user 402 (contrast the relative position of sound source 2002 in FIG. 20 with that of sound source 2102 in FIG. 21), FIG. 21 depicts bases 2106 (i.e., basis 2106-L associated with the left ear of user 402 and basis 2106-R associated with the right ear of user 402) each including respective signals 2108 (i.e., signal 2108-L having a greater level and signal 2108-R having a lesser level) and associated with the null degree. As shown by the shaded box in basis 2106-L, if the sound processor on the left is to perform the contralateral gain synchronization operation to the null degree, the sound processor ignores contralateral signal 2108-R and uses ipsilateral signal 2108-L as a basis for determining the gain processing parameter. In this case, it may thus be only coincidental that signal 2108-L (i.e., the signal used as the sole basis by the left-side sound processor) happens to have the greater level of the two signals 2108. As shown by the shaded box in basis 2106-R, the sound processor on the right might similarly ignore contralateral signal 2108-L when performing the contralateral gain synchronization operation to the null degree. Thus, even though ipsilateral signal 2108-R is lesser than contralateral signal 2108-L, this sound processor uses signal 2108-R as the sole basis for determining the gain processing parameter. It is noted that behavior is equivalent to the operation of the sound processors in example 1800 described above.

FIG. 21 further depicts bases 2110 (i.e., basis 2110-L associated with the left ear of user 402 and basis 2110-R associated with the right ear of user 402) each including respective signals 2108 and associated with the partial degree. As shown by the shaded box in basis 2110-L, even though the sound processor on the left might be configured to take contralateral signal 2108-R into account when performing the contralateral gain synchronization operation to the partial degree, because ipsilateral signal 2108-L is greater than contralateral signal 2108-R in example 2100, this sound processor uses signal 2108-L as the sole basis for determining the gain processing parameter. However, as shown by the shaded box in basis 2106-R, if the sound processor on the right is to perform the contralateral gain synchronization operation to the partial degree, the sound processor does not use either signal 2108 as a sole basis for determining the gain processing parameter, but, rather, uses a particular combination of both signals 2108. For example, depending on the degree of partiality, the sound processor may weight signals 2108-L and 2108-R in a similar manner as described above for signals 2008-L and 2008-R or in any other manner as may serve a particular implementation.

FIG. 21 further depicts bases 2112 (i.e., basis 2112-L associated with the left ear of user 402 and basis 2112-R associated with the right ear of user 402) each including respective signals 2108 and associated with the full degree. As shown by the shaded box in both bases 2112, if the sound processor is to perform the contralateral gain synchronization operation to the full degree, the sound processor is configured to use, as a sole basis for determining the gain processing parameter, whichever of the ipsilateral and the contralateral signal has a greater level. Accordingly, both the left-side and right-side sound processors determine the gain processing parameter based solely on signal 2108-L. It is noted that this behavior is equivalent to the operation of the sound processors in example 1900 described above.

The left and right sound processors referred to above in relation to examples 2000 and 2100 may each perform the contralateral gain synchronization operation to any degree as may serve a particular implementation. For example, in certain implementations, each sound processor may perform the contralateral gain synchronization operation to the same degree (e.g., to the full degree as described in certain implementations of system 100 above). In other implementations, however, each sound processor may perform the contralateral gain synchronization operation to a distinct (i.e., differing) degree. For example, the degree to which one sound processor may perform the contralateral gain synchronization operation may be distinct from the degree to which the other sound processor performs the contralateral gain synchronization operation because the first degree is a full degree and the second degree is a null degree, the first degree is a full degree and the second degree is a partial degree, the first degree is a partial degree and the second degree is a null degree, or the first degree is a first partial degree and the second degree is a second partial degree different from the first partial degree.

As has been mentioned, it may be desirable for a binaural hearing system such as system 100 to provide the versatility of being able to preserve an ILD to a distinct degree for each ear of a user for various different reasons. Two particular reasons for this will now be described in relation to FIG. 22 and FIG. 23, respectively.

As one reason that such versatility may be desirable, the hearing of certain binaural hearing system users may be asymmetrical. Whether such users are using system 100 as implemented by a cochlear implant system, a hearing aid system, an earphone system, or another type of binaural hearing system, these users ("asymmetric hearing users") may perceive sound more effectively at one side (e.g., a "strong" side or "strong" ear) than at the other side (e.g., a "weak" side or "weak" ear).

As such, a binaural hearing system being used by an asymmetric hearing user may be configured to, as part of a performance of a contralateral gain synchronization operation, access data representative of a hearing profile of the user, and determine (e.g., based on the data representative of the hearing profile of the user) the first degree to which the contralateral gain synchronization operation is to be performed at the first sound processor and the second degree to which the contralateral gain synchronization operation is to be performed at the second sound processor. For example, by accessing data (e.g., by downloading predetermined data, running tests to directly determine the data, etc.), system 100 may determine that a user is an asymmetric hearing user who may benefit from preserving an ILD to a distinct degree for each ear, rather than preserving the ILD in the same way (e.g., to the full degree) for each ear.

To determine how to distinctly set each degree to which the contralateral gain synchronization operation is to be performed at each ear, users themselves or caretakers (e.g., clinicians, parents, etc.) associated with the users may prioritize one hearing aspect over another.

For instance, in one example, asymmetric hearing users and/or their caretakers may identify speech recognition and maximizing the full dynamic range of a binaural hearing system as a priority over preserving ILD and facilitating sound localization, while still recognizing preserving ILD as an important aspect of hearing. In this example, it may be undesirable to perform the contralateral gain synchronization operation to the full degree on the strong side because the user may have very little or no ability to hear on the weak side, thus necessitating a strong reliance by the user on the strong side. By fully implementing contralateral gain synchronization on the strong side, the system would potentially attenuate or compress sounds on the strong side (e.g., when the sound levels are greater on the weak side), thereby ultimately limiting the loudness of the output signal presented to the user on the strong side in certain situations. Due to the user's heavy reliance on the strong side, it may be undesirable for the strong side to ever be compressed or (or at least to be compressed to the full degree) for the sake of preserving ILD, and system 100 may thus be set up to function accordingly (e.g., by assigning a null degree or a relatively small partial degree to the strong side sound processor). At the same time, because the user may not heavily rely on the weak side (but may still retain some ability to hear on the weak side), it may be helpful and appropriate to more fully perform the contralateral gain synchronization on the weak side (e.g., by assigning a relatively large partial degree or a full degree to the weak side sound processor). In this way, a balance may be struck that allows the user to hear optimally with the strong ear while still having some ability to localize sound using the weak ear.

In another example, asymmetric hearing users and/or their caretakers may identify preserving ILD and facilitating sound localization as a priority over maximizing the full dynamic range of a binaural hearing system. In this example, it may be desirable to perform the contralateral gain synchronization operation to a relatively full degree (e.g., a relatively high partial degree or the full degree) because the weak side may not be sensitive enough to perceive the ILD. Additionally, it may be undesirable to perform a relatively full contralateral gain synchronization with respect to the weak side because doing so may artificially limit the dynamic range, thus ultimately reducing the perceived loudness level presented to the user at that ear and rendering an already weak ear even weaker. Accordingly, it may be desirable to assign the weak side sound processor a relatively low partial degree or null degree to ensure that the weak side always maximizes the dynamic range, even while the strong side is configured to better preserve the ILD and facilitate sound localization.

System 100 may access data representative of a hearing profile of a user (e.g., an asymmetrical hearing user) in any manner as may serve a particular implementation. For example, the data representative of the hearing profile of the user may be predetermined and stored in a storage facility associated with system 100 (e.g., within storage facility 106). As such, system 100 may be configured to access the data representative of the hearing profile by retrieving the data representative of the hearing profile from the storage facility. Additionally, in the same or other examples, system 100 may be configured to access the data representative of the hearing profile by automatically performing a hearing test with respect to the user to thereby directly determine the data representative of the hearing profile of the user.

To illustrate, FIG. 22 shows an exemplary hearing profile 2202 for an exemplary user ("User 1"). Hearing profile 2202 may include various types of data and may be generated, determined, represented, stored, and accessed in any manner as may serve a particular implementation. Certain data included within hearing profile 2202 may be predetermined (e.g., by a person such as the user, a clinician or other medical practitioner associated with the user, etc.) and stored and retrieved from a storage facility. Additionally or alternatively, certain data included within hearing profile 2202 may be detected or determined directly (e.g., in real time) from the user by way of hearing tests performed by system 100 with respect to the user. In some examples, hearing profile 2202 may include a combination of predetermined data accessed by retrieving it from a storage facility and detected data accessed by performing hearing tests to directly determine the data. While the data included in hearing profile 2202 is associated with a particular user referred to as "User 1," it will be understood that a library of user profiles for multiple different users may be accessible to system 100 (e.g., stored in a storage facility associated with system 100, associated with a cochlear implant clinic, etc.) and may be retrieved for any user as may be appropriate.

As shown, the data included in hearing profile 2202 may include any suitable data. For example, hearing profile 2202 may include data 2204, which may represent information associated with a hearing ideology of the user, demographic information associated with the user, and so forth. As shown, for instance, if Patient 1 suffers from hearing loss (e.g., Patient 1 is a cochlear implant system patient or a hearing aid system patient), data 2204 may include information reported by the patient and entered into hearing profile 2202 by a clinician. The information may relate to the circumstances surrounding the hearing loss (e.g., whether the user was prelingual or postlingual at a time the hearing loss occurred, an age of the user was when hearing loss occurred, etc.), include details related to the user's use of system 100 to help overcome the hearing loss (e.g., an age of the user when a first hearing device was used, an age of the user when a first cochlear implant was implanted, an age of the user when a second cochlear implant was implanted, etc.), and so forth. In other examples, data 2204 may include other types of hearing ideology and/or demographic information as may serve a particular implementation.

As illustrated by data 2206, hearing profile 2202 may further include data representing test results determined by hearing tests administered professionally (e.g., by a clinician) in a clinical setting and/or administered directly (e.g., in any suitable setting including outside of the clinic) by system 100. Test results represented within data 2206 may include, for example, aided hearing thresholds determined by way of typical cochlear implant system or hearing aid system fitting procedures (e.g., M-level thresholds representative of a most comfortable level ("MCL"), T-level thresholds associated with a loudness threshold at which sounds become uncomfortably loud to the user, etc.). Test results represented within data 2206 may further include various scores obtained by the user with respect to different speech tests such as a speech score for hearing by each ear alone or by both ears together. These test results may further include results from tests associated with the localization ability of the user, including subjective or behavioral results of psychoacoustic tests for binaural cues (e.g., tests designed to determine a cochlear implant system user's ITD/ILD sensitivity with respect to pairs of electrodes each associated with the same frequency range implanted within the cochleae of the user). For instance, stimulation representative of a sound originating directly in front of the user (i.e., so as to have a negligible amount of ILD and/or ITD) may be provided (e.g., for each frequency associated with each electrode pair in certain examples), and indications of a direction from whence the user perceives the stimulation to be originating may be recorded as the behavioral test results.

Additionally, as illustrated by data 2208, hearing profile 2202 may further include data representing objective measurements performed clinically and/or by system 100 as may serve a particular implementation. For example, an objective version of the psychoacoustic tests for binaural cues described above may rely on objective measurements of evoked responses (e.g., evoked brain activity in different lobes of the midbrain, etc.) in addition to or instead of the subjective indications provided by the user. Similarly, other physiological measurements associated with evoked responses to electrical and/or acoustic stimulation (e.g., peripheral potentials such as electrical auditory brainstem responses ("EABRs"), central potentials, electrocochleographic ("ECoG") potentials associated with residual hearing, etc.) may be objectively measured using electrodes implanted within the user (e.g., associated with a cochlear implant lead), electrodes external to the user (e.g., electrodes deposited on the user's head to detect brainwaves), or the like. Another exemplary objective measurement represented within data 2208 of hearing profile 2202 if User 1 is a cochlear implant patient may be associated with imaging (e.g., CT scan imaging, MRI imaging, etc.) indicative of cochlear implant electrode placement within the user. For example, if electrodes associated with certain frequency ranges are determined to be lined up in different relative positions in each cochlea of the user due to different electrode placement in each cochlea (e.g., electrode insertion to different depths), it may be determined that the user is likely to have asymmetric hearing as a result of the electrode placement.

As described above, any of the data included in hearing profile 2202 (e.g., data included within data 2204, 2206, 2208, or any other suitable data included in hearing profile 2202 and not explicitly illustrated in FIG. 22) may be taken into account by system 100 to determine the relative degree to which a contralateral gain synchronization operation is to be performed at each side of the user. For example, the data included within hearing profile 2202 may indicate that User 1 is an asymmetric hearing user with a strong side and a weak side that each call for different hearing strategies and/or priorities with respect to contralateral gain synchronization operations and/or other binaural hearing system configurations or operations. Accordingly, as described above, the degree to which each sound processor in the binaural hearing system is to perform the contralateral gain synchronization operation may be determined at least partially based on the data included within hearing profile 2202.

In addition to using data in hearing profile 2202 to determine the first and second degrees to which the contralateral gain synchronization operation is to be performed at the first and second sound processors of the binaural hearing system, the data in hearing profile 2202 may further be employed for other purposes. For example, test results and/or objective measurements associated with localization ability and/or psychoacoustic tests for binaural cues may indicate that the user has a localization bias. For example, it may be determined that the user perceives sounds that originate directly in front of the user, which normally should not be perceived to have any significant degree of ILD or ITD, to be offset from the center by a certain amount. As such, system 100 may use this data to correct the localization bias by artificially fixing the ILD between the first and second signals so that sounds that, for example, actually originate directly in front of the user will be perceived to originate in front of the user in spite of the user's bias. In certain cochlear implant system examples, this type of correction may be performed on an electrode by electrode basis. For instance, individual correction curves associated with each electrode or electrode pair may be included within hearing profile 2202 and used to correct localization bias for each specific frequency range associated with each electrode or electrode pair.

Another exemplary reason that the versatility of being able to preserve an ILD to a distinct degree for each ear of a user may be desirable relates to environmental factors associated with the dynamic listening scenario surrounding the user at any particular time. To this end, system 100 may be configured to, as part of the performance of the contralateral gain synchronization operation, access data representative of a dynamic listening scenario in which the binaural hearing system is being used, and determine (e.g., based on the data representative of the dynamic listening scenario) the first degree to which the contralateral gain synchronization operation is to be performed at the first sound processor and the second degree to which the contralateral gain synchronization operation is to be performed at the second sound processor.

The first and second degrees may be determined based on any suitable data associated with the dynamic listening scenario. For example, the data representative of the dynamic listening scenario may indicate a first signal-to-noise ratio of the first signal and a second signal-to-noise ratio of the second signal, and the binaural pair of sound processors may be configured to determine the first degree and the second degree based on the first and second signal-to-noise ratios (e.g., in various ways that will be described below or in other suitable ways). As another example, the data representative of the dynamic listening scenario may indicate a magnitude of the ILD between the first and second signals, and the binaural pair of sound processors may be configured to determine the first degree and the second degree based on the magnitude of the ILD between the first and second signals (e.g., also in various ways that will be described below or in other suitable ways).

Figure 23:
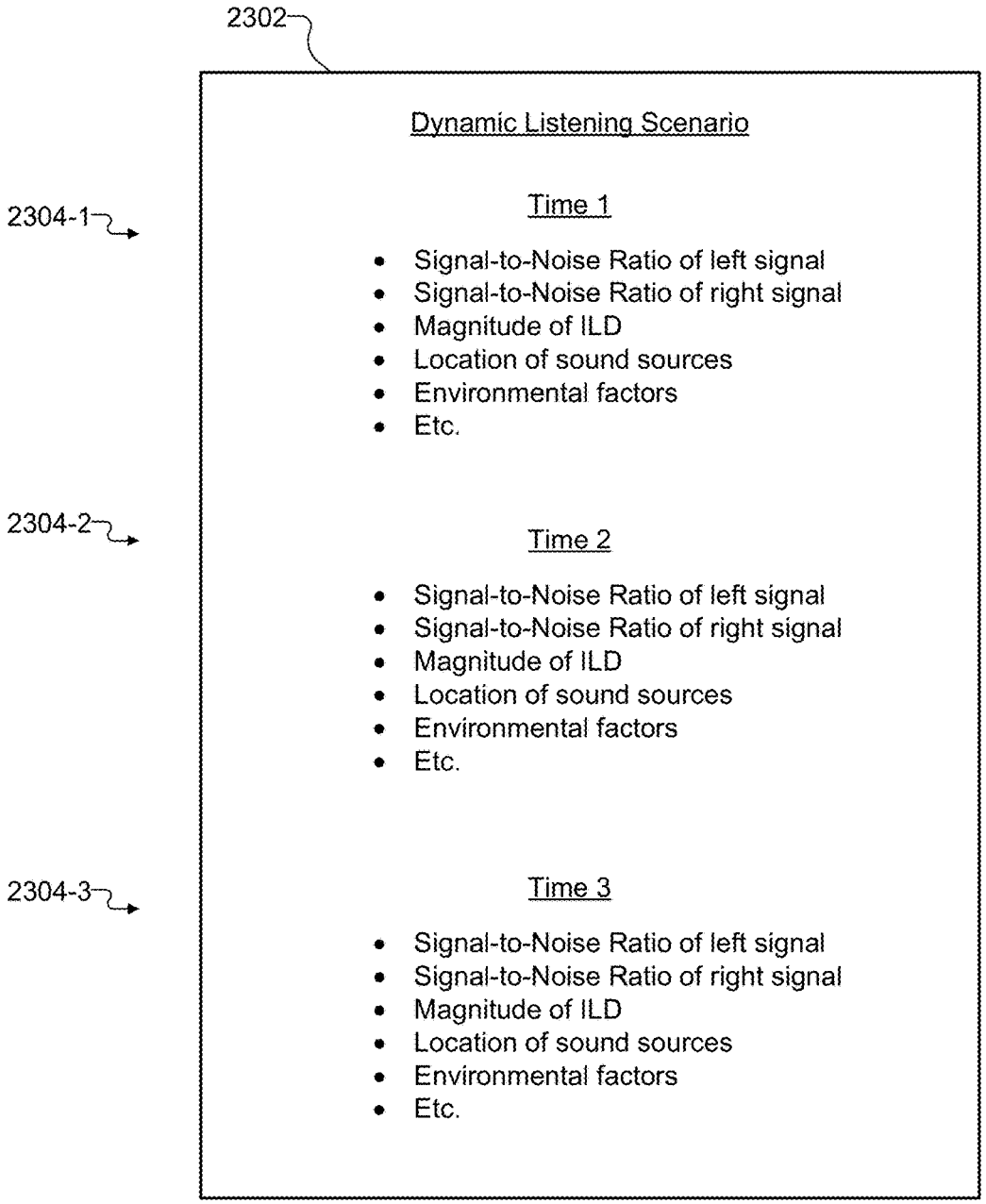
FIG. 23 illustrates an exemplary dynamic listening scenario according to principles described herein.

To illustrate, FIG. 23 shows an exemplary dynamic listening scenario 2302 representing listening scenario data for a plurality of times 2304 (e.g., time 2304-1 labeled "Time 1," time 2304-2 labeled "Time 2," time 2304-3 labeled "Time 3," etc.). The listening scenario surrounding the user may be dynamic (i.e., constantly changing). As such, dynamic listening scenario 2302 depicts data such as the signal-to-noise ratio of each signal, the magnitude of the ILD, the location of sound sources, other environmental factors, and so forth, at different points in time (e.g., times 2304-1 through 2304-3) to indicate that this data is not static but dynamically changing. It will be understood, however, that data representative of dynamic listening scenario 2302 may be detected, generated, stored, and/or accessed in any manner as may serve a particular implementation. For example, data associated with any particular time 2304 may be detected and used in real time and not stored or retrieved in certain examples.

Based on the data illustrated in dynamic listening scenario 2302 and/or any other suitable dynamic listening scenario data not explicitly shown, system 100 may determine the first and second distinct degrees to which the contralateral gain synchronization operation is to be performed at each of the first and second sound processors in any manner as may serve a particular implementation. For instance, if a signal-to-noise ratio of the first signal (e.g., the left-side signal) is positive (i.e., the ratio is greater than zero, indicating that there is more information included on the signal than interference), the first degree may be determined to be the full degree. Conversely, if the signal-to-noise ratio is negative (i.e., the ratio is less than zero, indicating that there is more interference on the signal than information) the first degree may be determined to be the null degree. In other examples, the same principle may be applied in a more graduated or nuanced manner. Specifically, for example, when the signal-to-noise ratio is greater than a first predetermined threshold, the first degree may be determined to be the full degree, when the signal-to-noise ratio is less than a second predetermined threshold, the first degree may be determined to be the null degree, and when the signal-to-noise ratio is between the first and second thresholds, the first degree may be determined to be a particular partial degree (e.g., between 0% and 100%) based on how close the signal-to-noise ratio is to either threshold (e.g., graded in a linear fashion or in a suitable nonlinear fashion). A signal-to-noise ratio of the second signal (e.g., the right-side signal in this example) may be used in any of the same ways as the signal-to-noise ratio of the first signal to help determine the second degree to which the contralateral gain synchronization operation is to be performed at the second sound processor.

Signal-to-noise ratio data included within dynamic listening scenario 2302 may further be used in other ways or for other purposes within system 100. For instance, whichever of the first and second signals is determined to have the greater signal-to-noise ratio may automatically be used as a sole basis for determining the gain processing parameter in one or both sound processors, or a weighting, based on the respective signal-to-noise ratios, of both the first and second signals may automatically be used as the basis for determining the gain processing parameter. As another example, it may be desirable, at least temporarily, for a sound processor to present a gain-processed signal based on the contralateral signal rather than or in addition to the ipsilateral signal. If dynamic listening scenario 2302 indicates, for example, that the first signal has a low signal-to-noise ratio and that the second signal has a high signal-to-noise ratio, both the first and second sound processors may present the second signal to the user at each ear of the user, at least until the signal-to-noise ratio of the first signal improves. Alternatively, the second sound processor may present the second signal at the second ear of the user, while the first sound processor may temporarily mix or crossfade in the second signal together with the first signal to thereby present a combination of both the first and second signals at the first ear of the user (e.g., at least until the signal-to-noise ratio of the first signal improves, whereupon the second signal may be crossfaded back out or otherwise removed from the first ear). The determination of which signal to process and present to the user may be performed independently of the determination of gain processing parameters and the performance of gain processing operations in the sound processor. As such, while the same signal (e.g., the second signal in this example) may be used by both sound processors, an ILD between what each sound processor presents to the user may still be presented to the user.

Also included within the data of dynamic listening scenario 2302 is data indicative of the magnitude of the ILD between the first and second signals. The ILD magnitude may indicate erroneous, undesirable conditions of the audio detectors, such as that one audio detector is being touched, is damaged, or the like. When an audio detector such as a microphone is directly touched (e.g., by the user's finger or the like), a large amount of noise may be detected by the audio detector that is not actually representative of sound in the environment. Such a situation may be indicated by an ILD having a larger than normal magnitude. Accordingly, very large ILD magnitudes (e.g., values that are determined to be caused by a condition such as a microphone being touched) may cause system 100 to at least temporarily disable the contralateral gain synchronization (e.g., by setting the first and/or second degrees to be null degrees) until the ILD magnitude returns to a normal value. Additionally, a signal generated by the audio detector that is not being touched may be processed for presentation to the user at both ears (e.g., in place of the noise caused by the touching of the microphone) by both sound processors in a manner similar to the manner described above.

In addition to the types of data illustrated in dynamic listening scenario 2302, system 100 may further determine the first and/or second degrees to which the contralateral gain synchronization operation is to be performed at the first and/or second sound processors by other indicators of listening scenario that may be available to system 100. For instance, certain sound processors may include classifier circuitry configured to constantly analyze and classify the listening scenario into categories indicating, for example, that the user is hearing speech, speech in noise, speech against a large amount of noise, and so forth. The output of the classifier may conventionally be used to help determine a sound processing program for the sound processor to use. However, the output of the classifier may additionally be used in certain examples to help determine the first and/or second degrees. Additionally or alternatively, the first and/or second degrees may be set as part of sound processing programs used by the respective sound processors or may be otherwise tied to the selection of sound processing programs used by sound processors.

Examples of data that may be analyzed and used by system 100 to determine different respective degrees to which a contralateral gain synchronization operation may be performed have been described above. However, it will be understood that in certain examples, system 100 may not be configured or called upon to determine the different degrees automatically in these ways. Rather, system 100 may implement first and second degrees that are set manually by the user, by a clinician or other caretaker associated with the user, or the like. For example, the binaural pair of sound processors within system 100 may, as part of the performance of the contralateral gain synchronization operation, be configured to receive user input representative of the first degree to which the contralateral gain synchronization operation is to be performed at the first sound processor and the second degree to which the contralateral gain synchronization operation is to be performed at the second sound processor, and may determine the first degree and the second degree based on the user input. This user input may be provided and detected an any suitable way. For instance, the user input may be provided by way of a user interface implementing a slider input capable of representing a continuum from a null degree to a full degree for each of the first and second degrees.

Figure 24:
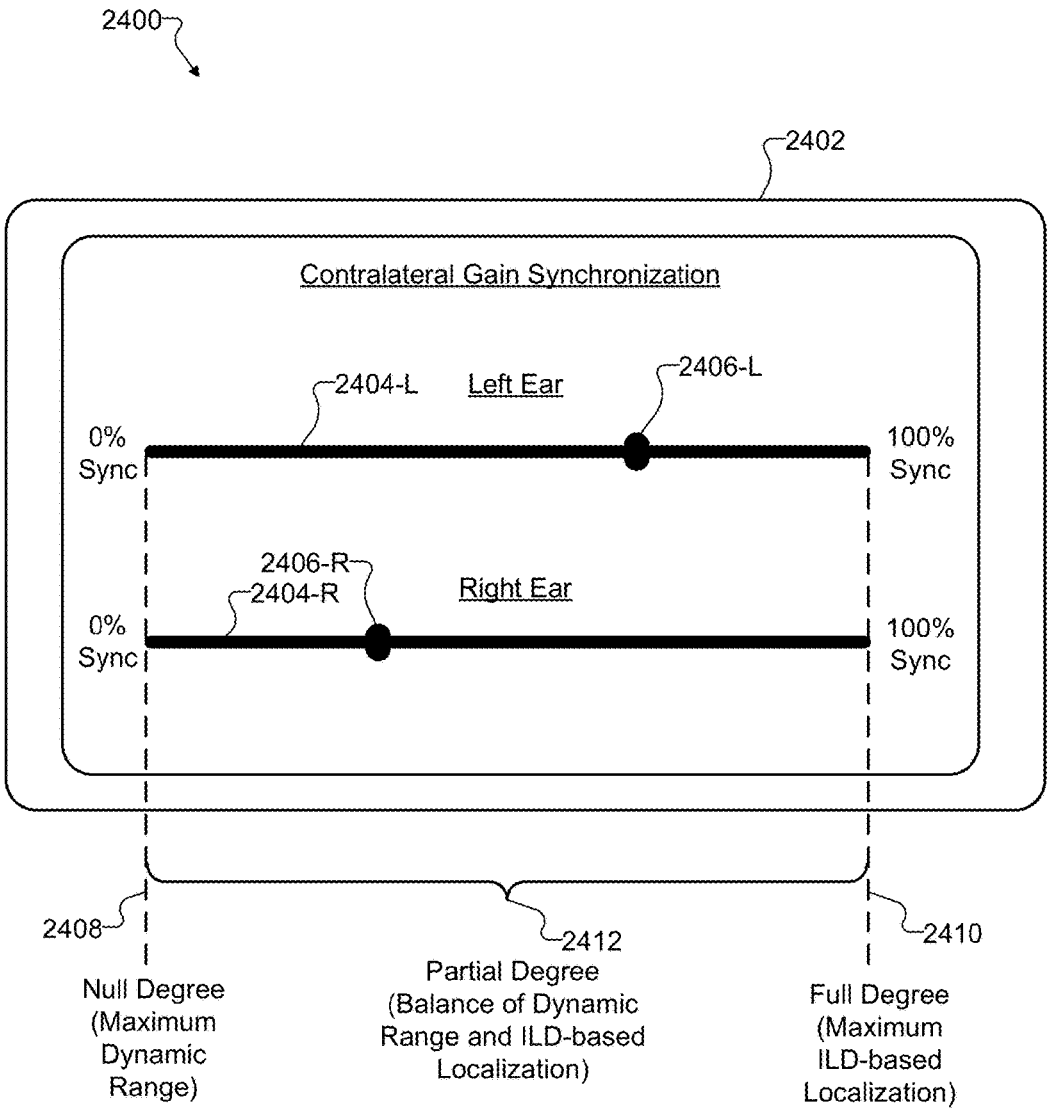
FIG. 24 illustrates an exemplary user interface enabling direct manual control of respective contralateral gain synchronization operations performed at a left and a right sound processor in a binaural hearing system according to principles described herein.

To illustrate, FIG. 24 shows an exemplary user interface 2400 enabling direct manual control of respective contralateral gain synchronization operations performed at a left and a right sound processor in a binaural hearing system such as system 100. As shown, user interface 2400 may be displayed on a device 2402, which may be implemented by a mobile device used by the user, a cochlear implant fitting device (e.g., a clinician's programming interface ("CPI") device) used by a clinician, or any other suitable device as may serve a particular implementation. While device 2402 is illustrated as being a device implementing a software-based user interface 2400, it will be understood that, in certain examples, device 2402 may be another type of device implementing other types of slider inputs (e.g., physical sliders, knobs, buttons, etc.).

As shown, user interface 2400 includes respective slider inputs 2404 for both the left ear and the right ear of the user (i.e., slider input 2404-L for the left ear and slider input 2404-R for the right ear). Each slider input 2404 includes a selector 2406 (e.g., selector 2406-L associated with slider input 2404-L and selector 2406-R associated with slider input 2404-R) used to set the degree for the respective ear to any value from a 0% value 2408 (i.e., a null degree associated with maximum dynamic range) to a 100% value 2410 (i.e., a full degree associated with maximum ILD-based localization), or to any intermediate value 2412 (i.e., any partial degree that balances the dynamic range and the ILD-based localization in any suitable way).

Selectors 2406 may both be set to the same value on their respective slider inputs 2404, or, as shown, may be set to different values. Any combination of values described herein may be assigned to the sound processors in this way. For example, one selector may be set to 0% value 2408 while the other is set to 100% value 2410, one selector may be set to 0% value 2408 while the other is set to a partial value 2412, one selector may be set to a partial value 2412 while the other is set to 100% value 2410, or both selectors may be set to different partial values 2412 (as illustrated in the exemplary settings depicted in FIG. 24).

Details have now been described for various aspects of binaural hearing systems that preserve an ILD to a distinct degree for each ear of a user. While these aspects have been described somewhat in isolation from other principles described herein, however, it will be understood that the same principles described for other implementations of system 100 described herein may apply to these implementations of system 100 that preserve the ILD to a distinct degree for each ear of the user.

Specifically, for example, the first and second sound processors in a binaural hearing system for preserving an ILD to a distinct degree for each ear of a user may be configured to preserve the ILD between the first and second signals by performing (e.g., subsequent to performing the contralateral gain synchronization operation) any of the same types of operations described above for other binaural hearing systems described herein. For example, subsequent to performing the contralateral gain synchronization operation, the first sound processor may present the first output signal to the user at the first ear. Similarly, subsequent to its own performance of the contralateral gain synchronization operation, the second sound processor may present the second output signal to the user at the second ear.

Binaural hearing systems for preserving an ILD to a distinct degree for each ear of a user may be implemented as any type of binaural hearing systems described herein, including cochlear implant systems, hearing aid systems, earphone systems, and so forth. In examples in which the binaural hearing system is implemented within a cochlear implant system, for instance, the binaural pair of sound processors may be included within the cochlear implant system and may be communicatively coupled with a binaural pair of cochlear implants implanted within the user. For example, the binaural pair of cochlear implants may include a first cochlear implant communicatively coupled with the first sound processor and a second cochlear implant communicatively coupled with the second sound processor. As such, the first sound processor may be configured to present the first output signal to the user at the first ear of the user by directing the first cochlear implant to apply electrical stimulation (e.g., based on the first output signal) to one or more locations within a first cochlea of the user. Similarly, the second sound processor may be configured to present the second output signal to the user at the second ear of the user by directing the second cochlear implant to apply electrical stimulation (e.g., based on the second output signal) to one or more locations within a second cochlea of the user.

Additionally, binaural hearing systems for preserving an ILD to a distinct degree for each ear of a user may generate any type of gain processing parameter to perform any type of gain processing operation as described herein or as may serve a particular implementation. For example, as part of a performance of a contralateral gain synchronization operation, a binaural pair of sound processors in such a binaural hearing system may be configured to: generate, at the first sound processor, a first AGC gain processing parameter; generate, at the second sound processor, a second AGC gain processing parameter; apply, at the first sound processor, a first AGC gain to at least one of the first and second signals, the first AGC gain defined by the first AGC gain parameter; and apply, at the second sound processor, a second AGC gain to an additional at least one of the first and second signals, the second AGC gain defined by the second AGC gain parameter.

Moreover, in the same or other examples, the binaural pair of sound processors included within the binaural hearing system may be configured, as part of the performance of the contralateral gain synchronization operation, to: generate, at the first sound processor, a first gain processing parameter; generate, at the second sound processor, a second gain processing parameter; perform, at the first sound processor based on the first gain processing parameter, a first gain processing operation on at least one of the first and second signals; and perform, at the second sound processor based on the second gain processing parameter, a second gain processing operation on an additional at least one of the first and second signals. In these examples, rather than (or in addition to) the AGC gain parameter, the first and second gain processing parameters may each be implemented as at least one of a noise cancellation gain parameter, a wind cancellation gain parameter, a reverberation cancellation gain parameter, and an impulse cancellation gain parameter.

As such, the first gain processing operation may be performed by applying, to the at least one of the first and second signals, at least one of: a noise cancellation gain defined by the first gain processing parameter if the first gain processing parameter is implemented as the noise cancellation gain parameter, a wind cancellation gain defined by the first gain processing parameter if the first gain processing parameter is implemented as the wind cancellation gain parameter, a reverberation cancellation gain defined by the first gain processing parameter if the first gain processing parameter is implemented as the reverberation cancellation gain parameter, and an impulse cancellation gain defined by the first gain processing parameter if the first gain processing parameter is implemented as impulse cancellation gain parameter. Similarly, the second gain processing operation may be performed by applying, to the additional at least one of the first and second signals, at least one of: a noise cancellation gain defined by the second gain processing parameter if the second gain processing parameter is implemented as the noise cancellation gain parameter, a wind cancellation gain defined by the second gain processing parameter if the second gain processing parameter is implemented as the wind cancellation gain parameter, a reverberation cancellation gain defined by the second gain processing parameter if the second gain processing parameter is implemented as the reverberation cancellation gain parameter, and an impulse cancellation gain defined by the second gain processing parameter if the second gain processing parameter is implemented as impulse cancellation gain parameter.

It will be understood that other aspects described in detail above may similarly be applied to binaural hearing systems for preserving an ILD to a distinct degree for each ear of a user. For example, contralateral gain synchronization operations may be performed in the frequency domain (e.g., frequency by frequency) or in the time domain in a similar manner as described above. Moreover, while the examples of binaural hearing systems for preserve the ILD to the distinct degrees described herein have focused on preserving the ILD to distinct degrees for each ear of the user, it will be understood that similar principles may apply to enhancing the ILD to a distinct degree for each ear of the user. For instance, examples described above have related to enhancing the ILD by using beamforming techniques to generate full end-fire directional polar patterns including statically-opposing, side-facing lobes at each ear (i.e., first and second lobes of the end-fire directional polar pattern that are each directed radially outward from the respective ears of the users), and such examples may illustrate how the ILD may be enhanced to a "full degree." In other examples, however, only one side-facing lobe at one ear may be used to enhance the ILD while the other ear may enhance the ILD to a "null degree" by using an omnidirectional polar pattern or otherwise unenhanced polar pattern. Similarly, by generating a static side-facing lobe that is not omnidirectional but also not as strongly directional (e.g., cardioid) as the end-fire polar patterns described herein, a sound processor may be said to enhance the ILD to a "partial degree." As such, different sound processors may each preserve and/or enhance the ILD to distinct degrees in any of the ways described herein.

Figure 25:
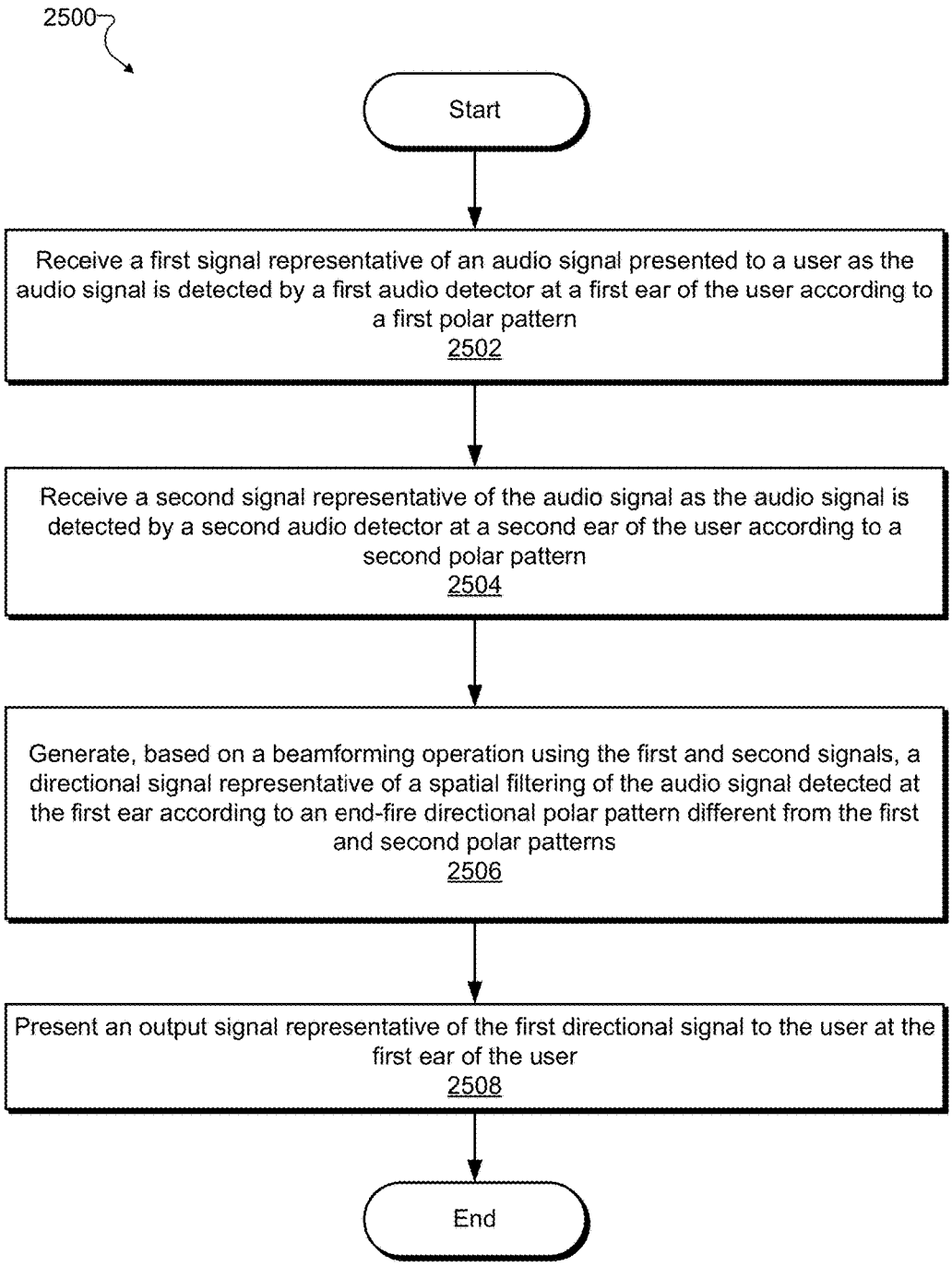
FIGS. 25-26 illustrate exemplary methods for facilitating ILD perception by users of binaural hearing systems according to principles described herein.

FIG. 25 illustrates an exemplary method 2500 for facilitating ILD perception by users of binaural hearing systems. In particular, one or more of the operations shown in FIG. 25 may be performed by system 100 and/or any implementation thereof to enhance an ILD between a first signal and a second signal generated by microphones at each ear of a user of system 100. While FIG. 25 illustrates exemplary operations according to one embodiment, other embodiments may omit, add to, reorder, and/or modify any of the operations shown in FIG. 25. In some examples, some or all of the operations shown in FIG. 25 may be performed by a sound processor (e.g., one of sound processors 406) while another sound processor performs similar operations in parallel.

In operation 2502, a first sound processor associated with a first ear of a user may receive a first signal representative of an audio signal presented to the user as the audio signal is detected by a first audio detector at the first ear according to a first polar pattern. The first sound processor may be communicatively coupled directly with the first audio detector and may receive the first signal directly from the first audio detector. Operation 2502 may be performed in any of the ways described herein.

In operation 2504, the first sound processor may receive a second signal representative of the audio signal as the audio signal is detected by a second audio detector at a second ear of the user according to a second polar pattern. Operation 2504 may be performed in any of the ways described herein. For example, the first sound processor may receive the second signal from a second sound processor associated with the second ear of the user via a communication link interconnecting the first and second sound processors.

In operation 2506, the first sound processor may generate a directional signal representative of a spatial filtering of the audio signal detected at the first ear according to an end-fire directional polar pattern. Operation 2506 may be performed in any of the ways described herein. For example, the first sound processor may generate the directional signal based on a beamforming operation using the first and second signals. Additionally, the end-fire directional polar pattern according to which the directional signal is generated may be different from the first and second polar patterns.

In operation 2508, the first sound processor may present an output signal representative of the first directional signal to the user at the first ear of the user. Operation 2508 may be performed in any of the ways described herein.

Figure 26:
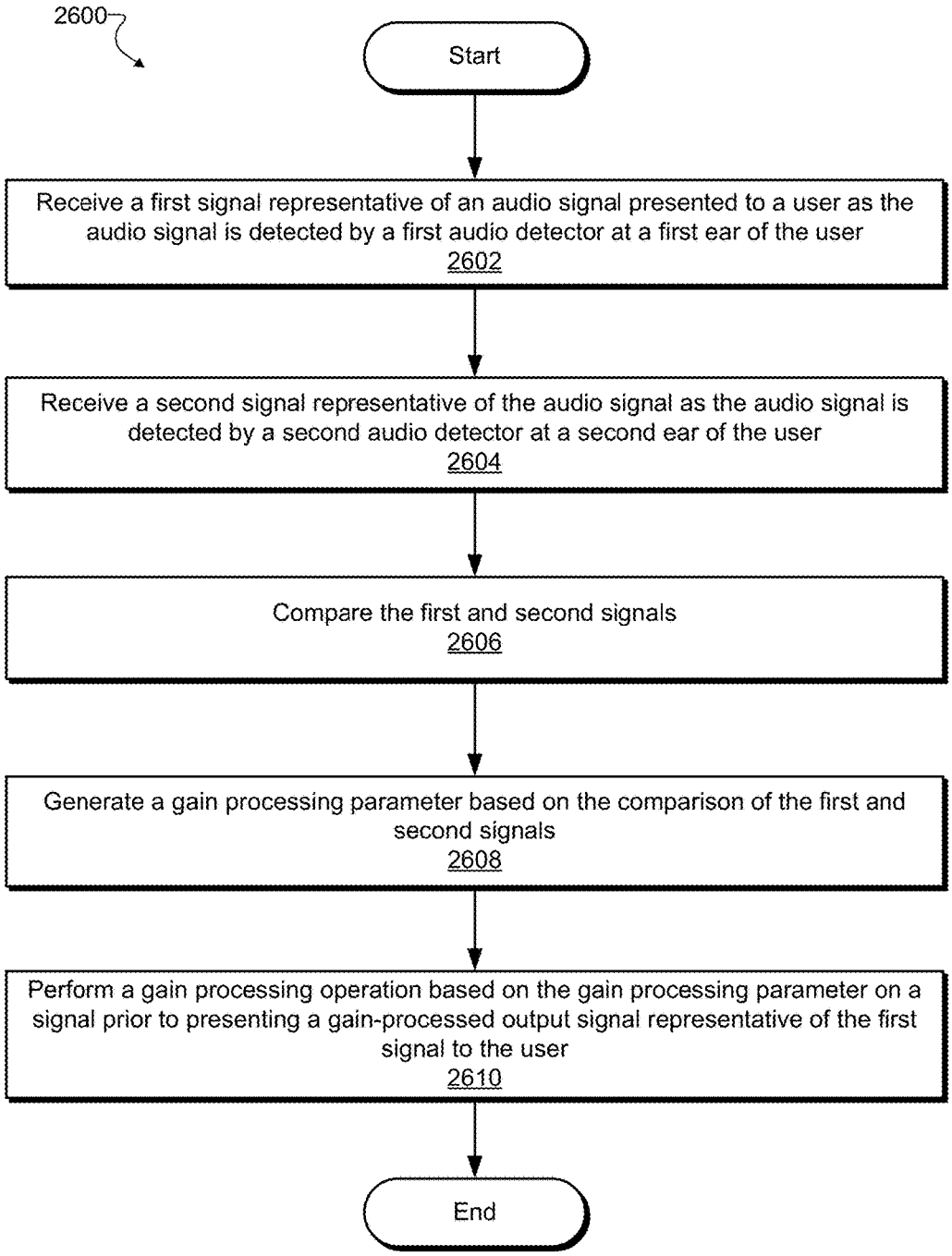

FIG. 26 illustrates an exemplary method 2600 for facilitating ILD perception by users of binaural hearing systems. In particular, one or more of the operations shown in FIG. 26 may be performed by system 100 and/or any implementation thereof to preserve an ILD between a first signal and a second signal generated by audio detectors at each ear of a user of system 100 as a gain processing operation is performed on the signals prior to presenting a gain-processed output signal to a user at a first ear of the user. While FIG. 26 illustrates exemplary operations according to one embodiment, other embodiments may omit, add to, reorder, and/or modify any of the operations shown in FIG. 26. In some examples, some or all of the operations shown in FIG. 26 may be performed by a sound processor (e.g., one of sound processors 406) while another sound processor performs similar operations in parallel.

In operation 2602, a first sound processor associated with a first ear of a user may receive a first signal representative of an audio signal presented to the user as the audio signal is detected by a first audio detector at the first ear. The first sound processor may be communicatively coupled directly with the first audio detector and may receive the first signal directly from the first audio detector. Operation 2602 may be performed in any of the ways described herein.

In operation 2604, the first sound processor may receive a second signal representative of the audio signal as the audio signal is detected by a second audio detector at a second ear of the user. Operation 2604 may be performed in any of the ways described herein. For example, the first sound processor may receive the second signal from a second sound processor associated with the second ear of the user via a communication link interconnecting the first and second sound processors.

In operation 2606, the first sound processor may compare the first and second signals. Operation 2606 may be performed in any of the ways described herein.

In operation 2608, the first sound processor may generate a gain processing parameter based on the comparison of the first and second signals in operation 2606. Operation 2608 may be performed in any of the ways described herein.

In operation 2610, the first sound processor may perform a gain processing operation on a signal prior to presenting a gain-processed output signal representative of the first signal to the user at the first of the user. Operation 2610 may be performed in any of the ways described herein. For example, the first sound processor may perform the gain processing operation based on the gain processing parameter on a signal representative of at least one of the first signal and the second signal.

Figure 27:
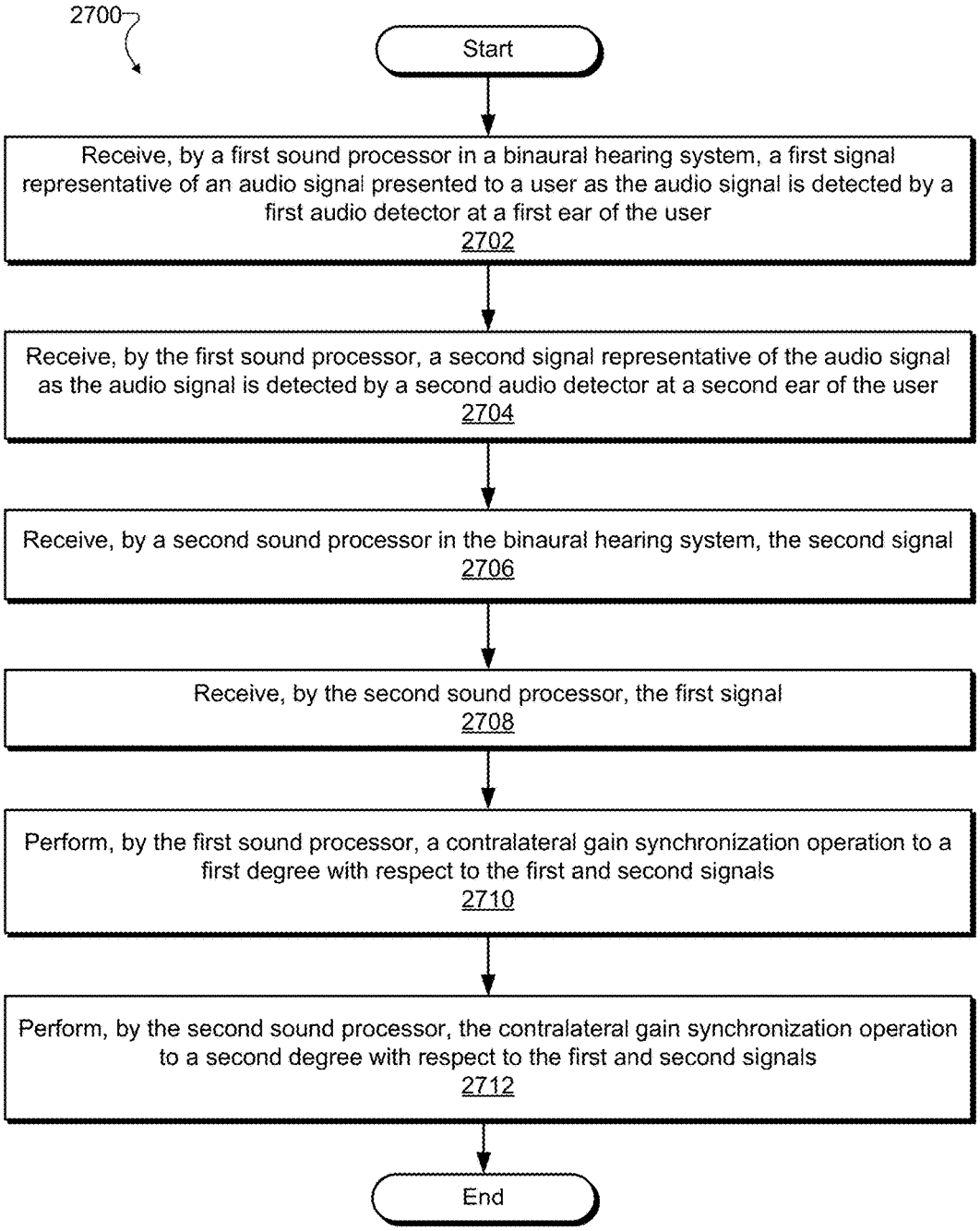
FIG. 27 illustrates an exemplary method for preserving an ILD to a distinct degree for each ear of a user according to principles described herein.

FIG. 27 illustrates an exemplary method 2700 for preserving an ILD to a distinct degree for each ear of a user. In particular, one or more of the operations shown in FIG. 27 may be performed by system 100 and/or any implementation thereof to preserve an ILD between a first signal and a second signal generated by audio detectors at each ear of a user of system 100 to different degrees (e.g., null, partial, or full degrees) at each of the ears. While FIG. 27 illustrates exemplary operations according to one embodiment, other embodiments may omit, add to, reorder, and/or modify any of the operations shown in FIG. 27. In some examples, some or all of the operations shown in FIG. 27 to be performed by a first sound processor may be performed by a left-side sound processor (e.g., sound processor 406-1) while some or all of the operations shown to be performed by a second sound processor may be performed by a right-side sound processor (e.g., sound processor 406-2). In other examples, these roles may be reversed, such that the operations performed by the first sound processor are performed by the right-side sound processor and the operations performed by the second sound processor are performed by the left-side sound processor.

In operation 2702, a first sound processor included within a binaural hearing system and associated with a first ear of a user may receive a first signal representative of an audio signal presented to the user as the audio signal is detected by a first audio detector at the first ear. The first sound processor may be communicatively coupled directly with the first audio detector and may receive the first signal directly from the first audio detector. Operation 2702 may be performed in any of the ways described herein.

In operation 2704, the first sound processor may receive a second signal from a second sound processor included within the binaural hearing system and associated with a second ear of the user. The second signal may be representative of the audio signal presented to the user as the audio signal is detected by a second audio detector at the second ear. The first sound processor may receive the second signal by way of a communication link interconnecting the first and second sound processors. Operation 2704 may be performed in any of the ways described herein.

In operation 2706, the second sound processor may receive the second signal directly from the second audio detector. For example, the second sound processor may be communicatively coupled directly with the second audio detector. Operation 2706 may be performed in any of the ways described herein.

In operation 2708, the second sound processor may receive the first signal from the first sound processor by way of the communication link. Operation 2708 may be performed in any of the ways described herein.

In operation 2710, the first sound processor may perform a contralateral gain synchronization operation to a first degree with respect to the first and second signals received in operations 2702 and 2704, respectively. Operation 2710 may be performed in any of the ways described herein.

In operation 2712, the second sound processor may perform the contralateral gain synchronization operation to a second degree with respect to the first and second signals received in operations 2706 and 2708, respectively. The second degree may be distinct from the first degree. Operation 2712 may be performed in any of the ways described herein.

In the preceding description, various exemplary embodiments have been described with reference to the accompanying drawings. It will, however, be evident that various modifications and changes may be made thereto, and additional embodiments may be implemented, without departing from the scope of the invention as set forth in the claims that follow. For example, certain features of one embodiment described herein may be combined with or substituted for features of another embodiment described herein. The description and drawings are accordingly to be regarded in an illustrative rather than a restrictive sense.

What is claimed is:

1. A binaural hearing system comprising:

a binaural pair of microphones including a first microphone and a second microphone that are configured to be located, respectively, at a first ear and a second ear of a user; and an interconnected binaural pair of sound processors including a first sound processor that is coupled directly to the first microphone and a second sound processor that is coupled directly to the second microphone, the binaural pair of sound processors configured to preserve an interaural level difference ("ILD") between a first signal generated by the first microphone at the first ear and a second signal generated by the second microphone at the second ear by performing a contralateral gain synchronization operation to a first degree with respect to the first and second signals at the first sound processor, and to a second degree with respect to the first and second signals at the second sound processor;

wherein the first degree is distinct from the second degree or at least one of the first and second degrees is a partial degree.

2. The binaural hearing system of claim 1, wherein the first and second degrees are each partial degrees and the first partial degree is equal to the second partial degree.

3. The binaural hearing system of claim 1, wherein the first degree is distinct from the second degree and the first and second degrees include one of:

a full degree and a null degree, a full degree and a partial degree, a partial degree and a null degree, and a first partial degree and a second partial degree that is distinct from the first partial degree.

4. The binaural hearing system of claim 1, wherein, as part of the performance of the contralateral gain synchronization operation, the binaural pair of sound processors is configured to:

access data representative of a hearing profile of the user; and determine, based on the data representative of the hearing profile of the user, the first degree to which the contralateral gain synchronization operation is to be performed at the first sound processor and the second degree to which the contralateral gain synchronization operation is to be performed at the second sound processor.

5. The binaural hearing system of claim 1, wherein, as part of the performance of the contralateral gain synchronization operation, the binaural pair of sound processors is configured to:

receive user input representative of the first degree to which the contralateral gain synchronization operation is to be performed at the first sound processor and the second degree to which the contralateral gain synchronization operation is to be performed at the second sound processor; and determine the first degree and the second degree based on the user input.

6. The binaural hearing system of claim 5, wherein the user input is provided by way of a user interface implementing a pair of slider inputs for setting the first and second degrees, each slider input in the pair of slider inputs capable of representing a continuum from a null degree to a full degree.

7. The binaural hearing system of claim 1, wherein, as part of the performance of the contralateral gain synchronization operation, the binaural pair of sound processors is configured to:

access data representative of a dynamic listening scenario in which the binaural hearing system is being used; and determine, based on the data representative of the dynamic listening scenario, the first degree to which the contralateral gain synchronization operation is to be performed at the first sound processor and the second degree to which the contralateral gain synchronization operation is to be performed at the second sound processor.

8. The binaural hearing system of claim 7, wherein:

the data representative of the dynamic listening scenario indicates a first signal-to-noise ratio of the first signal and a second signal-to-noise ratio of the second signal; and the binaural pair of sound processors is configured to determine the first degree to which the contralateral gain synchronization operation is to be performed at the first sound processor and the second degree to which the contralateral gain synchronization operation is to be performed at the second sound processor based on the first and second signal-to-noise ratios.

9. The binaural hearing system of claim 7, wherein:

the data representative of the dynamic listening scenario indicates a magnitude of the ILD between the first and second signals; and the binaural pair of sound processors is configured to determine the first degree to which the contralateral gain synchronization operation is to be performed at the first sound processor and the second degree to which the contralateral gain synchronization operation is to be performed at the second sound processor based on the magnitude of the ILD between the first and second signals.

10. The binaural hearing system of claim 1, wherein the interconnected binaural pair of sound processors is configured to perform the contralateral gain synchronization operation to the first degree by:

receiving, at the first sound processor, the first signal directly from the first microphone;

receiving, at the first sound processor, the second signal from the second sound processor by way of a communication link interconnecting the binaural pair of sound processors;

determining, at the first sound processor, a level of the first signal;

determining, at the first sound processor, a level of the second signal;

determining, at the first sound processor, the first degree to which the contralateral gain synchronization operation is to be performed;

generating, at the first sound processor, a first gain processing parameter based on exclusively the level of the first signal if the first degree is a null degree or if the level of the first signal is greater than the level of the second signal, exclusively the level of the second signal if the first degree is a full degree and the level of the second signal is greater than the level of the first signal, and both the levels of the first and second signals if the first degree is a partial degree and the level of the first signal is lesser than the level of the second signal; and performing, at the first sound processor based on the first gain processing parameter, a first gain processing operation on a first at least one of the first and second signals to thereby generate a first output signal.

11. The binaural hearing system of claim 10, wherein the interconnected binaural pair of sound processors is configured to perform the contralateral gain synchronization operation to the second degree by:

receiving, at the second sound processor, the second signal directly from the second microphone;

receiving, at the second sound processor, the first signal from the first sound processor by way of the communication link;

determining, at the second sound processor, the level of the first signal;

determining, at the second sound processor, the level of the second signal;

determining, at the second sound processor, the second degree to which the contralateral gain synchronization operation is to be performed;

generating, at the second sound processor, a second gain processing parameter based on exclusively the level of the second signal if the second degree is a null degree or the level of the second signal is greater than the level of the first signal, exclusively the level of the first signal if the second degree is a full degree and the level of the first signal is greater than the level of the second signal, and both the levels of the first and second signals if the second degree is a partial degree and the level of the second signal is lesser than the level of the first signal; and performing, at the second sound processor based on the second gain processing parameter, a second gain processing operation on a second at least one of the first and second signals to thereby generate a second output signal.

12. The binaural hearing system of claim 11, wherein:

the interconnected binaural pair of sound processors is included within a cochlear implant system and is communicatively coupled with a binaural pair of cochlear implants implanted within the user and including a first cochlear implant communicatively coupled with the first sound processor, and a second cochlear implant communicatively coupled with the second sound processor;

the first sound processor is configured to present the first output signal to the user at the first ear of the user by directing the first cochlear implant to apply electrical stimulation, based on the first output signal, to one or more locations within a first cochlea of the user; and the second sound processor is configured to present the second output signal to the user at the second ear of the user by directing the second cochlear implant to apply electrical stimulation, based on the second output signal, to one or more locations within a second cochlea of the user.

13. The binaural hearing system of claim 1, wherein the performance of the contralateral gain synchronization operation includes:

applying, at the first sound processor to at least one of the first and second signals, a first automatic gain control ("AGC") gain defined by a first AGC gain parameter generated at the first sound processor; and applying, at the second sound processor to an additional at least one of the first and second signals, a second AGC gain defined by a second AGC gain parameter generated at the second sound processor.

14. The binaural hearing system of claim 1, wherein the performance of the contralateral gain synchronization operation includes:

applying, at the first sound processor to at least one of the first and second signals, a first gain based on a first gain processing parameter generated at the first sound processor; and applying, at the second sound processor to an additional at least one of the first and second signals, a second gain based on a second gain processing parameter generated at the second sound processor;

wherein the first and second gains are each implemented as at least one of a noise cancelation gain, a wind cancelation gain, a reverberation cancelation gain, and an impulse cancelation gain, and wherein the first and second gain processing parameters are each implemented as at least one of a noise cancelation gain parameter, a wind cancelation gain parameter, a reverberation cancelation gain parameter, and an impulse cancelation gain parameter.

15. A cochlear implant system comprising:

a binaural pair of cochlear implants including a first cochlear implant implanted within a user and associated with a first ear of the user, and a second cochlear implant implanted within the user and associated with a second ear of the user;

a binaural pair of microphones including a first microphone that generates a first signal representative of an audio signal presented to the user as the audio signal is detected by the first microphone at the first ear, and a second microphone that generates a second signal representative of the audio signal as the audio signal is detected by the second microphone at the second ear;

a binaural pair of sound processors including a first sound processor associated with the first ear and coupled directly to the first microphone, the first sound processor communicatively coupled with the first cochlear implant, and a second sound processor associated with the second ear and coupled directly to the second microphone, the second sound processor communicatively coupled with the second cochlear implant; and a communication link interconnecting the binaural pair of sound processors and configured to enable transmission of the first and second signals between the first and second sound processors;

wherein:

the binaural pair of sound processors is configured to preserve an interaural level difference ("ILD") between the first and second signals by performing a contralateral gain synchronization operation to a first degree with respect to the first and second signals at the first sound processor, and to a second degree with respect to the first and second signals at the second sound processor; and the first degree is distinct from the second degree or at least one of the first and second degrees is a partial degree.

16. The cochlear implant system of claim 15, wherein the first and second degrees are each partial degrees and the first partial degree is equal to the second partial degree.

17. The cochlear implant system of claim 15, wherein the first degree is distinct from the second degree and the first and second degrees include one of:

a full degree and a null degree, a full degree and a partial degree, a partial degree and a null degree, and a first partial degree and a second partial degree that is distinct from the first partial degree.

18. The cochlear implant system of claim 15, wherein the performance of the contralateral gain synchronization operation includes:

applying, at the first sound processor to at least one of the first and second signals, a first automatic gain control ("AGC") gain defined by a first AGC gain parameter generated at the first sound processor; and applying, at the second sound processor to an additional at least one of the first and second signals, a second AGC gain defined by a second AGC gain parameter generated at the second sound processor.

19. A method of preserving an interaural level difference ("ILD") between a first signal and a second signal in a binaural hearing system, the method comprising:

receiving, by a first sound processor associated with the first ear and directly from a first microphone, the first signal, the first signal representative of an audio signal presented to a user of the binaural hearing system as the audio signal is detected by the first microphone at the first ear;

receiving, by the first sound processor from a second sound processor associated with the second ear and by way of a communication link interconnecting the first and second sound processors, the second signal, the second signal representative of the audio signal as the audio signal is detected by a second microphone at the second ear;

receiving, by the second sound processor directly from the second microphone, the second signal;

receiving, by the second sound processor from the first sound processor by way of the communication link, the first signal;

performing, by the first sound processor, a contralateral gain synchronization operation to a first degree with respect to the first and second signals; and performing, by the second sound processor, the contralateral gain synchronization operation to a second degree with respect to the first and second signals;

wherein the first degree is distinct from the second degree or at least one of the first and second degrees is a partial degree.

20. The method of claim 19, wherein the first and second degrees are each partial degrees and the first partial degree is equal to the second partial degree.

21. The binaural hearing system of claim 4, wherein:

the data representative of the hearing profile of the user is predetermined and stored in a storage facility associated with the binaural hearing system; and the interconnected binaural pair of sound processors is configured to access the data representative of the hearing profile by retrieving the data representative of the hearing profile from the storage facility.

22. The binaural hearing system of claim 4, wherein the interconnected binaural pair of sound processors is configured to access the data representative of the hearing profile by automatically performing a hearing test with respect to the user to thereby determine the data representative of the hearing profile of the user.

23. The binaural hearing system of claim 11, wherein:

the first sound processor is configured to preserve the ILD between the first and second signals by further presenting, to the user at the first ear and subsequent to the performing of the contralateral gain synchronization operation at the first sound processor, the first output signal; and the second sound processor is configured to preserve the ILD between the first and second signals by further presenting, to the user at the second ear and subsequent to the performing of the contralateral gain synchronization operation at the second sound processor, the second output signal.

24. The cochlear implant system of claim 15, wherein:

the first degree is a full degree and the second degree is a null degree; and the interconnected binaural pair of sound processors is configured to perform the contralateral gain synchronization operation to the full degree at the first sound processor by:

receiving, at the first sound processor, the first signal directly from the first microphone, receiving, at the first sound processor, the second signal from the second sound processor by way of the communication link, determining, at the first sound processor, a level of the first signal, determining, at the first sound processor, a level of the second signal, generating, at the first sound processor, a first gain processing parameter based on exclusively the level of the first signal if the level of the first signal is greater than the level of the second signal, and exclusively the level of the second signal if the level of the second signal is greater than the level of the first signal, and performing, at the first sound processor based on the first gain processing parameter, a first gain processing operation on a first at least one of the first and second signals to thereby generate a first output signal.

25. The cochlear implant system of claim 24, wherein the interconnected binaural pair of sound processors is configured to perform the contralateral gain synchronization operation to the null degree at the second sound processor by:

receiving, at the second sound processor, the second signal directly from the second microphone;

receiving, at the second sound processor, the first signal from the first sound processor by way of the communication link;

determining, at the second sound processor, the level of the first signal;

determining, at the second sound processor, the level of the second signal;

generating, at the second sound processor, a second gain processing parameter based on exclusively the level of the second signal; and performing, at the second sound processor based on the second gain processing parameter, a second gain processing operation on a second at least one of the first and second signals to thereby generate a second output signal.

* * * * *